US008702265B2

(12) United States Patent
May

(10) Patent No.: US 8,702,265 B2
(45) Date of Patent: Apr. 22, 2014

(54) NON-CURVILINEAR LED LUMINARIES

(76) Inventor: Michael W. May, Lakewood, IL (US)

( * ) Notice: Subject to any disclaimer, the term of this patent is extended or adjusted under 35 U.S.C. 154(b) by 183 days.

(21) Appl. No.: 13/440,423

(22) Filed: Apr. 5, 2012

(65) Prior Publication Data

US 2013/0265746 A1 Oct. 10, 2013

(51) Int. Cl.

| | |
|---|---|
| ***F21V 21/005*** | (2006.01) |
| ***G09F 13/04*** | (2006.01) |
| ***F21S 8/04*** | (2006.01) |
| ***F21V 5/04*** | (2006.01) |
| ***F21V 29/00*** | (2006.01) |

(52) U.S. Cl.
USPC ..... 362/147; 362/217.01; 362/217.02; 362/218; 362/225; 362/249.02

(58) Field of Classification Search
CPC ..... F21V 21/005; G09F 13/04; F21S 8/04
USPC ..... 362/147, 217.01, 217.02, 218, 225, 362/249.02
See application file for complete search history.

(56) References Cited

U.S. PATENT DOCUMENTS

| | | | | |
|---|---|---|---|---|
| 6,283,612 | B1 * | 9/2001 | Hunter | 362/240 |
| 6,578,979 | B2 | 6/2003 | Truttmann-Battig | |
| 6,623,151 | B2 * | 9/2003 | Pederson | 362/542 |
| 7,195,370 | B2 | 3/2007 | Riblett et al. | |
| 7,476,004 | B2 * | 1/2009 | Chan | 362/240 |
| 7,513,637 | B2 | 4/2009 | Kelly et al. | |
| 7,637,636 | B2 | 12/2009 | Zheng et al. | |
| 7,918,580 | B2 | 4/2011 | Liu | |
| 7,976,185 | B2 * | 7/2011 | Uang et al. | 362/240 |
| 7,976,187 | B2 | 7/2011 | Villard | |
| 7,989,827 | B2 | 8/2011 | Hsu | |
| 8,052,295 | B2 | 11/2011 | Kim et al. | |
| 8,235,539 | B2 | 8/2012 | Thomas et al. | |
| 2007/0159828 | A1 | 7/2007 | Wang | |
| 2007/0246714 | A1 | 10/2007 | Koike et al. | |
| 2010/0327768 | A1 | 12/2010 | Kong et al. | |
| 2011/0019421 | A1 | 1/2011 | Lai | |
| 2011/0235321 | A1 | 9/2011 | Ivey et al. | |

OTHER PUBLICATIONS

Notification of Transmittal of the International Search Report and the Written Opinion of the International Searching Authority, or the Declaration from the International Bureau of WIPO for corresponding International Application No. PCT/US2012/037242, dated Aug. 13, 2012, 13 pages.

* cited by examiner

*Primary Examiner* — Stephen F Husar
*Assistant Examiner* — James Cranson, Jr.
(74) *Attorney, Agent, or Firm* — Fitch, Even, Tabin & Flannery, LLP

(57) ABSTRACT

An improved light emitting diode (LED) illuminating assembly is provided with a multiple sided LED lighting bar, also referred to as a multi-sided LED light bar, comprising a non-curvilinear LED luminary for enhanced LED lighting. The LED illuminating assembly can be used for overhead ceiling lighting, menu boards and other LED illuminating signs, as well as for other uses.

22 Claims, 49 Drawing Sheets

Fig. 47
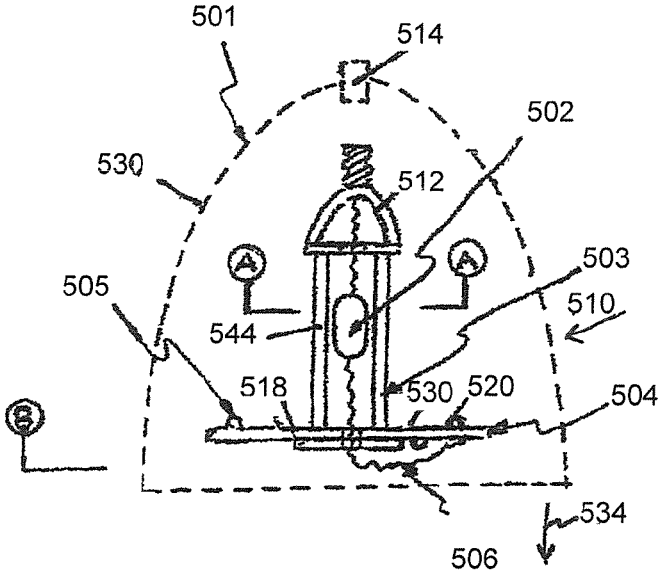
Fig. 48
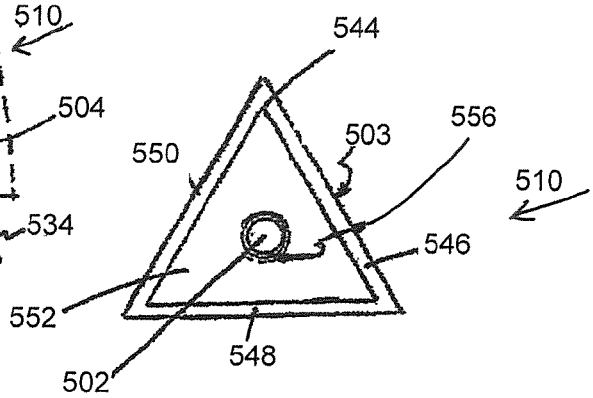
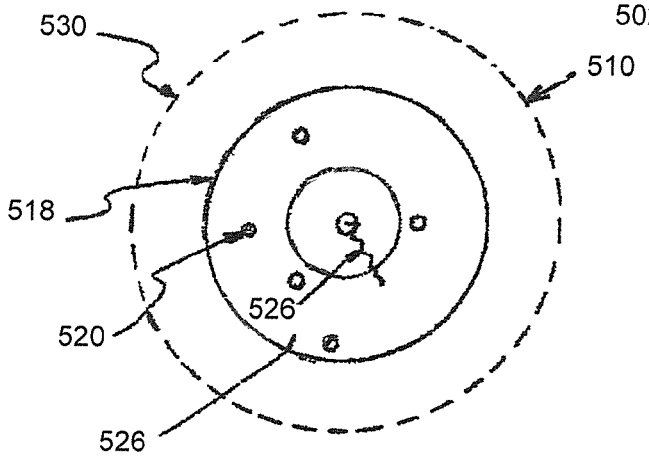
Fig. 49

NON-CURVILINEAR LED LUMINARIES

BACKGROUND OF THE INVENTION

This invention relates to lighting and, more particularly, to light emitting diode (LED) illumination.

Over the years various types of illuminating assemblies and devices have been developed for indoor and/or outdoor illumination, such as torches, oil lamps, gas lamps, lanterns, incandescent bulbs, neon signs, fluorescent bulbs, halogen lights, and light emitting diodes. These conventional prior art illuminating assemblies and devices have met with varying degrees of success.

Incandescent light bulbs create light by conducting electricity through a thin filament, such as a tungsten filament, to heat the filament to a very high temperature so that it glows and produces visible light. Incandescent light bulbs emit a yellow or white color. Incandescent light bulbs, however, are very inefficient, as over 98% of its energy input is emitted and generated as heat. A standard 100 watt light bulb emits about 1700 lumens, or about 17 lumens per watt. Incandescent lamps are relatively inexpensive and have a typical lifespan of about 1,000 hours.

Fluorescent lamps (light bulbs) conduct electricity through mercury vapor, which produces ultraviolet (UV) light. The ultraviolet light is then absorbed by a phosphor coating inside the lamp, causing it to glow, or fluoresce. While the heat generated by fluorescent lamps is much less than its incandescent counterpart, energy is still lost in generating the UV light and converting UV light into visible light. If the lamp breaks, exposure to mercury can occur. Linear fluorescent lamps are often five to six times the cost of incandescent bulbs but have life spans around 10,000 and 20,000 hours. Lifetime varies from 1,200 hours to 20,000 hours for compact fluorescent lamps. Some fluorescent lights flicker and the quality of the fluorescent light tends to be a harsh white due to the lack of a broad band of frequencies. Most fluorescent lights are not compatible with dimmers.

Light emitting diode (LED) lighting is particularly useful. Light emitting diodes (LEDs) offer many advantages over incandescent light sources, including: lower energy consumption, longer lifetime, improved robustness, smaller size, faster switching, and excellent durability and reliability. LEDs emit more light per watt than incandescent light bulbs. LEDs can be tiny and easily placed on printed circuit boards. LEDs activate and turn on very quickly and can be readily dimmed LEDs emit a cool light with very little infrared light. LEDs come in multiple colors which are produced without the need for filters. LEDs of different colors can be mixed to produce white light. Other advantages of LEDs include: high efficiency; low energy consumption; higher outputs at higher drive currents; shock resistant with no filament, glass or tube to break, contain no toxic substances, hazardous mercury or halogen gases.

The operational life of some white LED lamps is 100,000 hours and 11 years of continuous operation. The long operational life of an LED lamp is much longer than the average life of an incandescent bulb, which is approximately 5000 hours. If the lighting device needs to be embedded into a very inaccessible place, using LEDs would minimize the need for regular bulb replacement. With incandescent bulbs, the cost of replacement bulbs and the labor expense and time needed to replace them can be significant especially where there are a large number of incandescent bulbs. For office buildings and high rise buildings, maintenance costs to replace bulbs can be expensive and can be substantially decreased with LED lighting.

An important advantage of LED lighting is reduced power consumption. An LED circuit will approach 80% efficiency, which means 80% of the electrical energy is converted to light energy; the remaining 20% is lost as heat energy. Incandescent bulbs, however, operate at about 20% efficiency with 80% of the electrical energy is lost as heat. Repair and replacement savings can be significant, as most incandescent light bulbs burn out within a year and require replacements whereas LED light bulbs can be used easily for a decade without burning out.

LED light (lighting) bars are considered to be much better than incandescent lights. Incandescent light bulbs do not last for a long time and the filament burns out. A LED light bar consumes less energy and has a longer life. LED light output is much brighter than that of an incandescent light bulb.

An assortment of colors and flash patterns are available with LED light bars for emergency vehicles such as police cars, fire trucks and ambulances. Emergency vehicles such as ambulances and police cars prefer mounting a LED light bar on the top for easy recognition and visibility. LED light bars can be used on the interior as well as on the exterior of the emergency vehicles as it emits sufficient light even in the darkest of areas. Furthermore, since the heat produced by LED light bars is small, it won't adversely affect the interior of the vehicle.

LEDs are used in applications as diverse as aviation lighting, traffic signals and automotive lighting such as for brake lights, turn signals and indicators. LEDs have a compact size, fast switching speed and good reliability. LEDs are useful for displaying text and video and for communications. Infrared LEDs are also used in the remote control units of many commercial products including televisions, DVD players and other domestic appliances.

Solid state devices such as LEDs have excellent wear and tear if operated at low currents and at low temperatures. LED light output actually rises at colder temperatures (leveling off depending on type at around −30 C.). Consequently, LED technology may be a good replacement for supermarket freezer lights and will often last longer than other types of lighting.

Large-area LED signs and displays are used as stadium displays and as decorative displays. LED message displays are used at airports and railway stations, and as destination displays for trains, buses, trams, and ferries.

With the development of efficient high power LEDs, it has become more advantageous to use LED lighting and illumination. High power white light LED lighting is useful for illumination and for replacing incandescent and/or fluorescent lighting. LED street lights are used on posts, poles and in parking garages. LED's are now used in stores, homes, stage and theaters, and public places. Furthermore, color LED's are useful in medical and educational applications such as for mood enhancement. In many countries incandescent lighting for homes and offices is no longer available and building regulations require new premises to use LED lighting.

Conventional prior art LED lighting which is powerful enough for room lighting, however, is relatively expensive and require more precise current and heat management than fluorescent lamp sources of comparable output. Furthermore, conventional LED lighting can have a higher capital cost than other types of lighting and LED light tends to be directional with small areas of illumination. Moreover, conventional LED luminaries suffer from drawbacks due to a lack of lumen output and less than desirable light dispersion. Individually and combined, these aspects of conventional LED lighting can detract from efficient utilization of LED luminaries.

It is, therefore, desirable to provide an improved LED illuminating assembly, which overcomes most, if not all of the preceding problems and disadvantages.

BRIEF SUMMARY OF THE INVENTION

An improved light emitting diode (LED) illuminating assembly is provided with a novel multiple sided LED lighting bar, also referred to as a multi-sided LED light bar, comprising a non-curvilinear LED luminary for enhanced LED lighting. Advantageously, the inventive LED illuminating assembly with the novel multi-sided light bar is efficient, effective, economical, convenient and safe. Desirably, the user friendly LED illuminating assembly with the compact multi-sided light bar produces outstanding illumination, is easy to manufacture and install, and has a long life span. The improved LED illuminating assembly and attractive multi-sided light bar are also reliable, durable and impact and breakage resistant.

The improved LED illuminating assembly can feature: a multi-sided light bar, such as with two, three, four or five sides; an internal non-switching driver; a scalable length; and an emitter count optimized for efficiency. The improved LED luminary assembly can also feature: parallel-series wiring; a no-wire design using a unique end cap design; a lens cover cap per design requirements to modify the beam angle; and redundancy in the driver.

There are many advantages of the inventive LED illuminating assembly with a novel multi-sided LED lighting bar comprising a non-curvilinear LED luminary versus conventional LED lighting.

1. The use of multi-sided light bar allows for a much wider distribution of light. A standard solution has about 100-110 degree light beam to half brightness. The inventive LED illuminating assembly with the novel multi-sided LED lighting bar, however, can reach a full 360 degrees with little or no loss of brightness. Furthermore, the illustrated two-sided design can reach over 180 degrees to half-brightness. Another advantage is near-field use; lighting something just a few inches from the light source.
2. The internal driver of the improved LED illuminating assembly with the multi-sided lighting bar is less expensive, uses less labor, is simpler and has lower chance of failure over conventional lighting.
3. The non-switching driver of the improved LED illuminating assembly with the multi-sided lighting bar provides a boost of efficiency on the scale of 4-7 magnitude. A typical switching driver which is used on conventional LED lighting bars has a typical efficiency of 80-85% or 15-20% loss. In contrast, the improved LED illuminating assembly with the multi-sided lighting bar can have an efficiency of 95-97% (3-5% loss), and is four to seven time more efficient than conventional lighting. This improvement results in about 20% overall efficiency gain. Since much of the power is spent on the LEDs it takes an increase of 5 times improvement in driver efficiency to net a 20% gain in overall efficiency. Desirably, the improved LED illuminating assembly with the multi-sided lighting bar can achieve greater than 90% efficiency, an impossibility with conventional switching drivers.

The improved LED illuminating assembly with the multi-sided lighting bar desirably can optimize the emitter count to the voltage source and can advantageously utilize wiring of the emitters in a parallel-series arrangement in the appropriate numbers.

In the improved LED illuminating assembly with the novel multi-sided lighting bar, the diffuser comprising the lens can be modified to change the output of the beam. By use of this arrangement, dark spots can be eliminated so that a much higher illuminating output can be attained. The improved LED illuminating assembly with the multi-sided lighting bar example can emit a 360 degree beam without visible hot or cold spots.

The improved LED illuminating assembly with the multi-sided lighting bar can also have scalable length since there is no theoretical limit to the length of the novel arrangement and design. The length may be governed, however, by customer needs, costs, available space, and production capabilities.

The improved LED illuminating assembly with the multi-sided lighting bar further has driver redundancy using parallel and multiple driver sub-circuits for even better reliability. This achieves two other important goals:

1. The improved LED illuminating assembly with the multi-sided lighting bar attains even, accurate power levels to all emitters. In contrast, conventional LED designs do not control the current to all the emitters evenly, but apply a metered amount of current to all parallel circuits, typically as many as three to eight of them, and the current can vary on each parallel circuit because there is no control per sub-circuit. The improved LED illuminating assembly with the multi-sided lighting bar can controls each sub-circuit independently so that every emitter in the entire light assembly gets exactly the same current.
2. The improved LED illuminating assembly with the multi-sided lighting bar achieves reliability of output even in the event of sub-circuit failure.

In a conventional LED design with output 300 mA to three branches or sub-circuits, when one fails, then two sub-circuits will share that same 300 mA so they will go from 100 mA to 150 mA, which is a huge change in current that is not desirable and is likely to cause a cascading failure. In the improved LED illuminating assembly with the multi-sided lighting bar, if one sub-circuit has a failure, the remaining circuits operate exactly as they were, and can operate like that indefinitely.

Furthermore, in the improved LED illuminating assembly with the multi-sided lighting bar, the sub-circuits can be spread out so that no one portion of the light assembly goes completely dark, but will just dim. This can be very important when lighting up a sign so that although it may be a little darker in one spot, the sign will still be lit up and readable.

In conventional LED illumination, all the emitters are in series with each other so in the event of a single LED failure that entire row blinks out (think of Christmas tree lights) and that entire portion of the light assembly will go dark. In the improved LED illuminating assembly with the multi-sided lighting bar, the strings or set of emitters are aligned and connected in parallel with every other emitter so that in the event of failure of one sub-circuit, the LED lamp of the LED illuminating assembly goes to 50% brightness but is evenly lit from edge to edge.

The improved LED illuminating assembly with the multi-sided lighting bar also achieves efficiency over initial capital costs. Conventional LED designs attempt to maximize lumens per emitter and are designed according to the specification ("spec") of the emitter. Emitters operating 'at spec' tend to net about 80 Lumen/watt total.

The improved LED illuminating assembly with the multi-sided lighting bar can be specifically under-driven to achieve some very valuable goals:

1. Longer life span. For example, an emitter operating at 70% of rated capacity will last 70-80,000 hours when specified at 50,000 hours. That's a difference of 8.6 to 5.7 years when run 24 hours per day at seven days a week.

2. Higher efficacy. The improved LED illuminating assembly with the multi-sided lighting bar can achieve over 100 L/W system total by de-tuning the current drive of the emitter. The improved LED illuminating assembly with the multi-sided lighting bar can achieve the same total output by adding more emitters. This may make the initial cost higher but the operational cost will be much lower. This is shown in the illustrated operational costs chart which compares the high output 3600 L LED light bar to the high efficiency 3000 L LED light bar with the exact same design just set to different drive operating levels because the LEDs that are more efficient and last longer when driven below spec.

3 Higher reliability. Within their expected lifespan, LED emitters will maintain lumen longer and maintain color temperature longer when they are cooler, if the temperature is directly proportional to LED drive current. An over-driven LED will lose color temp accuracy quicker than one driven at spec. An under driven LED can maintain lumen and color temperature longer than even one driven to 'spec'.

The improved LED illuminating assembly can have a no-wire design such that the novel light bar of the improved LED luminary assembly has no electrical wires. This arrangement can decrease assembly problems and lower failure rate associated with complexity in a manual labor portion of the assembly. A conventional LED light bar can have at least twelve hand-made solder joints. The new design can include only two hand-made solder joints as well as eliminating 100% of the electrical wiring. Elimination of standard electrical wires can increase both initial and long term reliability.

The improved light emitting diode (LED) illuminating assembly can comprise a multiple sided modular LED lighting bar, which is also referred to as a multi-sided modular LED light bar, comprising a non-curvilinear LED luminary with a multi-sided elongated tubular array having multiple, server, numerous or many sides comprising modular boards which can define panels with longitudinally opposite ends. The tubular array preferably has a non-curvilinear cross-sectional configuration (cross-section) without and in the absence of a circular cross-sectional configuration, oval configuration, elliptical cross-sectional configuration and a substantially curved or round cross-sectional configuration. Each of the sides of the multi-sided tubular array can have a generally planar flat surface as viewed from the ends of the array, and adjacent sides can intersect each other and converge at an angle of inclination. Operatively positioned and connected to the multi-sided array can be an internal non-switching printed circuit board (PCB) driver comprising a driver board. The driver can be an interior or inner driver board positioned within an interior of the tubular array or can be an exterior or outer driver board comprising and providing one of the sides of the tubular array. Desirably, at least two or some of the sides comprise modular LED emitter boards which can provide elongated LED PCB panels. The internal driver comprising the driver board can drive the LED emitter boards and can comprise one or more modular driver boards that are connected in series and/or parallel to each other.

The improved LED illuminating assembly comprising a multi-sided light bar providing a non-curvilinear (LED) luminary can have an optimal count of LED emitters comprising a group, set, matrix, series, multitude, plurality or array of light emitting diodes (LEDs) securely positioned, mounted and arranged on each of the emitter boards for emitting and distributing light outwardly from the emitter boards in a light distribution pattern for enhanced LED illumination and operational efficiency.

One or more end cap PCB connectors providing connector end boards which are also referred to as end cap boards can be positioned at one or both of the ends of the tubular array and connected to the internal driver board and the emitter boards. The connector end boards can have connector pins which can extend longitudinally outwardly for engaging at least one light socket. One or more end caps can be positioned about the end cap PCB connectors. The end caps can have bracket segments which provide clamps that can extend longitudinally inwardly for abuttingly engaging and clamping the emitter boards.

The boards can have matingly engageable male and female connectors such that the connectors on the connector end boards matingly engage, connect and plug into matingly engageable female and male connectors on the driver board and on the emitter boards.

The boards comprising the emitter boards and driver board can be generally rectangular. Each of the sides of the multi-sided array comprising emitter boards can comprise a single emitter board or a set, series, plurality, or multiple elongated emitter boards that are longitudinally connected end to end. The sides comprising emitter boards can include all of the sides of the tubular array or all but one of the sides of the tubular array with the one other side comprising the driver board. The driver board can comprise a single driver board or multiple driver boards that are longitudinally connected end to end.

A multiple sided tubular heat sink comprising multiple metal sides can be positioned radially inwardly of the multi-sided tubular array for supporting and dissipating heat generated from the emitter boards and driver board. The heat sink can have a tubular cross-section which is generally complementary or similar to the cross-sectional configuration of the multi-sided tubular array. The cross-section of the heat sink preferably can have a non-curvilinear cross-section without and in the absence of a circular cross-section, oval cross-section, elliptical cross-section and a substantially or round curved cross-section.

The improved LED illuminating assembly comprising a multi-sided light bar providing a non-curvilinear (LED) luminary can have emitter traces for connecting the LED emitters in parallel and/or in series and can have alternating current (AC) and/or direct current (DC) lines. The emitters can comprise at least one row of substantially aligned aliquot uniformly spaced LED emitters. Desirably, the multi-sided light bar provides a no wire design in the absence of electrical wires.

The improved LED illuminating assembly comprising a multi-sided light bar providing a non-curvilinear (LED) luminary can also have a diffuser comprising an elongated light diffuser cover which provides a light transmissive lens positioned about and covering the LED emitters for reflecting, diffusing and/or focusing light emitted from the LED emitters.

In one embodiment, the lighting bar comprises: a two sided lighting bar; the array comprises a two sided array; the heat sink comprises a heat sink with at least two sides; the emitter boards are arranged in a generally V-shaped configuration at an angle of inclination ranging from less than 180 degrees to an angle more than zero degrees; and the driver is positioned in proximity to an open end of the V-shaped configuration.

In another embodiment, the lighting bar comprises: a three sided lighting bar; the array comprises a three sided delta or triangular array; the heat sink comprises a tubular three sided heat sink with a delta or triangular cross-section; and the angle of inclination can range from less than 180 degrees to an angle more than zero degrees, and is preferably about 120 degrees. The driver can be positioned within the interior of the delta or triangular cross-section of the three sided heat sink.

In a further embodiment, the lighting bar comprises: a four sided lighting bar; the array comprises a square or rectangular array; the heat sink comprises a tubular four sided heat sink with a square or rectangular cross-section; and the angle of inclination can be a right angle of about 90 degrees.

In still another embodiment, the lighting bar comprises: a five sided lighting bar; the array comprises a pentagon array; the heat sink comprises a tubular five sided heat sink with a pentagon cross-section; and the angle of inclination of the intersecting sides of the pentagon can comprise an acute angle, preferably at about 72 degrees.

Light bars, arrays and heat sinks with more than five sides can also be used.

The improved LED illuminating assembly can comprise an illuminated LED sign, such as an outdoor sign or an indoor sign. The outdoor sign can comprise an outdoor menu board, such as for use in a drive through restaurant. The indoor sign can comprise an indoor menu board such as for use in an indoor restaurant. LED signs can also be provided for other uses. The illuminated LED sign can comprise: a housing with light sockets; at least one light transmissive panel providing an illuminated window connected to the housing; multiple sided LED lighting bars, which are also referred to as multi-sided light bars, of the type previously described, connected to the light sockets for emitting light through the illuminated window; and the illuminated window can be movable from a closed position to an open position for access to the LED lighting bars. The lighting bars can extend vertically, horizontally, longitudinally, transversely or laterally along portions of the housing. The illuminated window can be covered by a diffuser.

The improved LED illuminating assembly can also comprise an overhead LED lighting assembly providing overhead ceiling lighting with: translucent ceiling panels comprising light transmissive ceiling tiles; at least one drop ceiling light fixture comprising light sockets; and at least one multiple sided LED lighting bar (multi-sided light bar) of the type previously described, connected to the light sockets and positioned above the ceiling panels for emitting light downwardly through the translucent ceiling panels into a room. At least one concave light reflector can be positioned above the LED lighting bar.

In a preferred aspect of the present invention, the luminary is provided in a non-curvilinear or rectilinear shape. In a more preferred aspect, the luminary has a triangular elongated shape. The individual LEDs, a power, source, and a mount board are capable of being within or along any of the elongated sides of the luminary.

Advantageously, the improved LED illuminating assembly with a novel multi-sided LED lighting bar comprising a non-curvilinear LED luminary as recited in the patent claims produced unexpected surprisingly good results.

The term "non-curvilinear" as used in this application means that the sides are generally flat or planar even if portions of the end caps, end cap connectors or heat sink are curved or rounded.

A more detailed explanation of the invention is provided in the following detailed descriptions and appended claims taken in conjunction with the accompanying drawings.

BRIEF DESCRIPTION OF THE DRAWINGS

FIG. 47 is a schematic diagram of another prototype non-curvilinear LED luminary in accordance with principles of the present invention.

FIG. 48 is an enlarged cross-sectional view of a prototype delta three sided non-curvilinear LED luminary in accordance with principles of the present invention and taken along line A-A of FIG. 47.

FIG. 49 is a bottom view of the non-curvilinear LED taken along line B of FIG. 48.

DETAILED DESCRIPTION OF THE INVENTION

The following is a detailed description and explanation of the preferred embodiments of the invention and best modes for practicing the invention.

Figure 1:
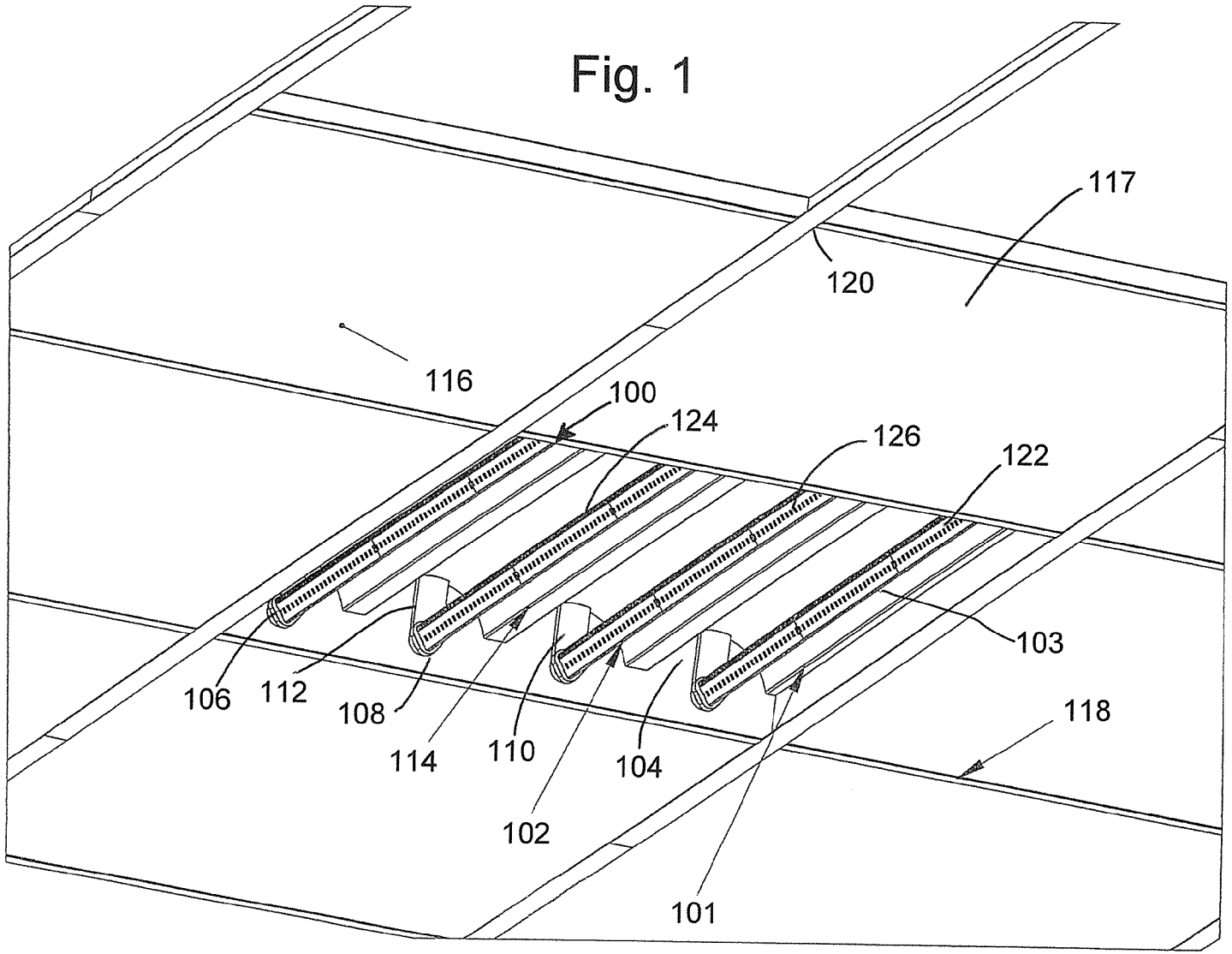
FIG. 1 is a perspective view of an LED drop ceiling fixture with three sided delta non-curvilinear LED luminaries mounted to a ceiling above ceiling panels in accordance with principles of the present invention.
Figure 2:
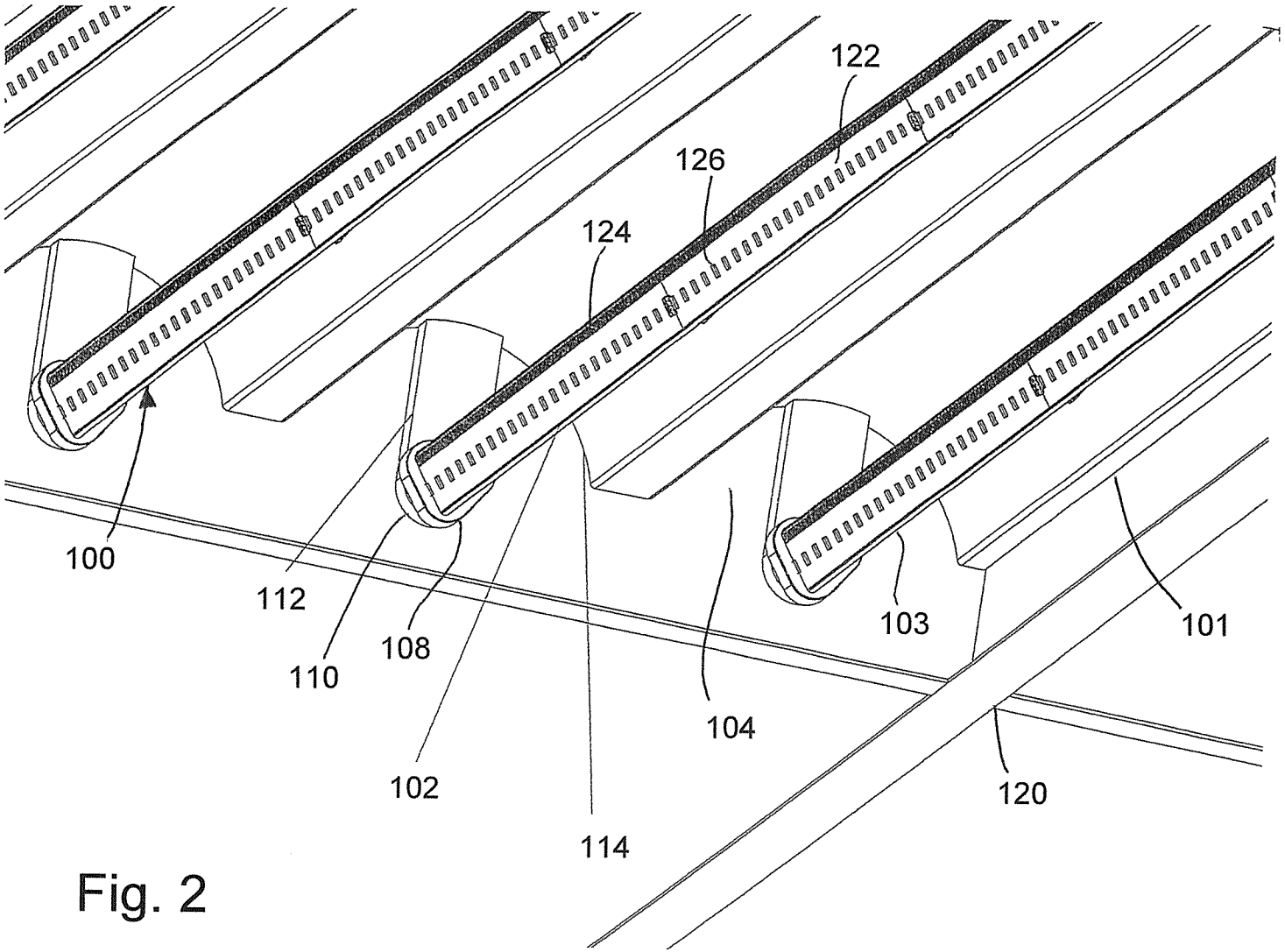
FIG. 2 is an enlarged view of portions of the LED drop ceiling fixture with three sided delta non-curvilinear LED luminaries of FIG. 1.
Figure 3:
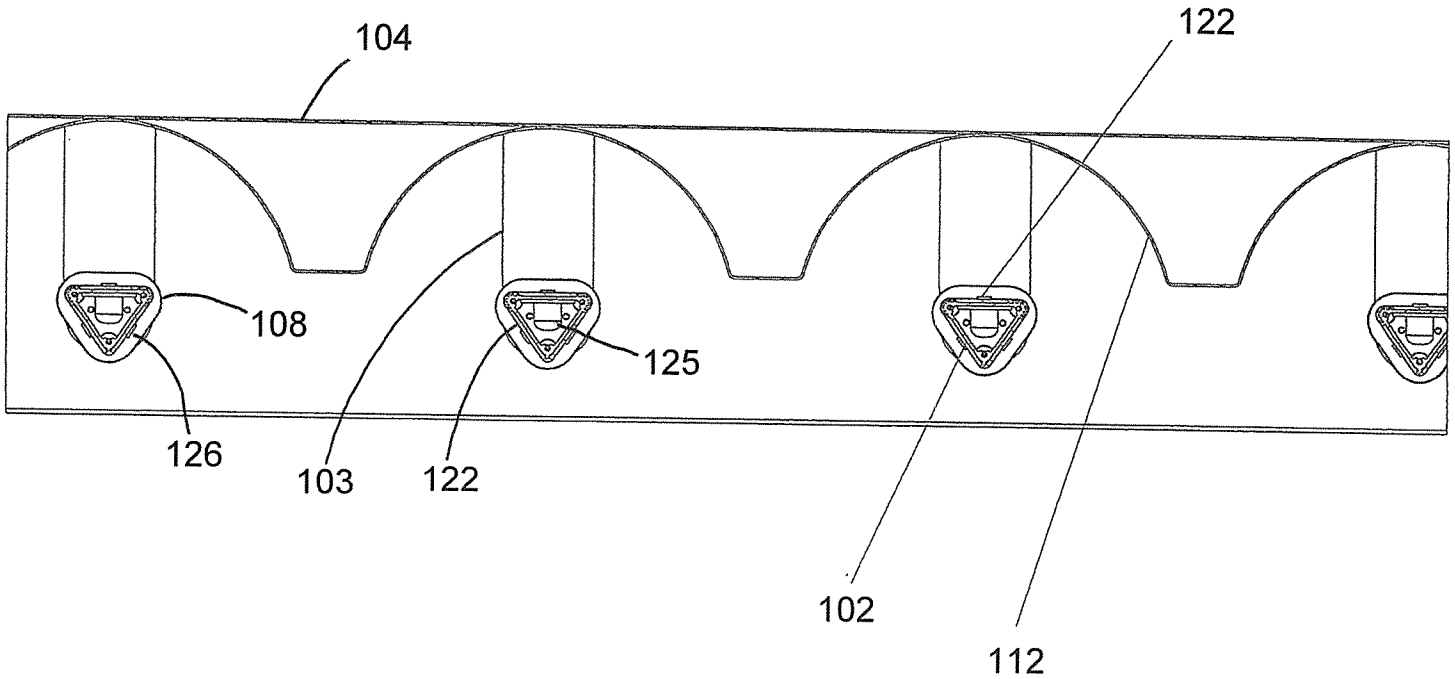
FIG. 3 is a cross-section view of the LED drop ceiling fixture with three sided delta LED non-curvilinear luminaries of FIG. 1.
Figure 4:
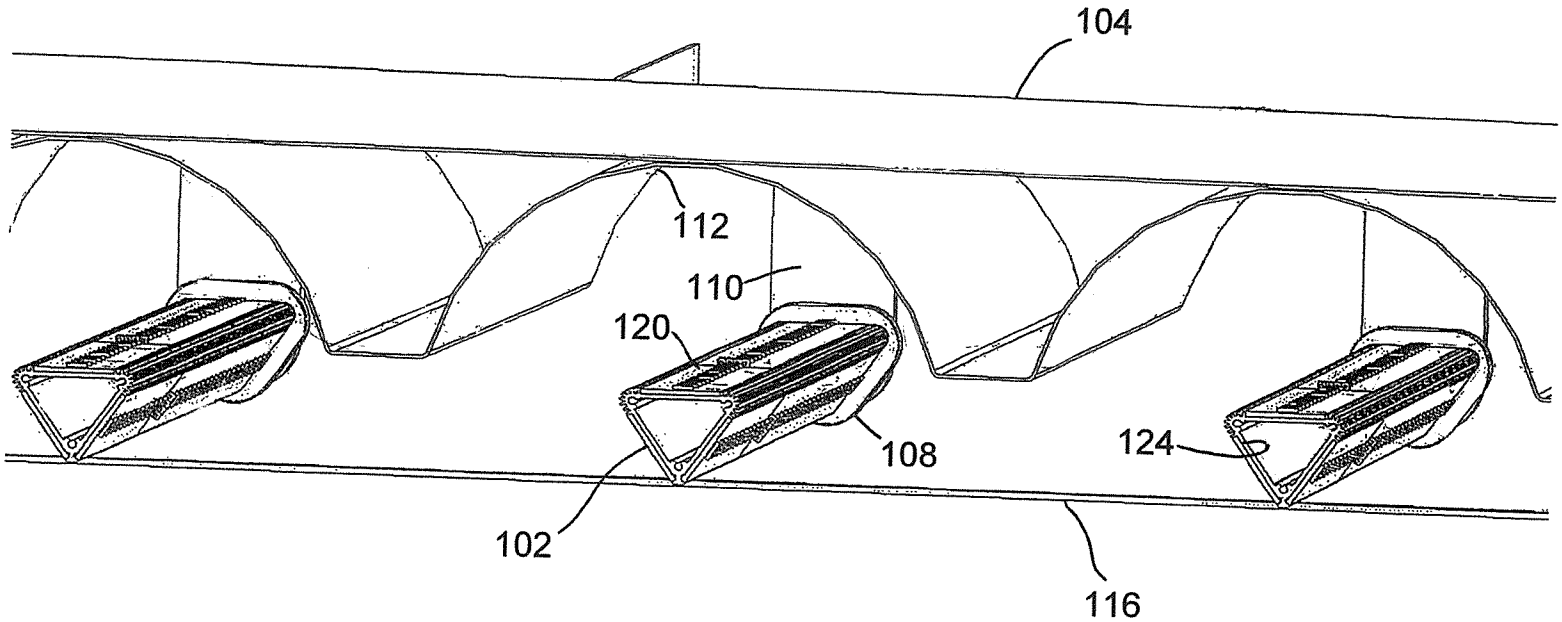
FIG. 4 is an enlarged perspective view of the three sided delta LED luminaries of FIG. 1.

Referring to the drawings, FIG. 1 is a perspective view of a light emitting diode (LED) light illuminating assembly 100 comprising an overhead LED lighting assembly providing overhead ceiling lighting with a two by four (2×4) LED drop ceiling fixture 101 with a multiple sided modular LED lighting bars 102, which are also referred to a multi-sided LED light bars. The lighting bars can comprise three sided delta triangular shaped non-curvilinear light emitting diode (LED) luminaries 103 which can be mounted to a ceiling 104, such as by power connector pins 106 extending from three sided delta triangular shaped end caps 108 which can securely engage light sockets 110. FIG. 2 is an enlarged view of portions of the multi-sided LED lighting bar comprising a LED drop ceiling fixture with three sided delta non-curvilinear LED luminaries of FIG. 1. Upright metal side members 112 can provide a bracket which can integrally extend between and connect the light sockets to overhead metal concave light reflectors 114. The light reflectors can be positioned above the three sided delta non-curvilinear LED luminaries to reflect light downwardly towards a floor. The three sided delta non-curvilinear LED luminaries, sockets and reflectors can be positioned above light transmissive translucent ceiling panels 116 (FIG. 1) providing light transmissive ceiling tiles arranged in a grid or pattern. The ceiling tiles can comprise an elongated light diffuser 117 providing a light transmissive lens for diffusing and/or focusing light emitted from the LED emitted on towards the floor. The ceiling panels can be connected by a ceiling grid 118 of longitudinal and lateral rows of ceiling panel-connectors 120. FIG. 3 is a cross-section view of the LED drop ceiling fixture with three sided delta LED non-curvilinear luminaries and illustrating elongated LED emitter printed circuit board (PCB) panels 122, which are also referred to as modular LED emitter boards. The LED PCB panels can be mounted or otherwise secured upon and/or positioned radially outwardly of the sides of an elongated three sided, delta or triangular tubular metal heat sink 124 (FIG. 1) to form a three sided delta or triangular array or set of emitter boards. The intersecting sides of the three sided heat sink can provide corners and apexes of the heat sink which sink can be raised, rounded, or chamfered, if desired. An internal non-switching PCB 125 comprising a driver board can be positioned in the interior of the array to drive the emitter boards. FIG. 4 is an enlarged perspective view of the three sided delta LED luminaries. Each of the three sided LED emitter PCB panels can contain a set, matrix or array of one or more rows of aligned, aliquot, uniformly spaced LED emitters 126. The heat sink can comprise an aluminum extrusion and can dissipate heat generated by the LED emitters and driver.

Figure 5:
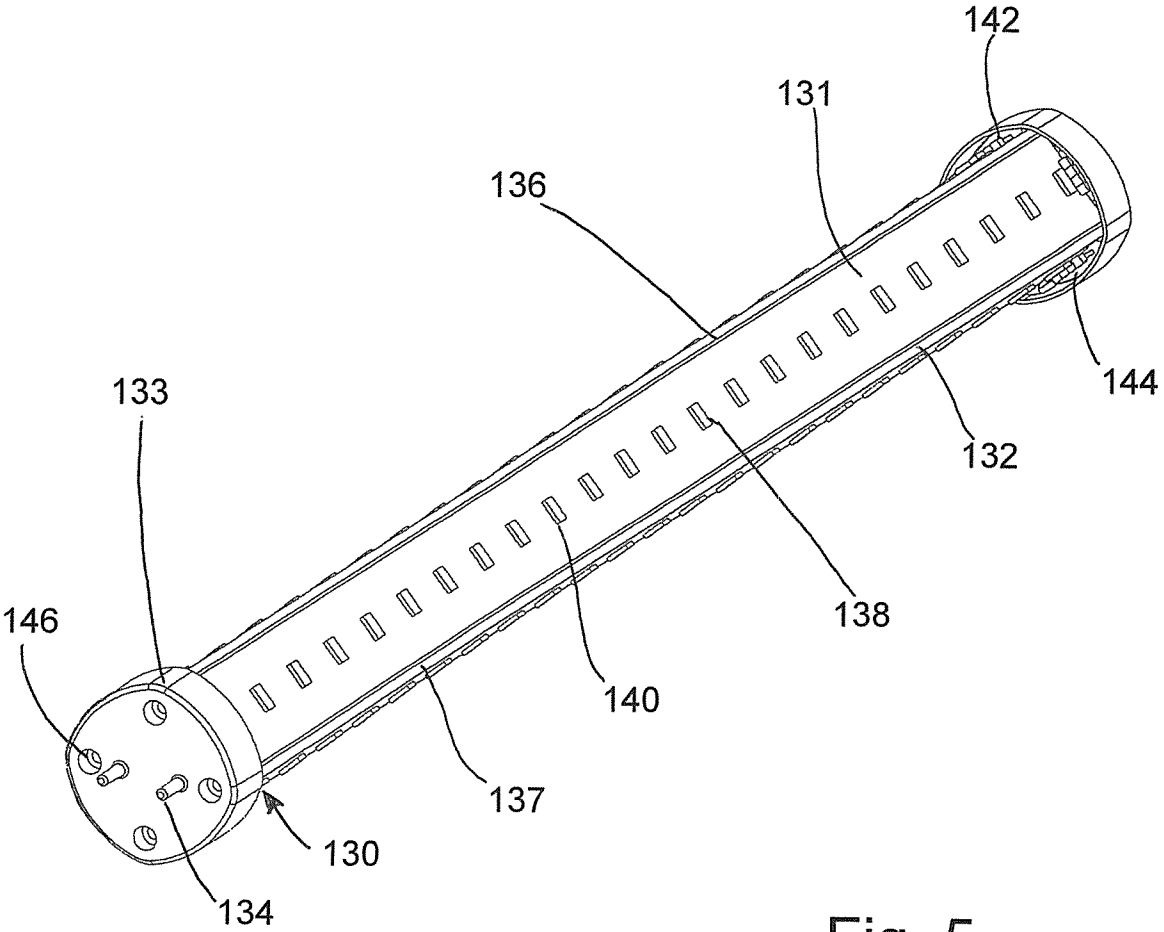
FIG. 5 is a perspective view of a four sided rectangular or square non-curvilinear LED luminary in accordance with principles of the present invention.

FIG. 5 is a perspective view of a LED illuminating light assembly 130 comprising a four sided modular LED lighting bar 131 (LED light bar) providing a four sided rectangular or square non-curvilinear LED luminary 132 which can have end caps 133 and outwardly extending power connector pins 134 for securely engaging a light socket. The four sided LED luminary can have an elongated four sided tubular metal heat sink 136, such as formed from an aluminum extrusion. The intersecting sides of the four sided heat sink can provide corners and apexes 137 of the heat sink which can be raised, rounded, curved or chamfered, if desired. Elongated LED emitter PCB panels 138 providing modular emitter boards can be mounted or otherwise secured upon and/or positioned radially outwardly of the heat sink in a generally rectangular shaped array. Each of the LED emitter PCB panels can be rectangular and can contain one or more rows of aligned, aliquot, uniformly spaced LED emitters 140. The heat sink can dissipate heat generated by the LED emitters. Terminals 142 can be connected to an end cap printed circuit board (PCB) connector 144 comprising a connector end board which is also referred to as an end cap board that can be fastened by screws 146 to the end cap. An internal non-switching PCB driver comprising a driver board can be positioned in the interior of the array to drive the emitter boards.

Figure 6:
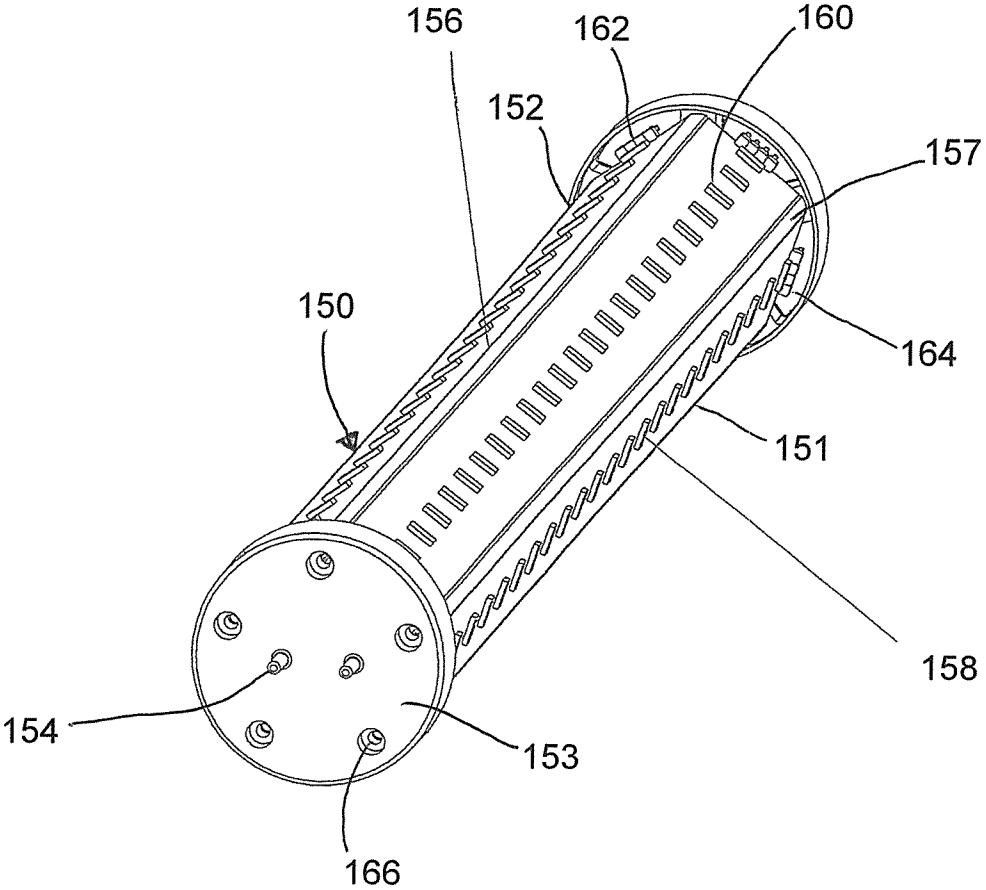
FIG. 6 is a perspective view of a five sided pentagon non-curvilinear LED luminary in accordance with principles of the present invention.
Figure 7:
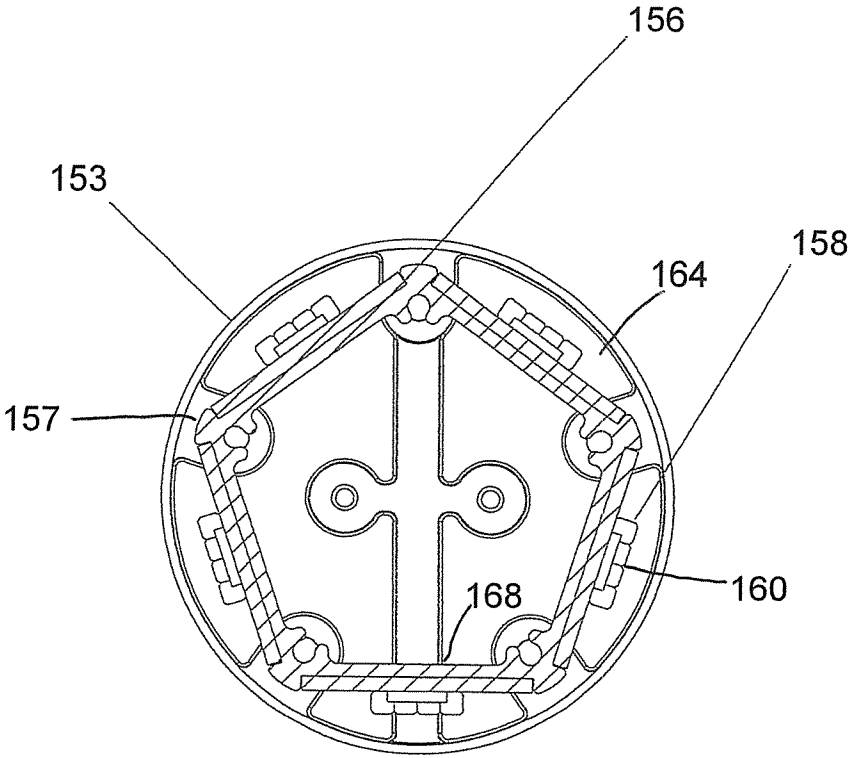
FIG. 7 is an enlarged cross-sectional view of the five sided pentagon non-curvilinear LED luminary of FIG. 6.

FIG. 6 is a perspective view of a LED illuminating assembly 150 comprising a five sided modular LED lighting bar 151 (LED light bar) providing a five sided pentagon shaped non-curvilinear LED luminary 152. The luminary can have end caps 153 and outwardly extending power connector pins 154 for securely engaging a light socket. The five sided LED luminary can have an elongated five sided pentagon shaped tubular metal heat sink 156, such as formed from an aluminum extrusion. The intersecting sides of the pentagon heat sink provides corners and apexes 157 of the heat sink which can be raised, rounded, curved or chamfered, if desired. Elongated LED emitter PCB panels 158, also referred to as modular LED emitter boards, can be mounted or otherwise secured upon and/or radially outwardly of the heat sink to from a five sided pentagon array of LED emitter PCB panels. Each of the five sided LED emitter PCB panels can be rectangular and contain one or more rows of aligned, aliquot, uniformly spaced LED emitters 160. Terminal(s) 162 can be connected to an end cap PCB connector 164 comprising a connector end board which is also referred to as an end cap board which can be fastened by screws 166 to the end cap. FIG. 7 is an enlarged cross-sectional view of the five sided pentagon non-curvilinear LED luminary. An internal non-switching PCB driver 168 comprising a driver board can be positioned in the interior of the array to drive the emitter boards. The heat sink can dissipate heat generated by the LED emitters and driver.

Figure 8:
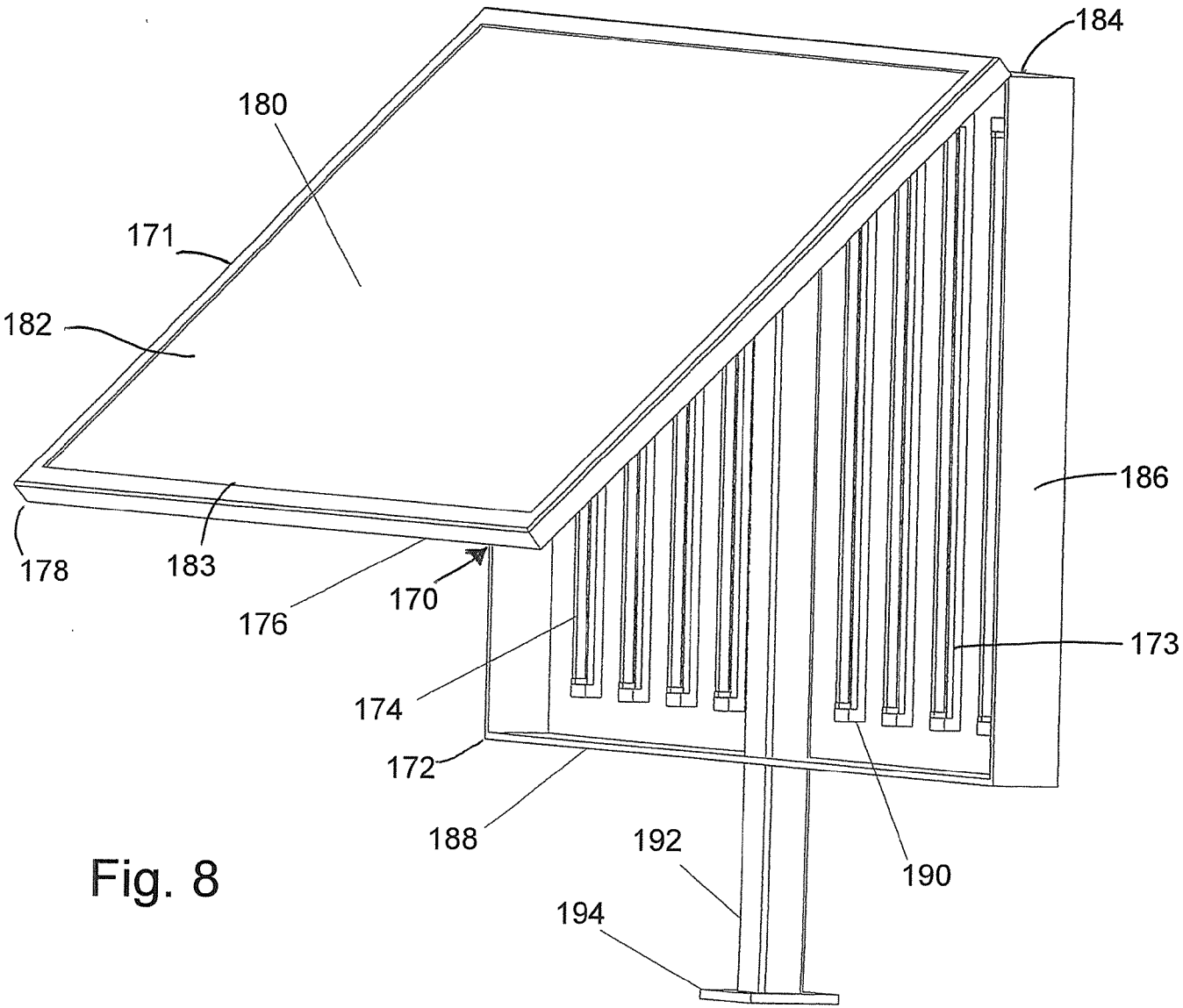
FIG. 8 is a perspective view of an outdoor menu board providing an outdoor sign with two sided delta non-curvilinear LED luminaries such as for drive through menu board applications and illustrating the menu board door partially open in accordance with principles of the present invention.
Figure 9:
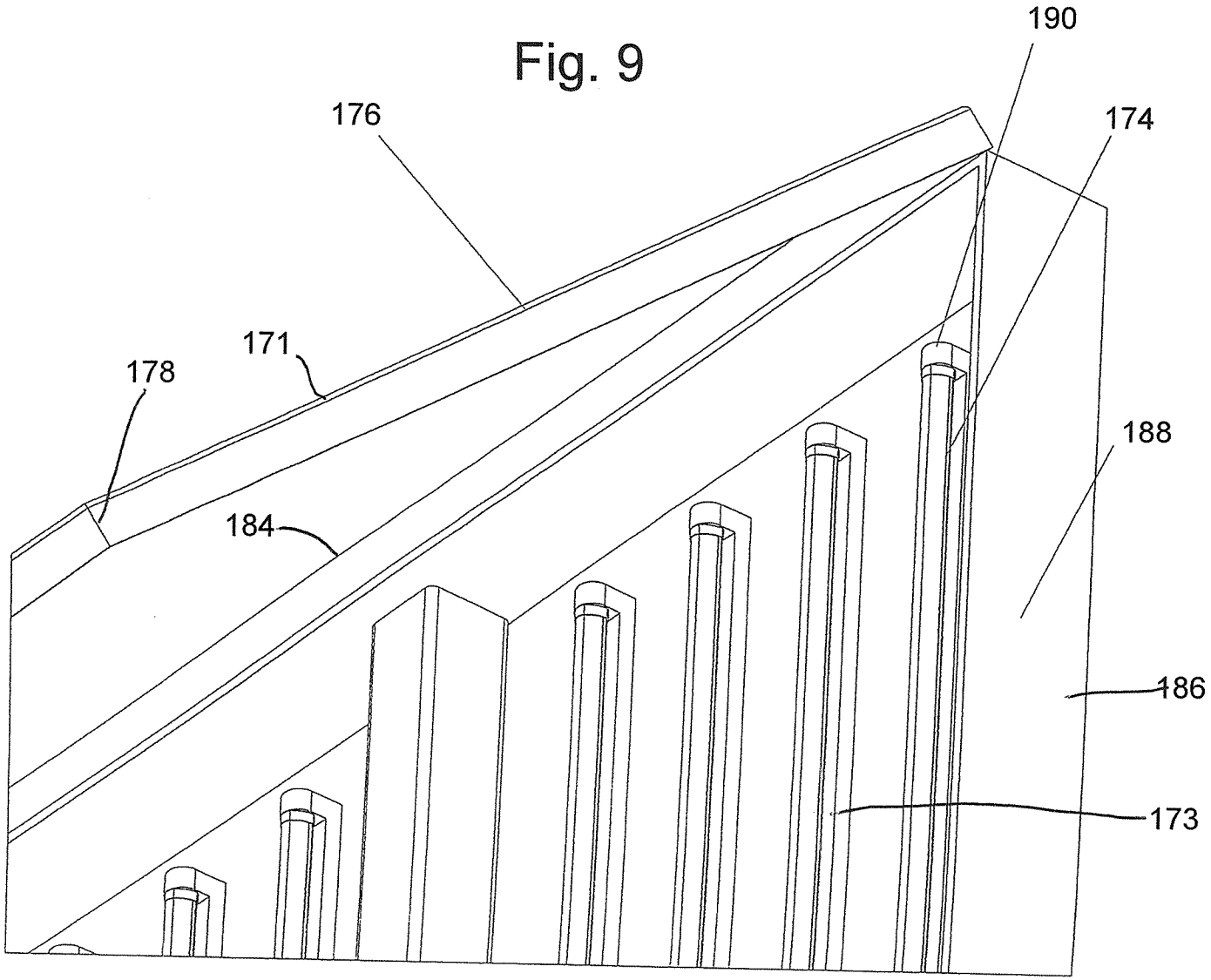
FIG. 9 is an enlarged view of portions of the outdoor menu board of FIG. 8.

FIG. 8 is a perspective view of an LED illuminating assembly 170 comprising an elongated outdoor menu board 171 which can provide an outdoor sign 172 with two sided modular LED lighting bars 173 (LED light bars) comprising two sided or delta non-curvilinear LED luminaries 174 such as to drive through menu board applications. FIG. 8 also illustrates the front menu board door 176 partially open. The front menu board can comprise a rectangular frame 178 to peripherally surround and secure light transmissive panel(s) 180 which can provide a door plea comprising an illuminated menu window 182. The menu window can provide illuminated signage which can comprise an elongated light diffuser 183 that can provide a light transmissive lens for diffusing and/or focusing light emitted from the LED outwardly. The front menu board door can be pivotally hinged or removably attached to the top 184 or one of the sides 186 of the outdoor menu board housing 188. The back of the housing can also have a light transmissive panel(s), if it is desired to illuminate both the front and back of the outdoor menu board. The two sided delta non-curvilinear LED luminaries can be connected, such as by power connector pins, to light socket assemblies 190. The two sided delta non-curvilinear LED luminaries can be positioned vertically, longitudinally, laterally, transversely, or horizontally in the interior of the outdoor menu board housing. A menu board vertical upright support post 192, which can have a rectangular, square, or rounded cross section, can be mounted on a base plate and connected to the top of the menu board housing along the vertical centerline of the housing, to support and elevate the outdoor menu board housing, door and illuminated menu window. FIG. 9 is an enlarged view of portions of the outdoor illuminated menu board.

Figure 10:
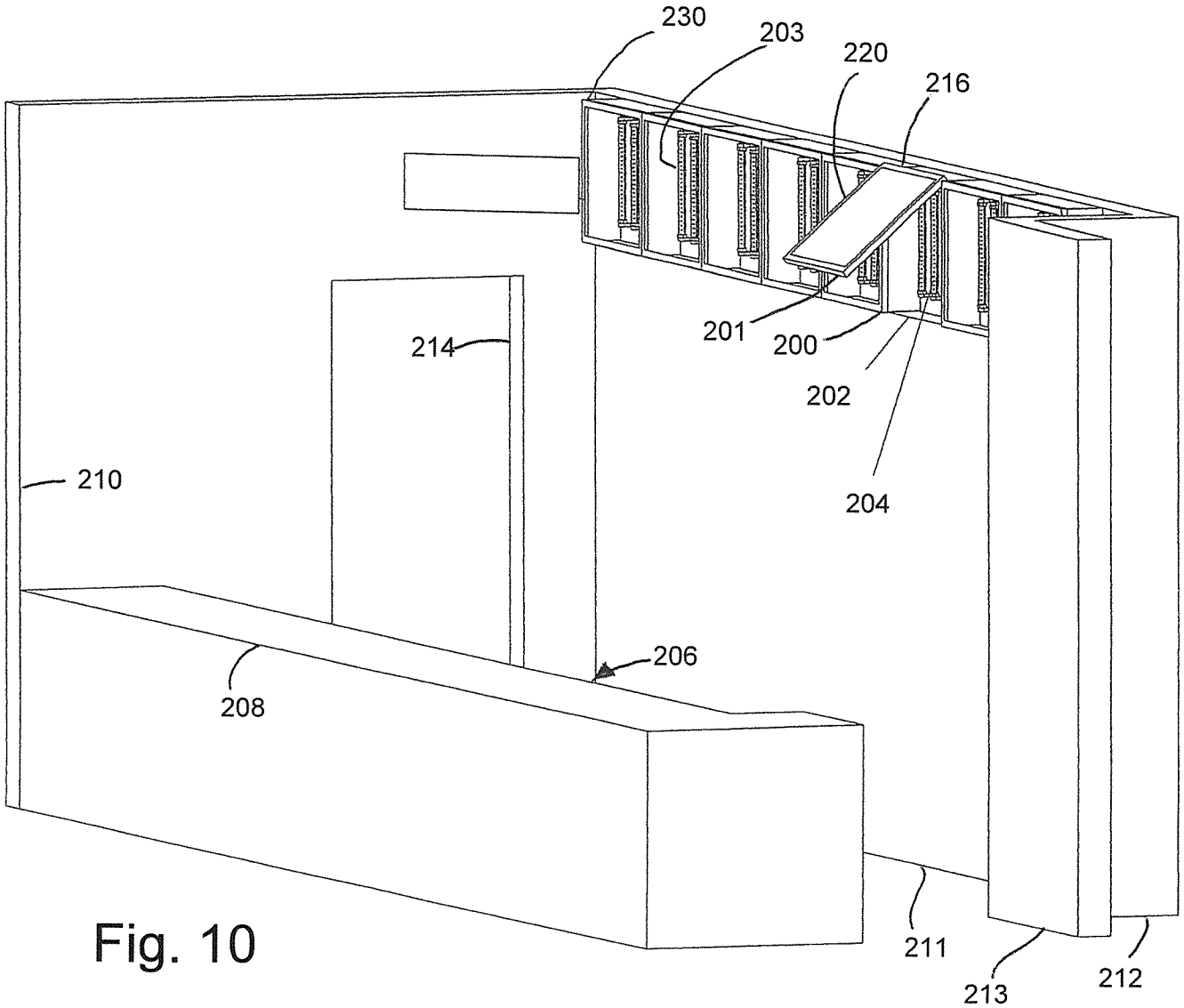
FIG. 10 is a perspective view of an indoor menu board providing an indoor sign with three sided delta non-curvilinear LED luminaries such as for a restaurant, and illustrating one of the panel doors in a partially open position in accordance with principles of the present invention.
Figure 11:
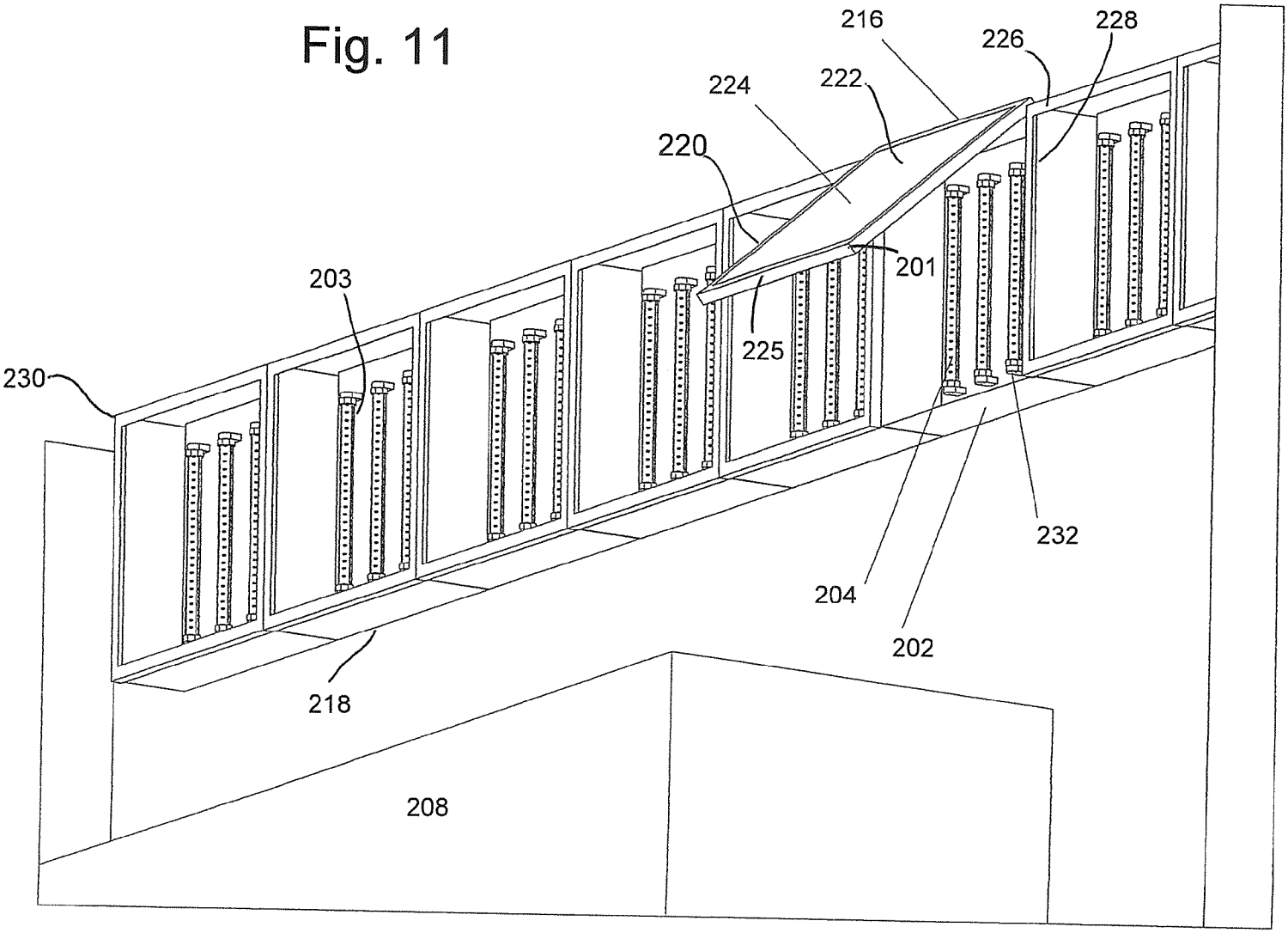
FIG. 11 is an enlarged view of portions of the indoor menu board of FIG. 10.

FIG. 10 is a perspective view of LED illuminating assembly 200 comprising an elongated indoor menu board 201 providing a wall mounted indoor sign 202 with two or three sided modular LED lighting bars 203 (LED light bars) comprising two or three sided delta non-curvilinear LED luminaries 204 for use such as in, but not limited to a restaurant 206 with a counter 208, walls 210-213, exit and/or entrance door 214 and a counter 214 and illustrating one of the menu panel doors 216 in a partially open position. FIG. 11 is an enlarged view of portions of the indoor menu board. The back 218 of the menu board can be securely mounted on a wall. The front of the menu board can comprise one or more menu panel doors such as a set or array of horizontally aligned menu panel doors. Each menu panel door can comprise a rectangular frame 220 to peripherally surround and secure a light transmissive panel 222 which can provide a door apex comprising an illuminated menu window 224. The menu window can provide illuminated signage which can comprise an elongated light diffuser 225 that can provide a light transmissive lens for diffusing and/or focusing light emitted from the LED outward into the room or interior of the restaurant. Each menu board panel door can be pivotally hinged or removably attached to the top 226 or one of the sides 228 of the menu board housing 230. The two or three sided delta non-curvilinear LED luminaries can be connected, such as by power connector pins, to light socket assemblies 232. The two sided delta non-curvilinear LED luminaries can be positioned vertically, longitudinally, laterally, transversely or horizontally in the interior of the outdoor menu board housing.

Figure 12:
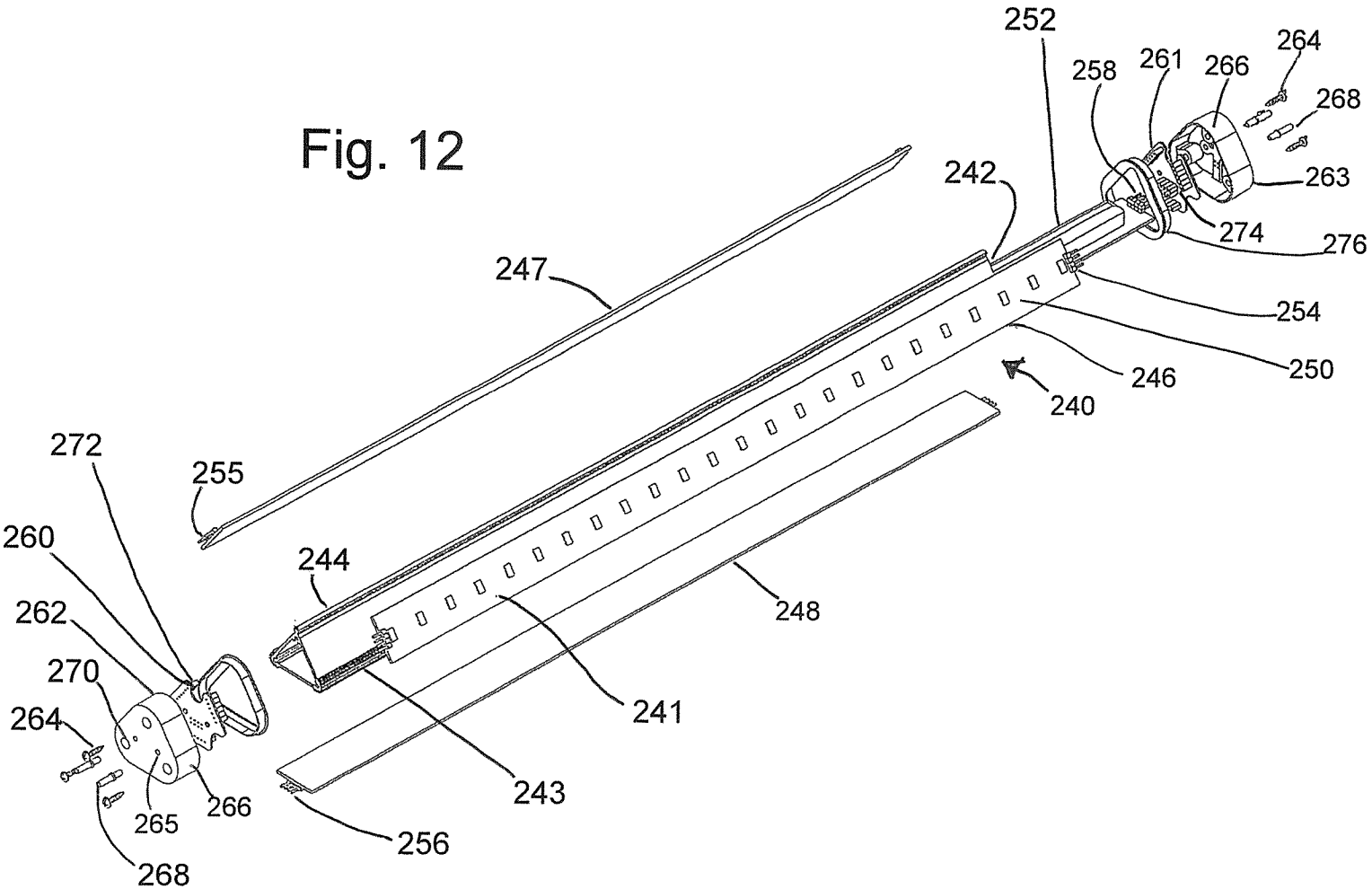
FIG. 12 is an exploded assembly view of a three sided delta non-curvilinear LED luminary in accordance with principles of the present invention.
Figure 13:
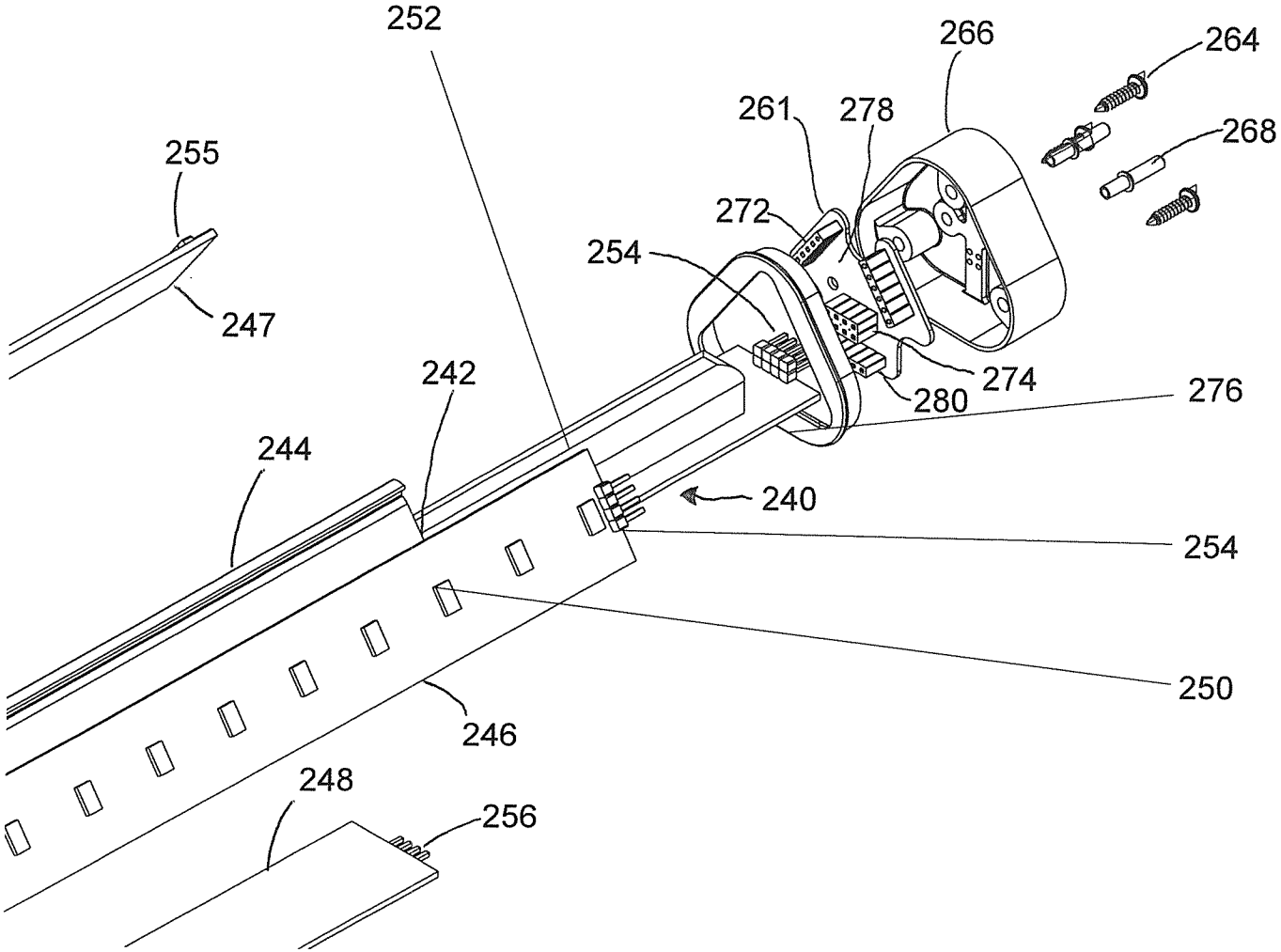
FIG. 13 is an enlarged view of the right portions of the three sided delta non-curvilinear LED luminary of FIG. 12.
Figure 14:
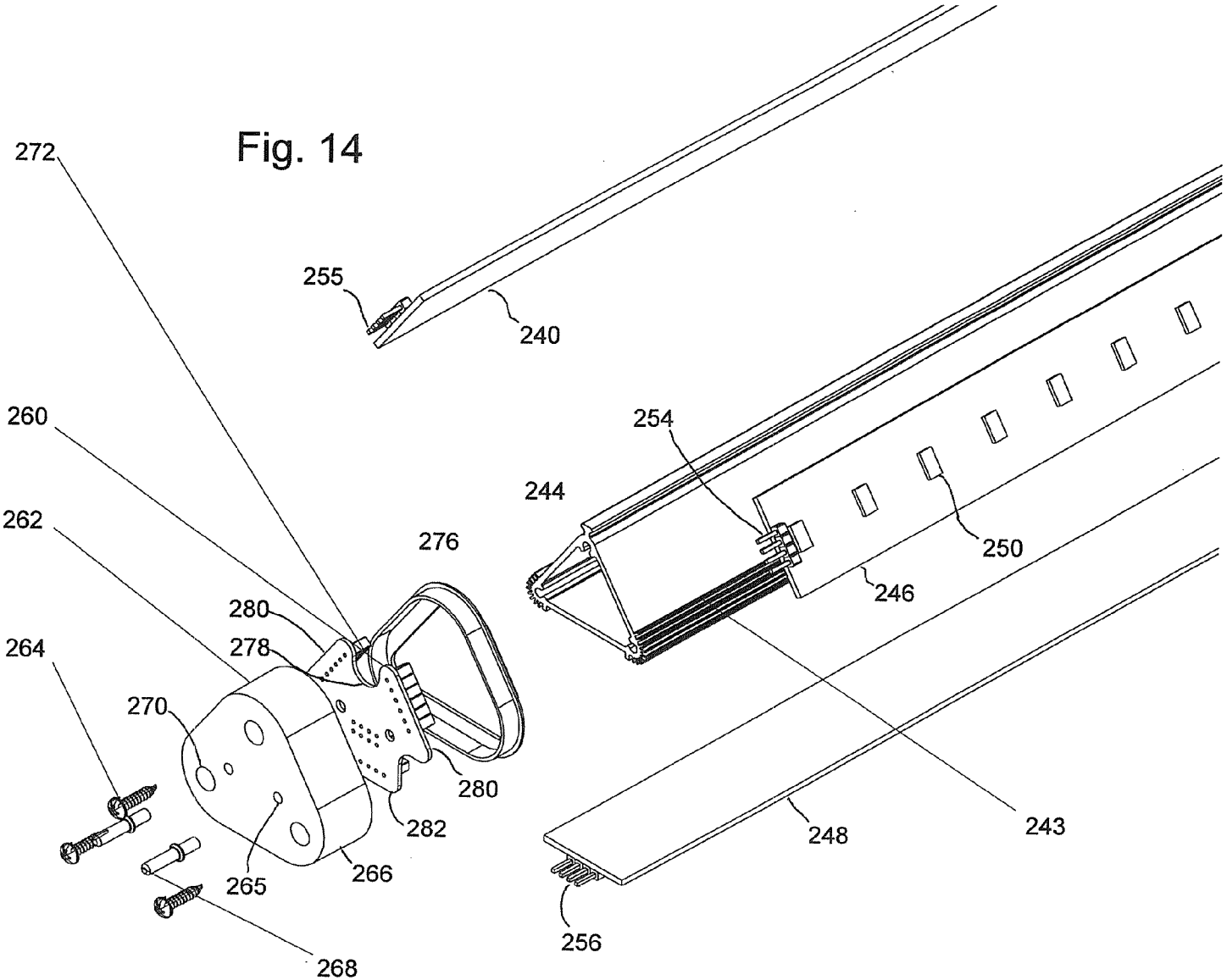
FIG. 14 is an enlarged view of the left portions of the three sided delta non-curvilinear LED luminary of FIG. 12.

FIG. 12 is an exploded assembly view of a LED illuminating assembly 240 comprising a three sided modular LED lighting bar 241 (LED light bar) providing a three sided delta or triangular shaped non-curvilinear LED luminary 242. FIG. 13 is an enlarged view of the right portions of the three sided delta non-curvilinear LED luminary of FIG. 12. FIG. 14 is an enlarged view of the left portions of the three sided delta non-curvilinear LED luminary of FIG. 12. The three sided delta non-curvilinear LED luminary can have a three sided delta triangular shaped metal heat sink 243, such as formed from extruded aluminum. The intersecting corners 244 providing apexes of the heat sink can be raised, rounded or chamfered, if desired. Elongated LED emitter PCB panels 246-248 can be mounted or otherwise secured upon and/or positioned radially outwardly of the heat sink in a generally triangular or delta shape. Each of the LED emitter PCB panels can be rectangular and can contain one or more rows of aligned, aliquot, uniformly spaced modular LED emitters 250. An internal non-switching elongated printed circuit board (PCB) driver 252, also referred to as a driver board, can be positioned along the length of and within the interior area bounded by the heat sink. The heat sink can dissipate heat generated by the LED emitters and PCB driver. Emitter board terminals 354-256 can extend longitudinally outwardly from the LED emitter boards. Driver board terminals 258 can be extend longitudinally outwardly from the PCB driver. The three sided delta triangular shaped non-curvilinear LED luminary can have three sided delta end cap PCB connectors 260-261 comprising connector end boards which are also referred to as end cap boards that can be secured to three sided delta or triangular shaped end caps 262-263, respectively, by fasteners 264, such as screws, through screw holes 265 in the end caps. The end caps can have rounded corners 266 or apexes. Power connector pins 268 can extend laterally outwardly from the connector end boards through connector pin-receiving holes 270 in the end caps for secure engagement with a light socket. The connector end boards can have end cap board terminals 272 which extend longitudinally inwardly along its three sides which can connect to the emitter board terminals. The connector end boards can also have a driver board connecting terminals 274 which extends longitudinally inwardly from central portions of the connector end boards and can be connected to the driver board terminals. A three sided delta or triangular shaped covers 276 can provide rims for positioning about the end caps. As best shown in FIG. 14, the connector end boards can each have a central U-shaped concave notched portion 278 between two of the sides 280 and 282 and can have a lower third side 284 which extends below the lower portions of the other two sides. The sides 280-284 can be straight, flat and planar.

Figure 15:
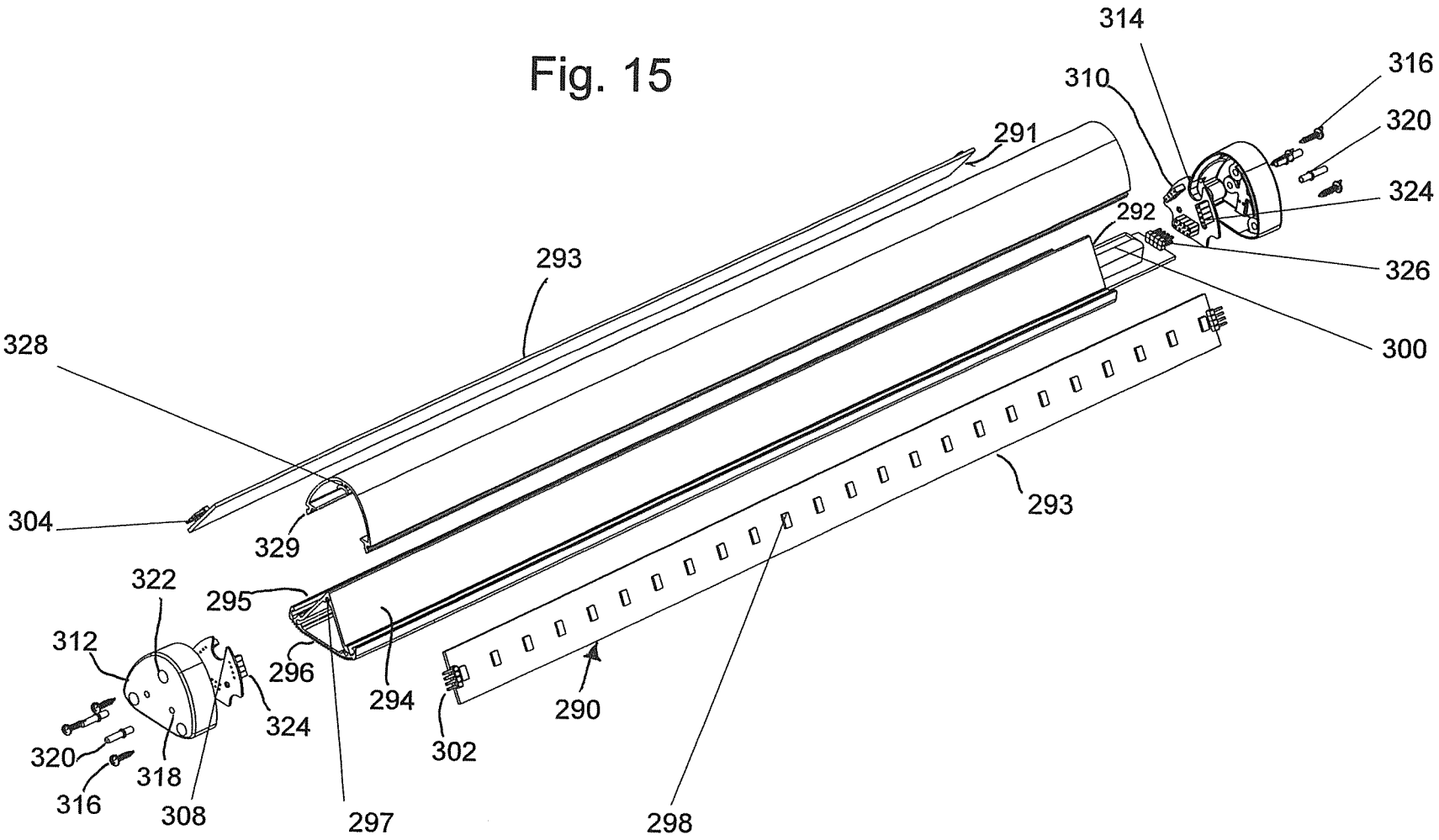
FIG. 15 is an exploded assembly view of a two sided non-curvilinear LED luminary in accordance with principles of the present invention.
Figure 16:
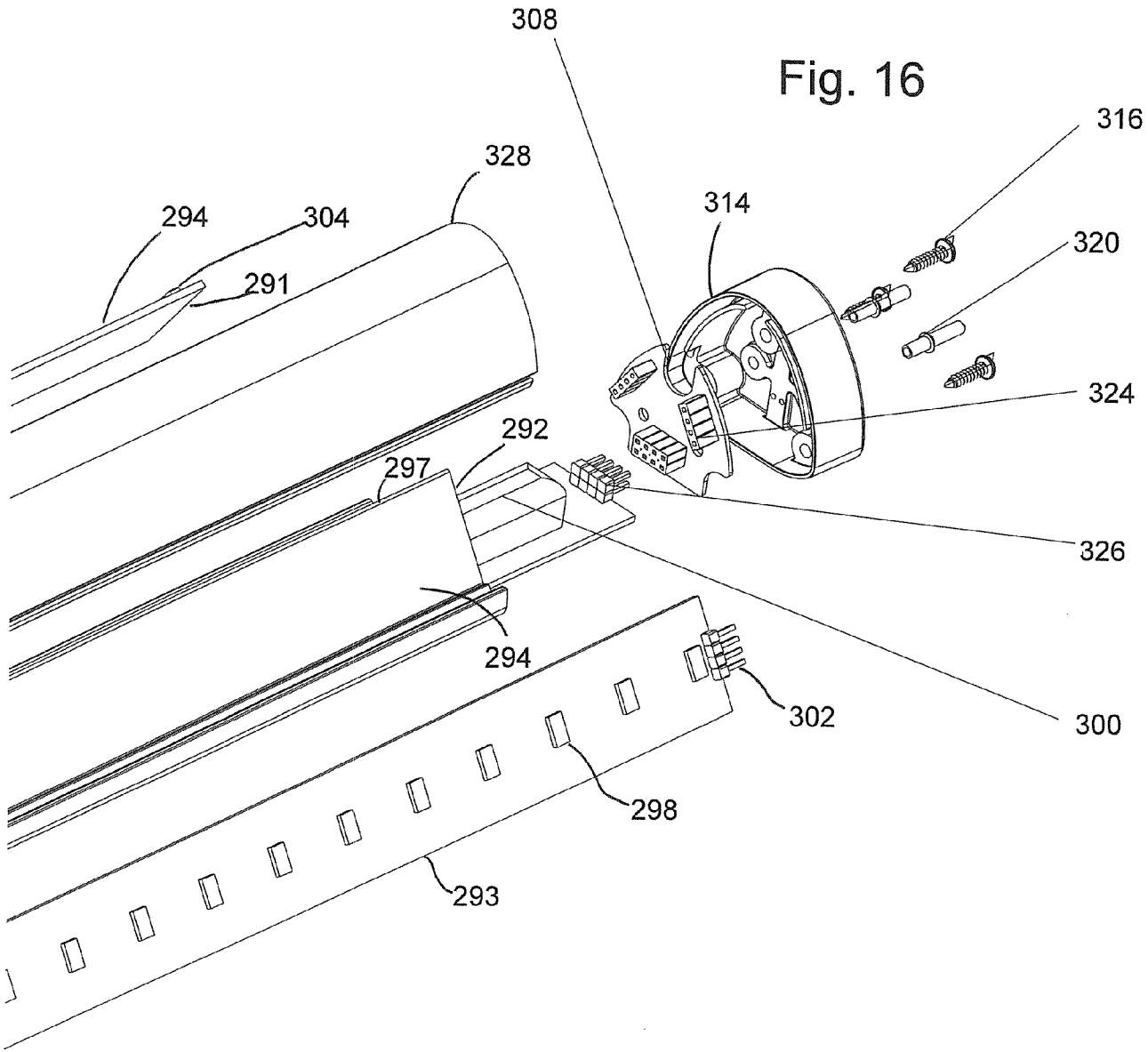
FIG. 16 is an enlarged view of the right portions of the two sided non-curvilinear LED luminary of FIG. 15.

FIG. 15 is an exploded assembly view of a LED illuminating assembly 290 comprising a two sided modular LED lighting bar 291 (LED light bar) providing a two sided elongated non-curvilinear LED luminary 292 which is similar to the three sided delta or triangular shaped non-curvilinear LED luminary of FIGS. 12-14 except there are only two elongated LED emitter PCB panels 293 comprising modular LED emitter boards which can be mounted or otherwise secured upon and/or positioned radially outwardly of the two sides 294 and 295 of the three sides 294-296 of the three sided delta or triangular shaped metal heat sink 297. The two LED emitter panels can be positioned in a generally V shape. FIG. 16 is an enlarged view of the right portions of the two sided non-curvilinear LED luminary of FIG. 15. Each of the LED emitter PCB panels can be rectangular and can contain one or more rows of aligned, aliquot, uniformly spaced LED emitters 298. An internal non-switching elongated printed circuit board (PCB) driver 300 can be positioned along the length of and within the interior area bounded by the heat sink. The heat sink can dissipate heat generated by the LED emitters and PCB driver. Emitter board terminals 302 and 304, which are also referred to as emitter board connectors, can extend longitudinally outwardly from the LED emitter boards. Driver board terminals 306 can extend longitudinally outwardly from the PCB driver. The two sided delta triangular shaped non-curvilinear LED luminary can have three sided delta or triangular connector end boards 308 and 310 comprising connector end boards which can be secured to three sided delta or triangular shaped end caps 312 and 314, respectively, by fasteners 316, such as screws, through screw holes 318 in the end caps. Power connector pins 320 can extend laterally outwardly from the connector end boards through connector pin-receiving holes 322 in the end caps for secure engagement with a light socket. The connector end boards can have end cap board terminals 324, which are also referred to as surface mount connectors, that can extend longitudinally inwardly along two of its three sides and can be aligned with and connect to the emitter board terminals. The connector end boards can also have a driver board connecting terminals 326 which extends longitudinally inwardly from central portions of the PCB end cap connector boards and can be connected to the driver board terminals. An elongated light diffuser cover 328 comprising a concave translucent or transparent light transmissive lens can cover the LED emitter boards for reflecting, diffusing and/or focusing light emitted from the LED emitters. The lens can be formed of plastic or glass and can be rounded, semicircular and positioned radially outwardly of the LED emitters. The lens can have inward facing feet 329 which can snap fit about the heat sink.

Figure 17:
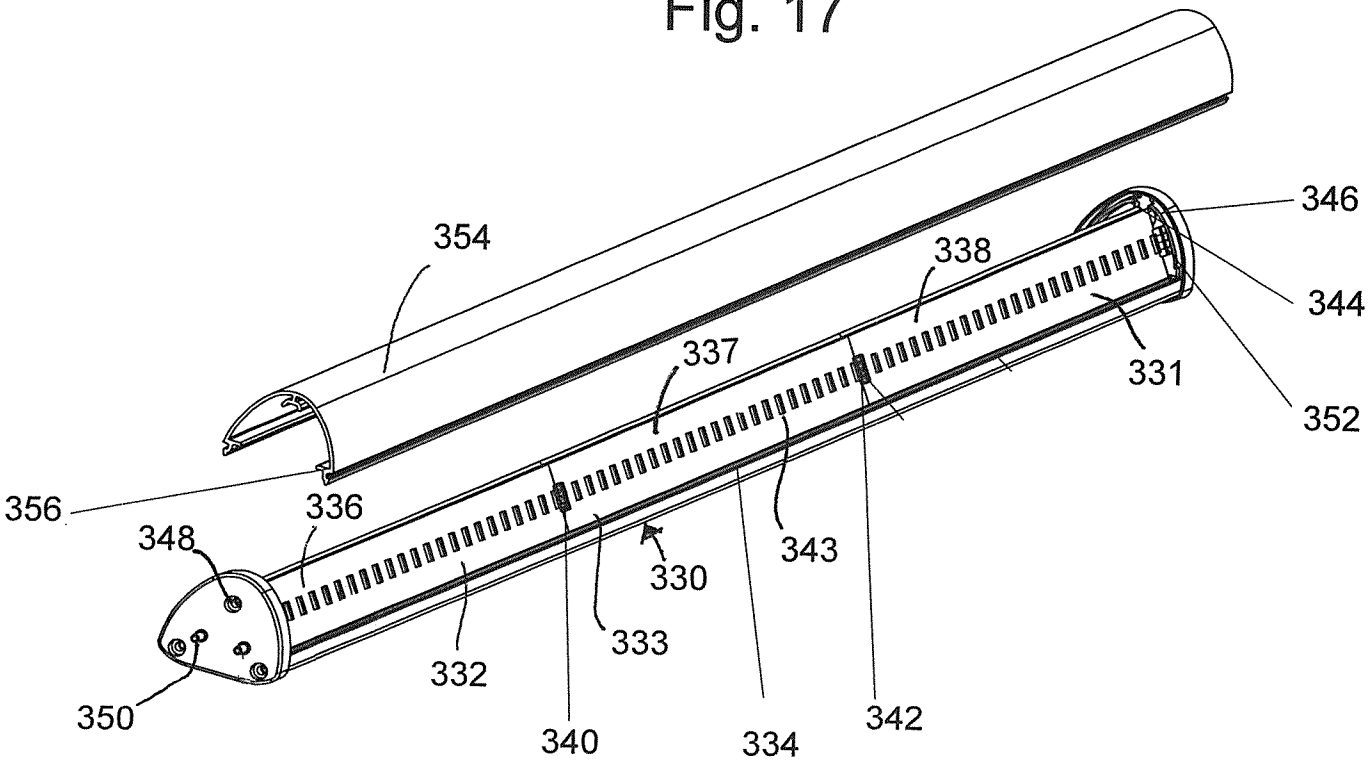
FIG. 17 is an exploded assembly view of another two sided non-curvilinear LED luminary in accordance with principles of the present invention.
Figure 18:
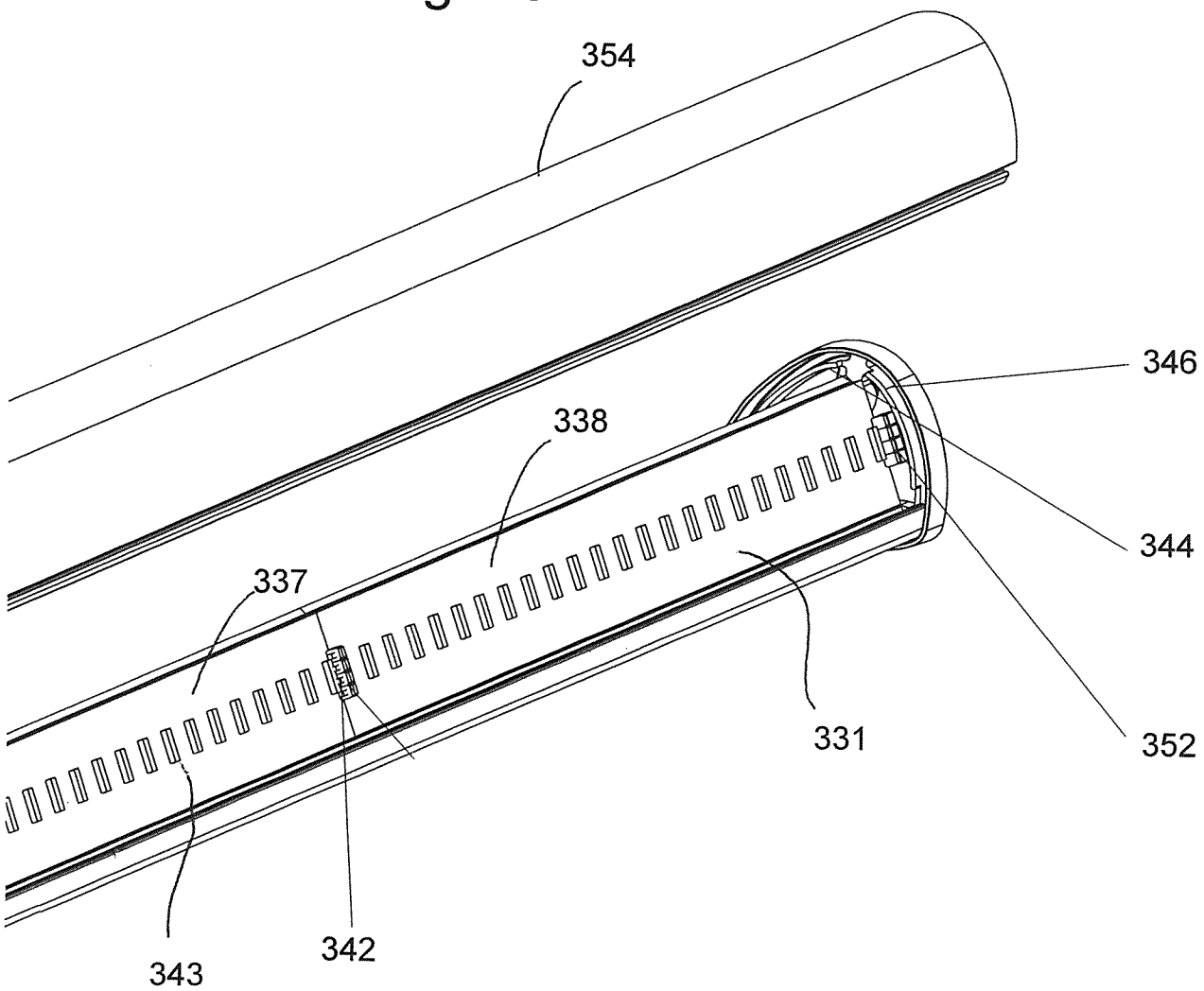
FIG. 18 is an enlarged view of the right portions of the two sided non-curvilinear LED luminary of FIG. 17.

FIG. 17 is an exploded assembly view of a LED illuminating assembly 330 comprising a two sided modular light bar 331 providing another two sided non-curvilinear LED luminary 332 which is similar to the two sided non-curvilinear LED luminary of FIGS. 15-16 except that there are two sets or arrays 333 of elongated LED emitter PCB panels comprising modular LED emitters which can be mounted or otherwise secured upon and/or positioned radially outwardly of the two sides of the three sided delta or triangular shaped metal heat sink 334. FIG. 18 is an enlarged view of the right portions of the two sided non-curvilinear LED luminary of FIG. 17. Each of the sets or arrays of modular LED emitter PCB panels have more than one LED emitter PCB panel, such as but not limited to, three elongated LED emitter PCB panels 336-338 providing modules which extend and are aligned and connected, lengthwise and longitudinally end to end via emitter PCB panel terminal connectors 340 and 342. Each of the LED emitter PCB panels can be rectangular and can contain one or more rows of aligned, aliquot, uniformly spaced LED emitters 343. The LED luminary can have three sided delta or triangular end cap connectors 344 which comprise connector end boards that can be secured to three sided delta or triangular shaped end caps 346 by screws or other fasteners through screw holes 348 in the end caps. Power connector pins 350 can extend laterally outwardly from the connector end boards through connector pin-receiving holes in the end caps for secure engagement with end plugging into a light socket. The connector end boards can have end cap board terminals 352 which can extend longitudinally inwardly along two of its three sides and can connect to the emitter board terminals. An elongated translucent or transparent light transmissive plastic lens 354 comprising a diffuser cover of diffuser can cover the LED emitter boards. The lens can be rounded, semicircular and positioned radially outwardly of the LED emitters. The lens can have inward facing feet 356 which can snap fit about the heat sink.

Figure 19:
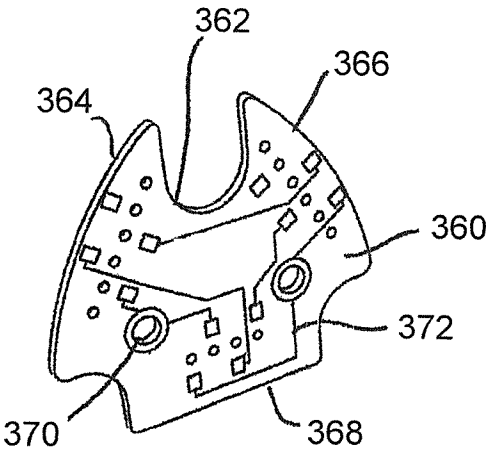
FIG. 19 is a perspective view of an end cap connector board for a two sided delta non-curvilinear LED in accordance with principles of the present invention.
Figure 20:
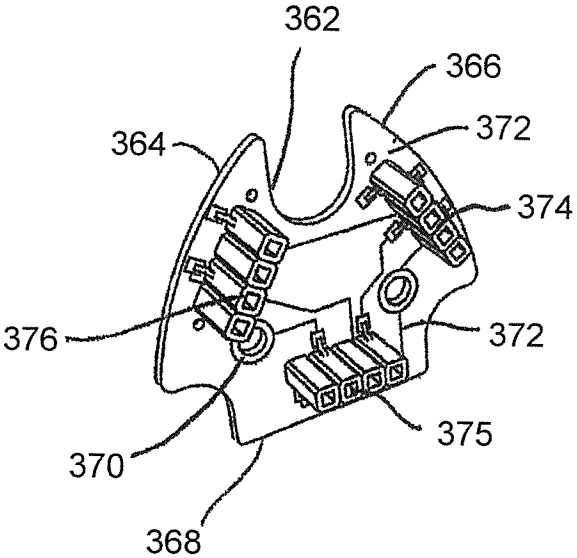
FIG. 20 is a perspective view of surface mount connectors connected to the end cap connector board of FIG. 19.
Figure 21:
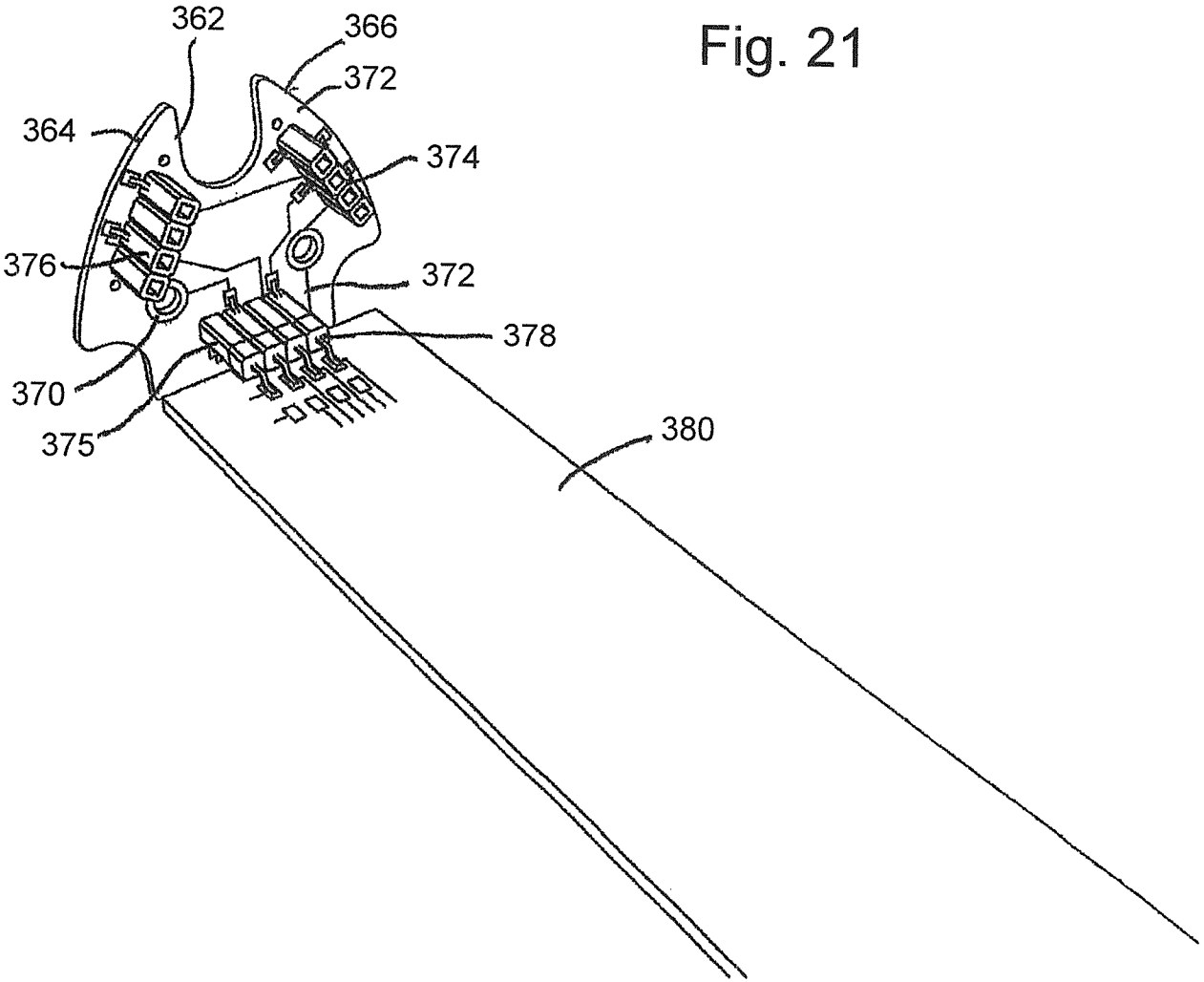
FIG. 21 is a perspective view of a portion of a driver board connected to the surface mount connectors connected of FIG. 20.
Figure 22:
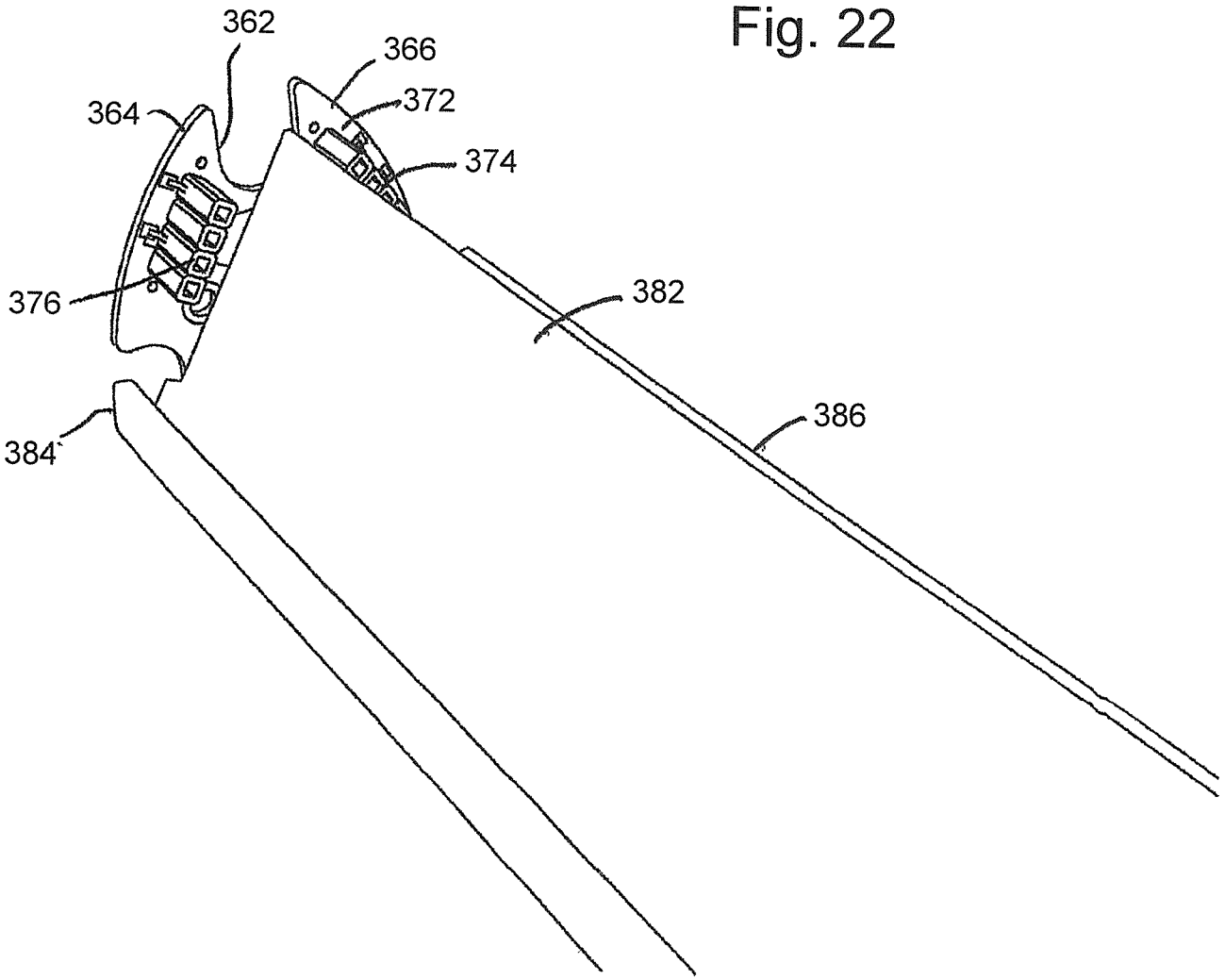
FIG. 22 is a perspective view of a portion of a three sided delta heat sink tube positioned peripherally about the driver board and against the end cap connector board of FIG. 21.
Figure 23:
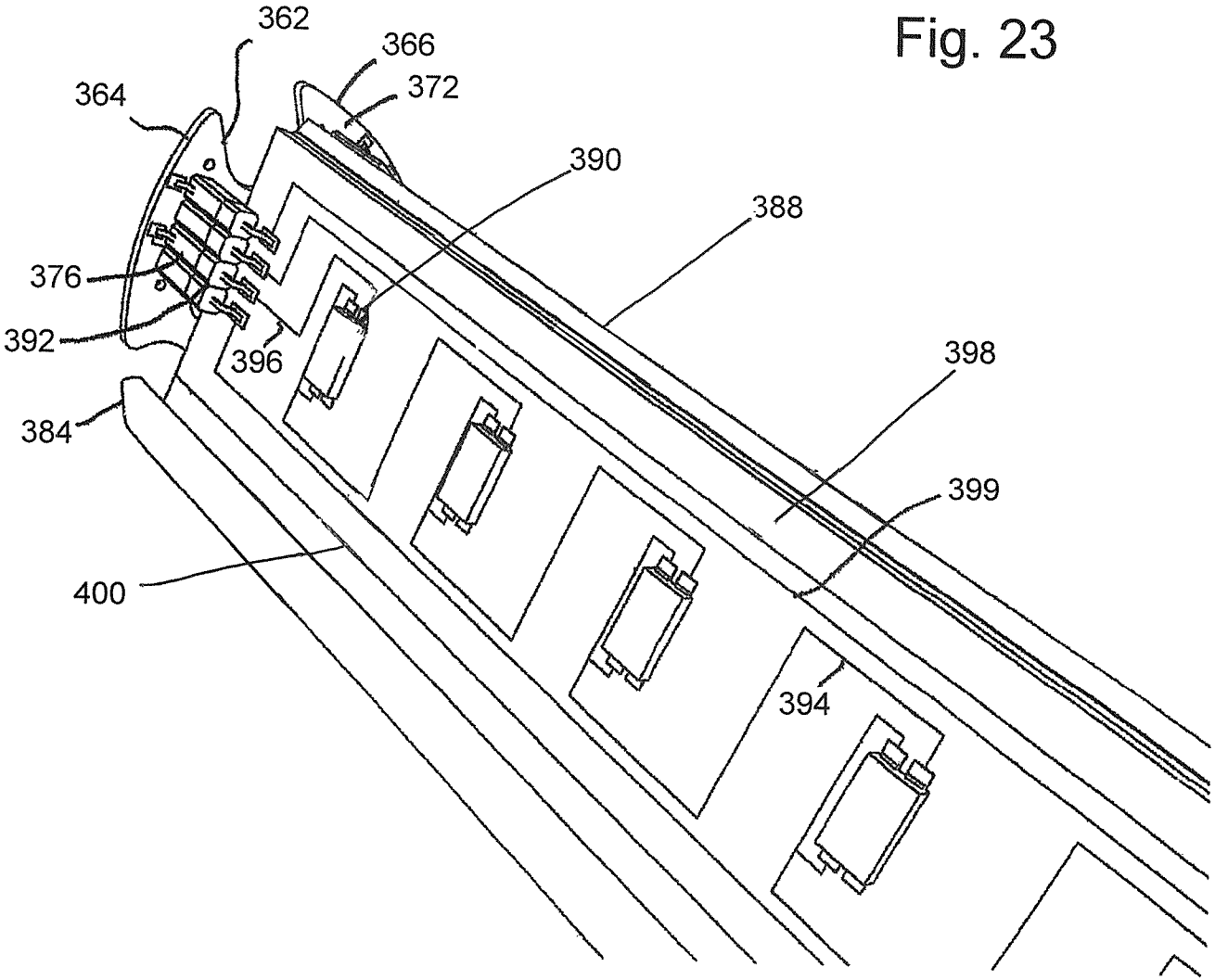
FIG. 23 is a perspective view of emitters on an emitter board with AC and DC power traces connected to the surface mount connectors and positioned about the heat sink tube of FIG. 22.
Figure 24:
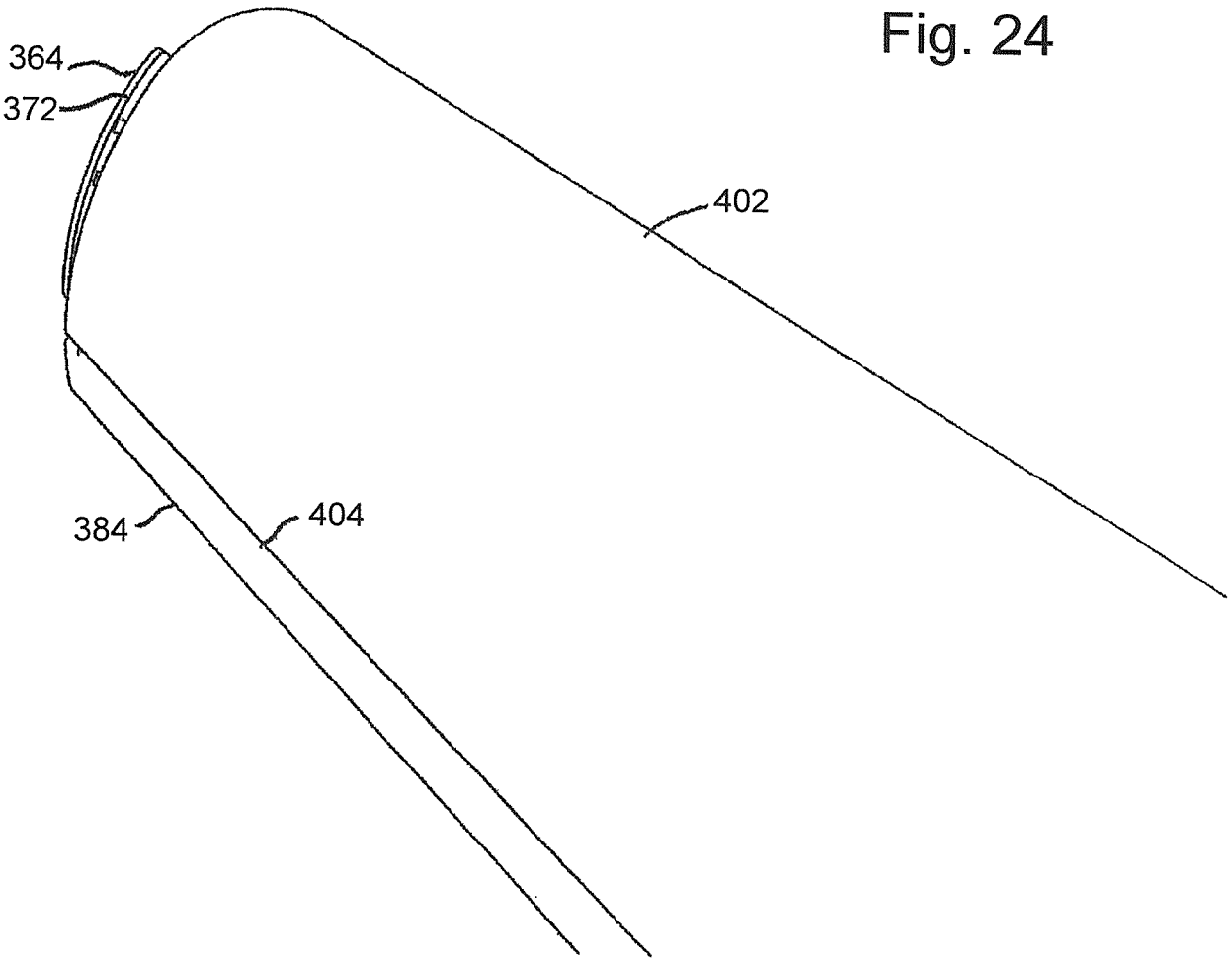
FIG. 24 is a perspective view of a portion of a lens about the emitters of FIG. 23.
Figure 25:
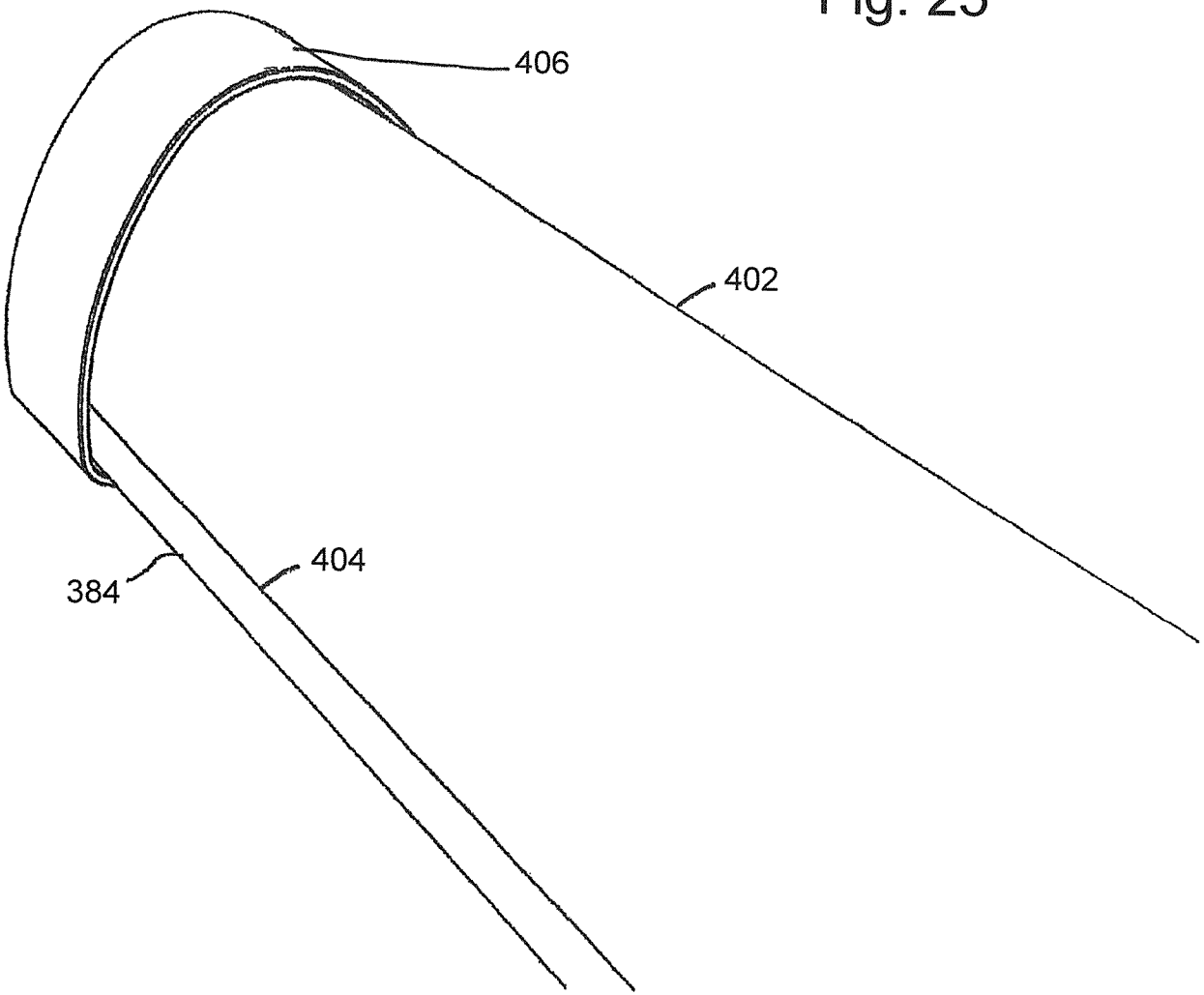
FIG. 25 is a perspective view of a portion of an end cap at the left end of the lens of FIG. 24.
Figure 26:
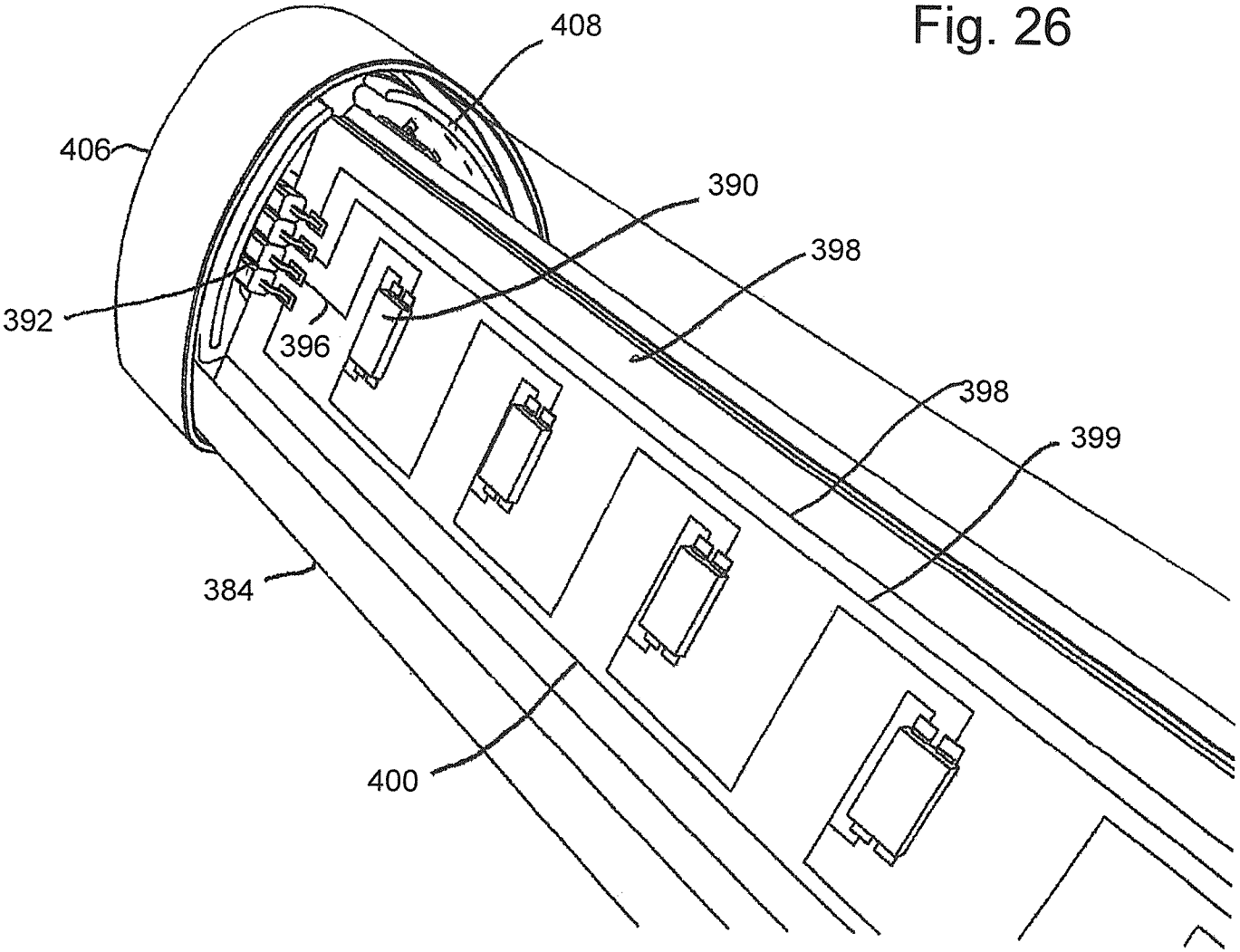
FIG. 26 is a perspective view of the two sided delta non-curvilinear LED luminary with the end cap and showing portions of the lens removed to illustrate the emitters on the emitter board and the AC and DC power traces connected to the surface mount connectors.

FIG. 19 is a perspective view of an end cap PCB connector 360, also referred to as a connector end board or end cap board, for a LED illuminating assembly comprising a two sided LED bar providing a two sided delta or triangular non-curvilinear LED luminary, such as shown in FIGS. 15-16. The end cap PCB connector can have a central U-shaped concave notched portion 362 between two of the sides comprising convex curved arcuate sides 364 and 366 and can have a lower third side, comprising a straight flat planar side 368 which can extend below the lower portions of the two convex sides. The PCB connector can have connector pin-holes 370, also referred to as AC power pin connectors or AC hot pin connector, as well as electrical traces 372 for connecting the electrical components on the end cap PCB connector. As shown in FIG. 20, surface mount connectors 374-376, which are also referred to as emitter board connectors or end cap board terminals, can be connected alongside portion of the connector end board in proximity to the sides of the connector end board. The surface mount connectors of the end cap PCB connector can be connected to drive board connectors 378 (FIG. 21), also referred to as PCB driver connectors, of an internal non-switching elongated driver board 380 comprising a driver. A three sided delta or triangular shaped metal heat sink tube 382 (FIG. 22), also referred to as a tubular heat sink, can be positioned peripherally about the driver board and against the cap connector end board. The heat sink can have upwardly facing emitter board-supporting channels 384 and 386 along its bottom edges to support elongated LED emitter PCB panels 388 (FIG. 23), which are also referred to as modular LED emitter boards. The LED emitter PCB panels can be mounted or otherwise secured upon and/or be positioned radially outwardly of the heat sink to form a V-shaped array. Each of the LED emitter PCB panels can contain one or more rows of aligned, aliquot, uniformly spaced LED emitters 390. The heat sink can dissipate heat generated by the LED emitters and driver board. Emitter board connectors 392, which are also referred to as emitter board terminals, can extend from the ends of the emitter boards and connect to the surface mount connectors comprising end cap board terminals of the end cap PCB connector. Emitter traces 394 can connect the LED emitters in series while end traces 396 can connect the emitters to the emitter board connectors. An alternating current (AC) power trace 398 can be positioned in parallel to an extra trace 399 and a direct current (DC) trace 400 on the emitter board. An elongated translucent or transparent light transmissive lens 402 (FIG. 24) comprising a diffuser cover or diffuser can cover the LED emitter boards. The lens can be rounded, semicircular and/or positioned radially outwardly of the LED emitters. The elongated longitudinal lower ends 404 of the lens can comprise feet and can fit in and be supported by channels of the heat sink. End caps 406 (FIG. 25) can be positioned about the ends of the lens and end cap PCB connectors. FIG. 26 is a perspective view of the three sided delta or triangular non-curvilinear LED luminary with the end cap and showing portions of the lens removed to illustrate the emitters on the emitter board and the AC and DC power traces connected to the surface mount connectors. As shown in FIG. 26, the end caps can have arcuate curved concave brackets 408 comprising bracket segments which can extend longitudinally inwardly and can provide clamps positioned about portions of the periphery of the end caps to securely engage, grasp, snap fit, clamp and hold the top ends of the emitter boards.

Figure 27:
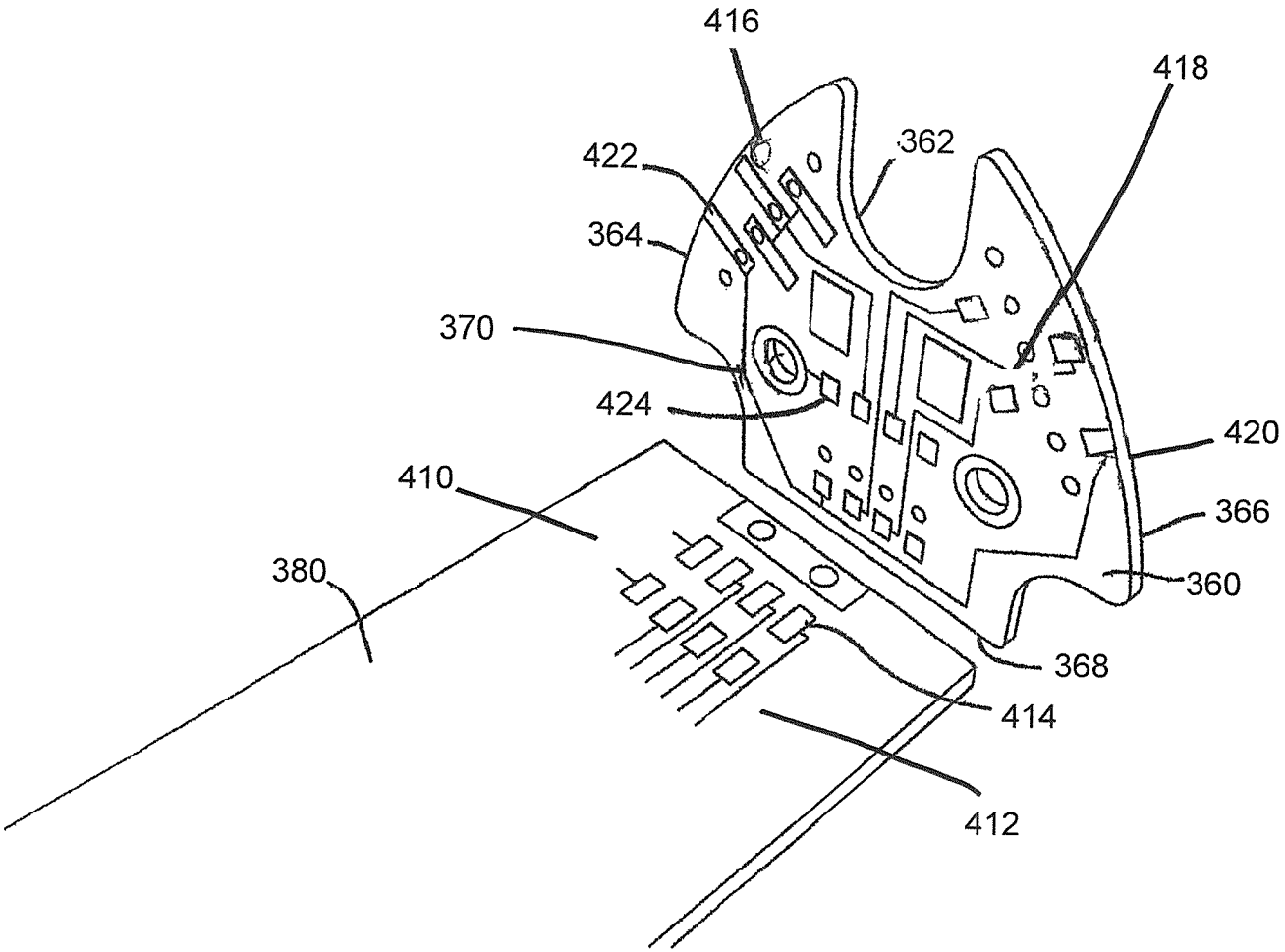
FIG. 27 is a perspective view of an end cap connector board or connector end board and driver board for a two sided delta non-curvilinear LED luminary in accordance with principles of the present invention.
Figure 28:
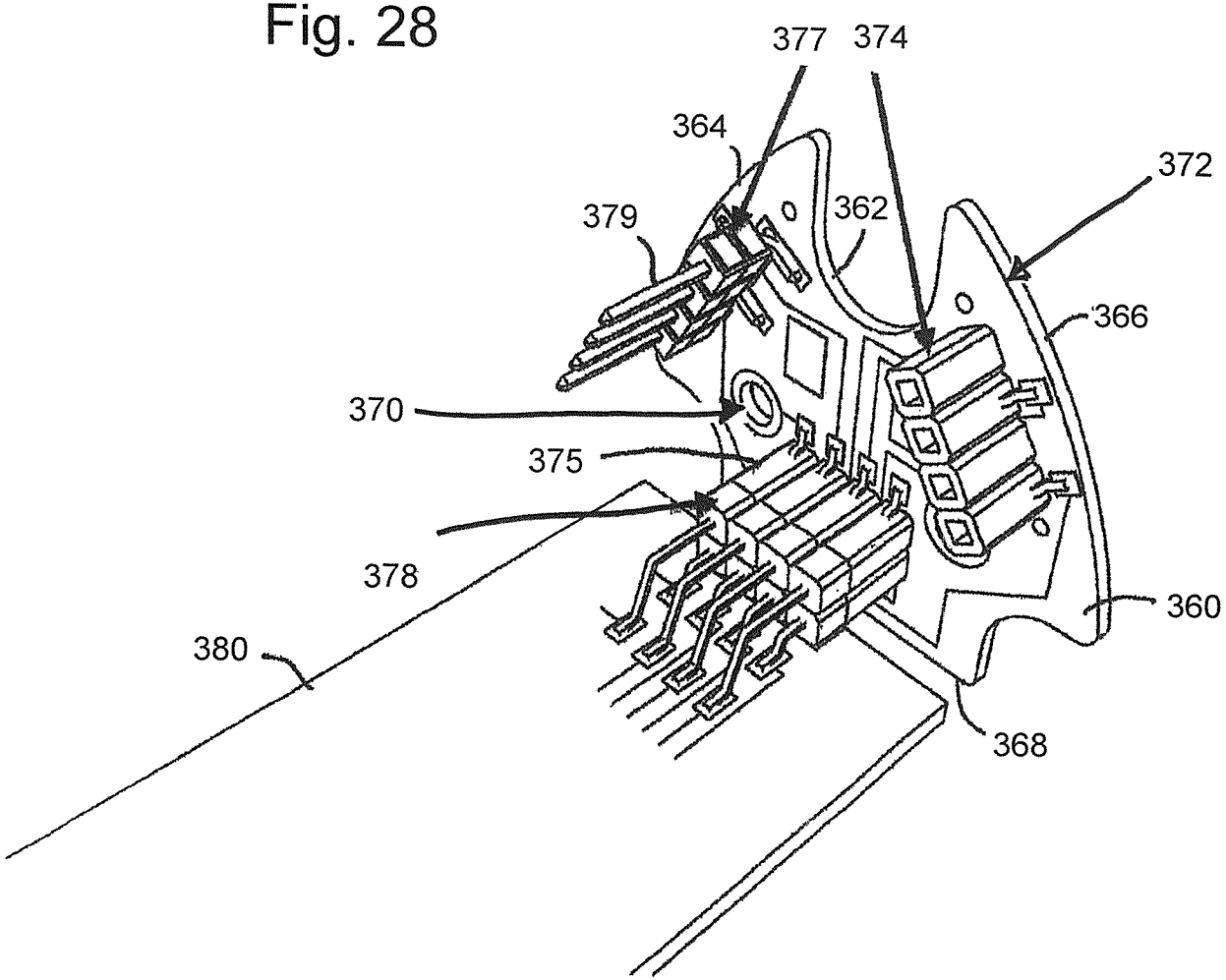
FIG. 28 is a perspective view of emitter board connectors connected to the end cap connector board and illustrating driver connectors connected to the driver board and the end cap connector board of FIG. 27.

AC traces 410 (FIG. 27) and DC traces 412 can be connected to driver circuitry 414 on the driver board 380. Driver connectors 378 (FIG. 28) can be connected to the driver circuitry as well as to the surface mount connectors 375, also referred to as emitter board connectors, of the end cap PCB connector (connector end board or end cap board) 372. In some arrangements, the end cap connector board can have male connectors 377 with longitudinally inwardly extending connector pins 379 to matingly engage and plug into female connectors on the emitter boards and/or drive board and the end cap connector board can have female connectors 374 to receive and plug into the longitudinally outwardly connector pins of matingly engageable (mating) male connectors on the emitter board and/or driver board. In the illustrated embodiment, there are a four pin connectors at end of each emitter board and driver board, although for some longer light bars, it may be desirable to use six pin connectors.

Figure 30:
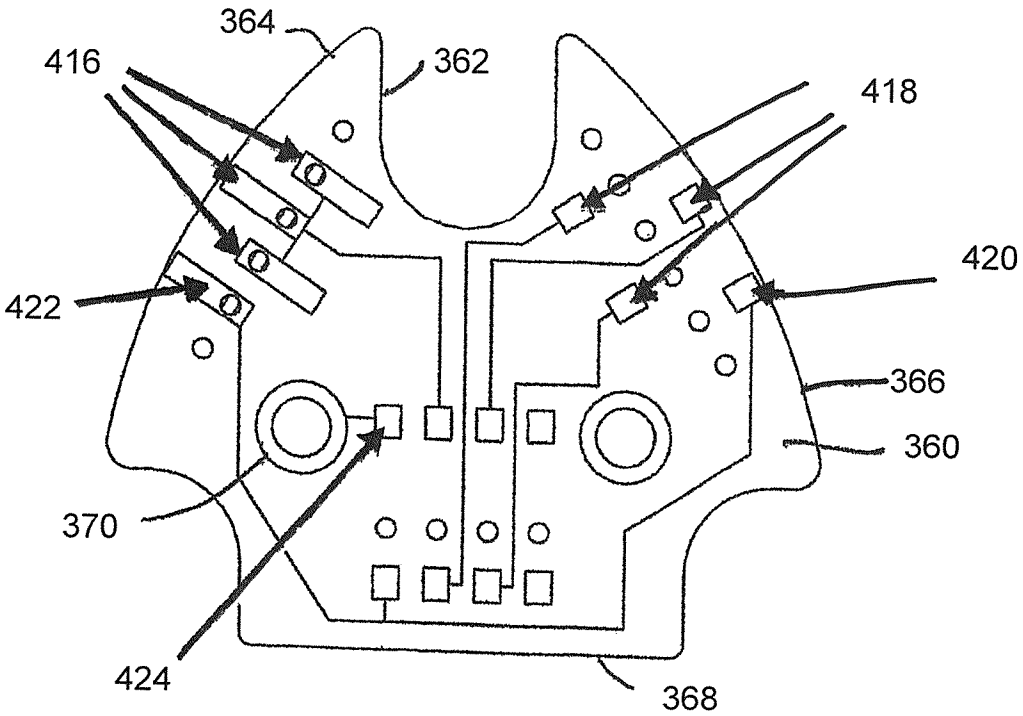
FIG. 30 is a front view of the end cap connector board of FIG. 27.

The end cap PCB connector can have DC power terminals 416 (FIG. 30) to conduct direct current (DC) to three LED strings as well as DC return terminals 418 to receive DC from the LEDs. An AC neutral trace 420 can extend from the opposite side. The end cap PCB connector can also have an AC neutral terminal 422 and an AC hot terminal 424.

Figure 29:
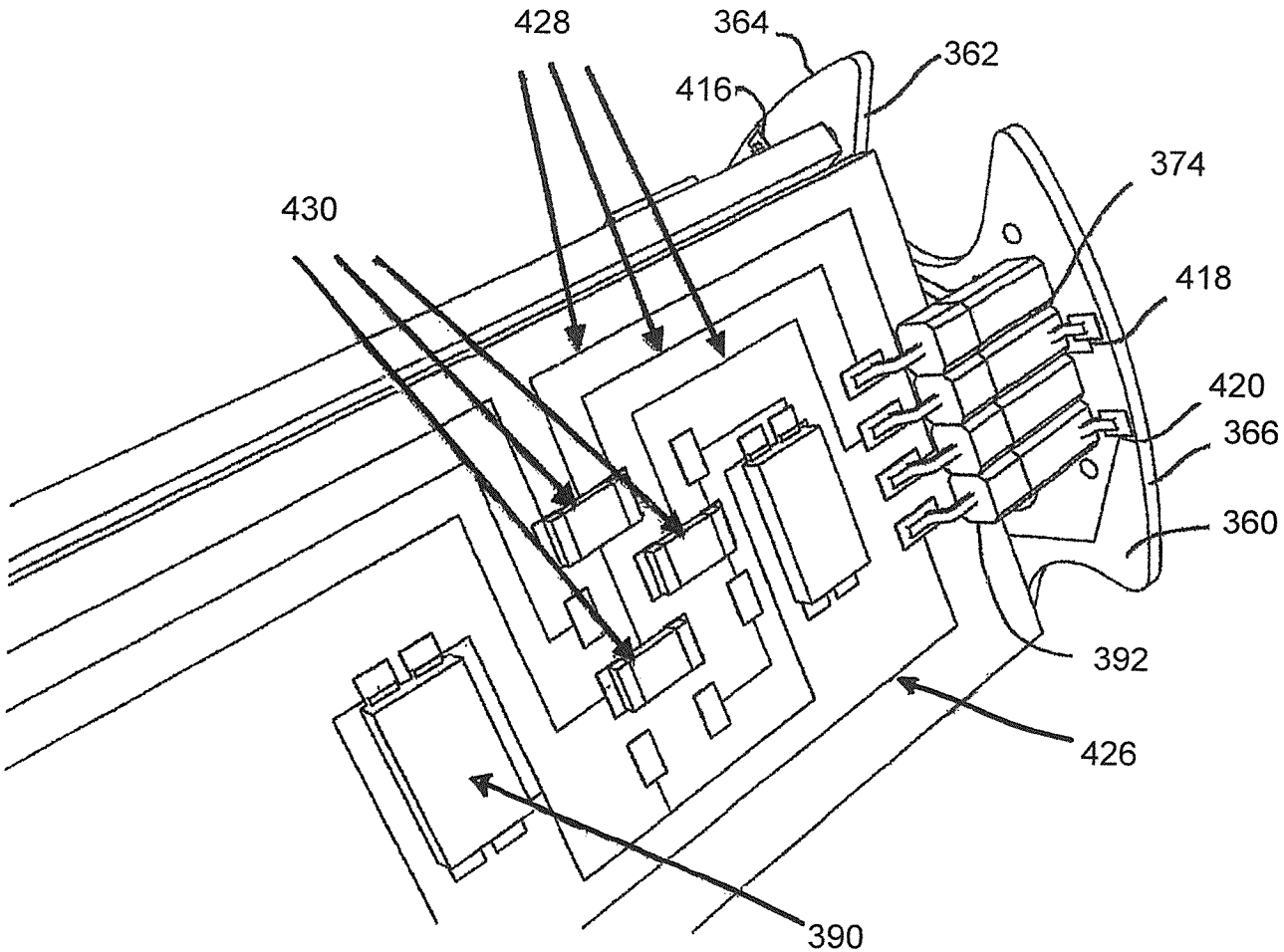
FIG. 29 is a perspective view of LED emitters mounted on an emitter board about a heat sink tube and against the end cap connector board of FIG. 28 and illustrating traces and jumpers.

FIG. 29 is a perspective view of LED emitters mounted on a modular LED emitter board about a heat sink tube (tubular heat sink) and against the end cap connector. The emitter can have an extra trace 426 connected to the emitter board connectors to carry either AC or DC from the opposite side or end of the emitter board. The emitter board can also have regulated DC return traces 428 connected to the emitter board connectors and to series-parallel jumpers 430. The drawings show how the driver is connected to the connector end board in a delta two-sided configuration with both male and female connectors. In some arrangements, (modules), only one end cap board is needed and the emitter boards are designed within a built in electric loop which sends electrical signals through both emitter boards in a W configuration.

The end cap board can have power pins directly soldered without wires. The driver board can be directly socketed and positioned inside the tube (tubular array). Each of the emitter boards can be directly socketed without wires. Extra traces are utilized when necessary to eliminate the need for a main power wire running thought the tube (heat sink).

Figure 31:
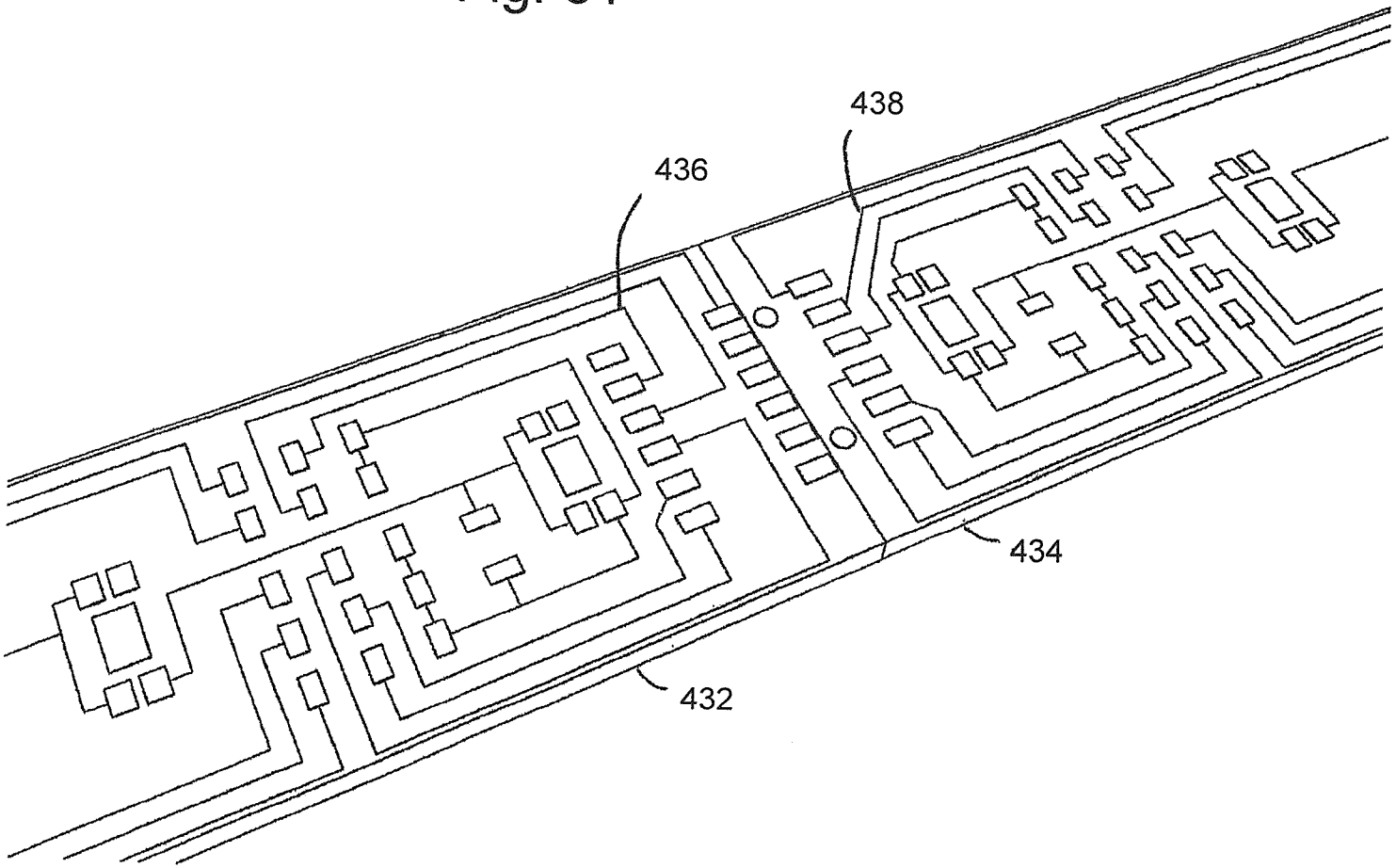
FIG. 31 is a perspective view of emitter boards which are connected longitudinally end to end for use in the non-curvilinear LED luminaries in accordance with principles of the present invention.
Figure 32:
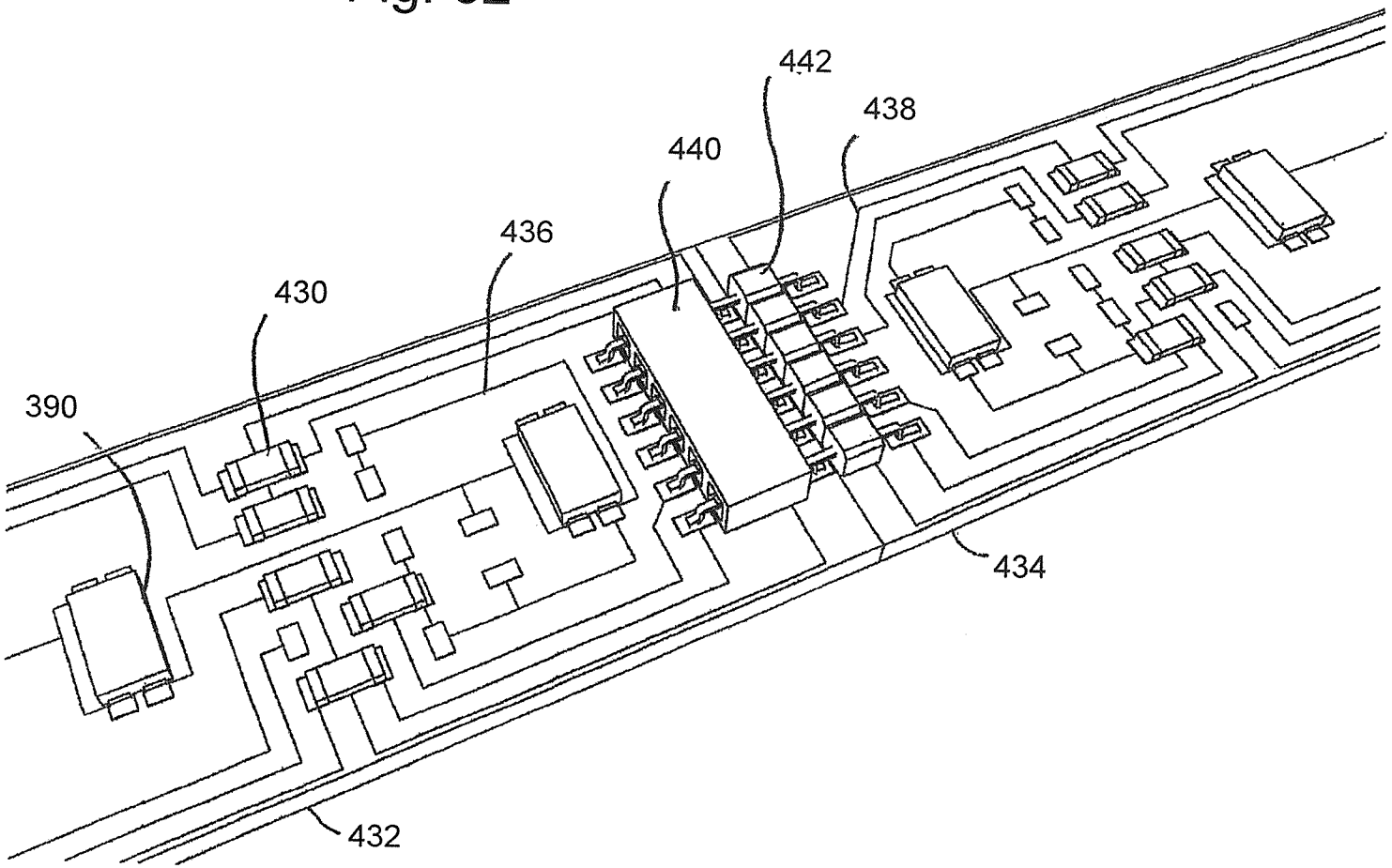
FIG. 32 is a perspective view of LED emitters mounted on the emitter boards of FIG. 31 and illustrating the emitter board connectors.

FIG. 31 is a perspective view of modular emitter boards 432 and 434 which are connected longitudinally end to end, such as described in FIGS. 17 and 18. The emitter boards can have printed emitter board circuitry 436 and sub-circuitry 438. FIG. 32 is a perspective view of LED emitters 390 and series-parallel jumpers 430 mounted on the emitter boards and illustrating emitter board connectors 440 and 442 comprising emitter PCB panel terminal connectors which can connect the ends of the emitter boards.

Figure 33:
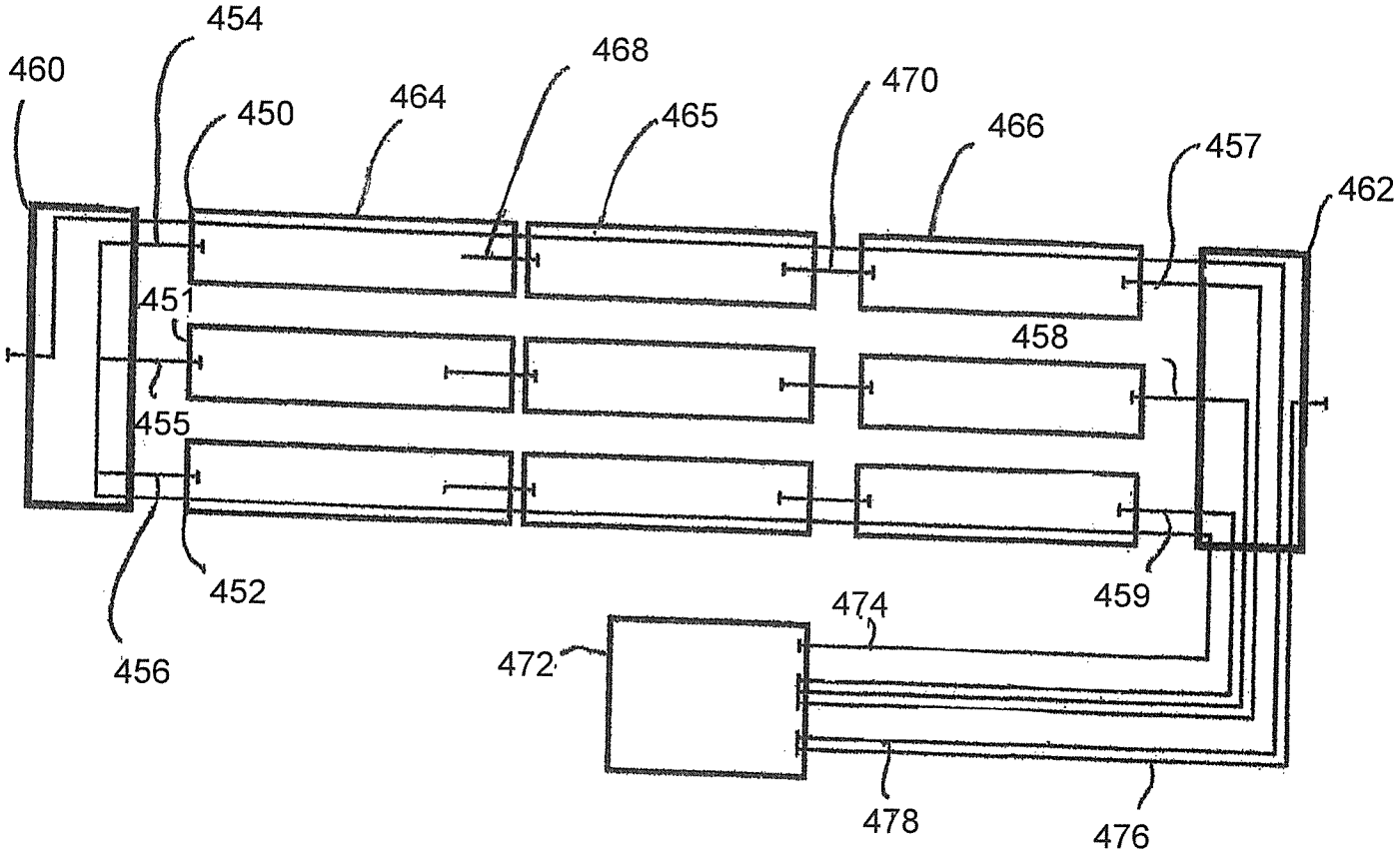
FIG. 33 is a schematic delta LED wiring diagram for the three sided delta non-curvilinear LED luminary in accordance with principles of the present invention.

FIG. 33 is a schematic delta LED wiring diagram for a LED illuminating assembly comprising a three sided LED lighting bar (LED light bar) providing the three sided delta or triangular shaped non-curvilinear LED luminary. The luminary can have three sides comprising rows 450-452 of modular LED emitter boards. Each row can be connected by emitter end traces 454-459 in parallel to end cap PCB connectors (connector end boards or end cap boards) 460 and 462. Each row of LED emitter boards can comprise three aligned modular LED emitter boards 464-466 which can be connected in series to each other by emitter serial traces 468 and 470. The emitter end traces can comprise independent DC regulated return lines (traces) 457-459 which can be connected in parallel to a driver board 472. A common DC outlet line (trace) 474 can be connected to the driver board in parallel with the independent DC regulated return lines. The common DC out line can be connected and extend through the end cap PCB connector 462 through the LED emitter boards of bottom row 452 to end cap PCB connector 460 and in parallel to emitter end traces 454-456. AC line (trace) 476 can extend from the driver board to the end cap 462 and outwardly, such as but not limited to another electrical component or an AC power source. An extra AC line (trace) 478 can extend from the driver board through the end cap PCB connector 462 and top row 450 of LED emitter boards to the end cap PCB connector 460 to eliminate the need of a wire to carry AC. The wiring diagram can include parallel paths on every emitter board allowing many variations of parallel-series electrical connections, such as by using jumpers on the emitter boards.

The wiring diagram of FIG. 33 illustrates the elimination of all wires. While the drawing shows what appears to be a jumper cable between the driver and end-cap, there is only a connector, because they are directly connected. More specifically, alternating current (AC) comes in on the two end-caps; the 'hot' on one side and 'neutral' on the other side. One side of the AC is fed along one string of emitter boards to the main end cap (shown on the right of FIG. 33), where it meets up with the other half of the AC and is fed to the driver board. The driver board converts the AC to direct current (DC) and sends DC current on one trace to the secondary end-cap through an extra trace on one row of emitter boards, where it is combined to apply the same high voltage DC to each string of emitters. On the low side of each string of emitters, there is an independent trace returning to the driver which has an independent current-controlling driver that controls the current separately to each string of emitters with high precision. The wiring diagram is simplified, because in reality there are multiple traces through each emitter board, so that any board can be assigned to any sub-driver.

The wiring diagram shows an example with three strings of three emitter boards: driver potion "a" running the top three emitter boards, driver portion "b" the middle three emitter boards and driver portion "c" the bottom three emitter boards, however for ultimate in redundancy, they can actually be wired such that the driver is responsible for three boards and will not light up emitter boards next to each other.

Example

In this case, the emitter board: driver combination:

| |
|---|
| A A A |
| B B B |
| C C C |

if sub-driver A, B or C fails, or any emitter in the string, one third of the light goes away on that whole side. However, the real wiring would look like this:

| |
|---|
| A B C |
| C A B |
| B C A |

Now if or when one driver sub circuit fails, two-thirds of the light remains and the dead spot revolves around the lamp so there is only a dim spot and not a black out.

Parallel traces can be used in the preferred arrangement. The boards can be made with the traces pre-fabricated. Parallel traces are utilized when needed to get the power to the emitters in an electrically efficient way. The advantage of using parallel traces means is the emitters are all driven at exactly the same current and power level. That is not the case in most conventional designs. A further advantage of the arrangement of parallel-series wiring is that we can run our lighting at higher voltage and lower current so that it is more efficient regardless of which driver is used. This is an important aspect of this arrangement. Furthermore, a multiple channel driver that has multiple channels can be used. In one particular model, six boards were wired three different ways.

Figure 34:
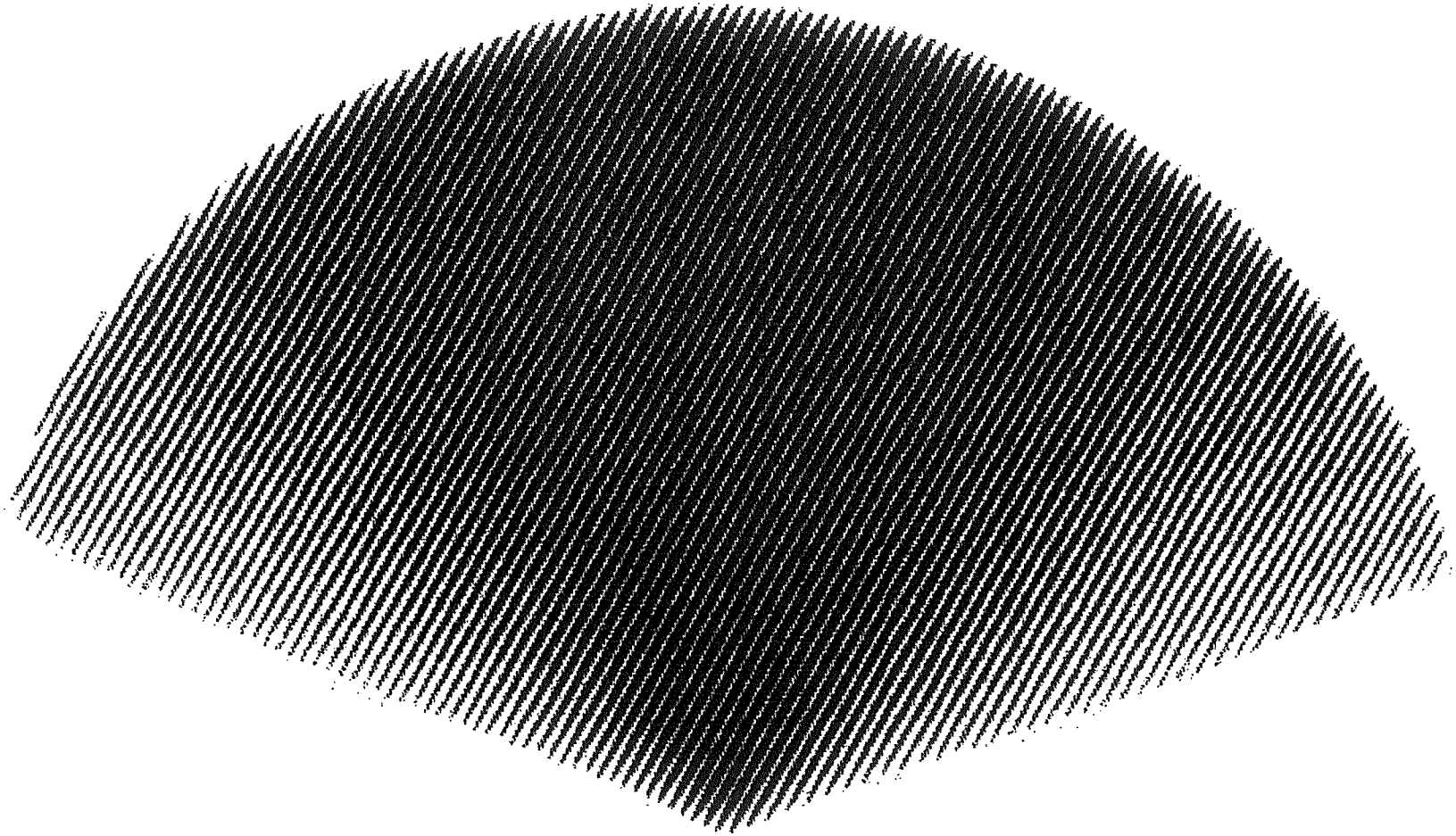
FIG. 34 is a light distribution pattern emitted from a straight row of emitters and is sometime referred to as the "baseline" or light angle before".

Light distribution patterns are shown in FIGS. 34-43. FIG. 34 is a light distribution pattern emitted from a straight row of emitters and is sometime referred to as the "baseline" or light angle before". The full angle is about 150 degrees of usable light but the fall-off is down to 20% of peak brightness on the outer edges of that cone of light. The ½ brightness angle (angle outside of which is less than ½ the peak on axis intensity) is about 120 degree in a very good emitter (60 degrees off-axis in a 360 degree cone). When using rows of emitters in columns with the rows representing the PCB and the columns representing the light bar, the light distribution is uneven as the columns are spread out, since due to practicality, the spacing on the rows will be closer than on the column.

Figure 35:
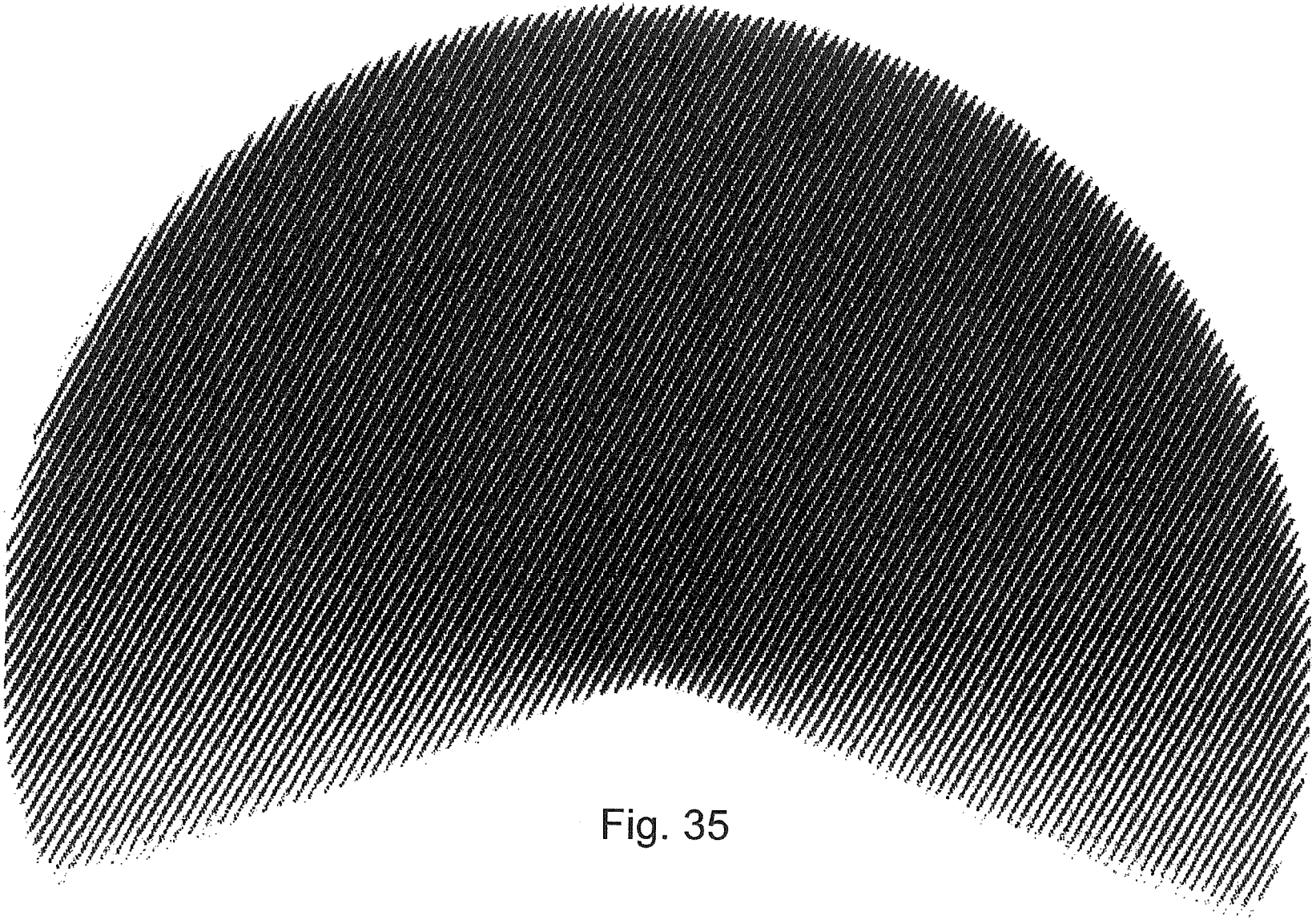
FIG. 35 is a light distribution pattern emitted from a two sided delta non-curvilinear LED luminary in accordance with principles of the present invention and is sometime referred to as the "light angle after".

FIG. 35 is a light distribution pattern emitted from a two sided delta non-curvilinear LED luminary and is sometime referred to as the "light angle after". Clearly visible is the fact that the center brightness is far wider and the beam width is greatly improved. The full angle is about 230 degree which is up from 150 degrees of usable light. The ½ brightness angle is bumped up from about 120 degrees which up to over 180 degrees, something impossible to achieve with a conventional single row of emitters.

Figure 36:
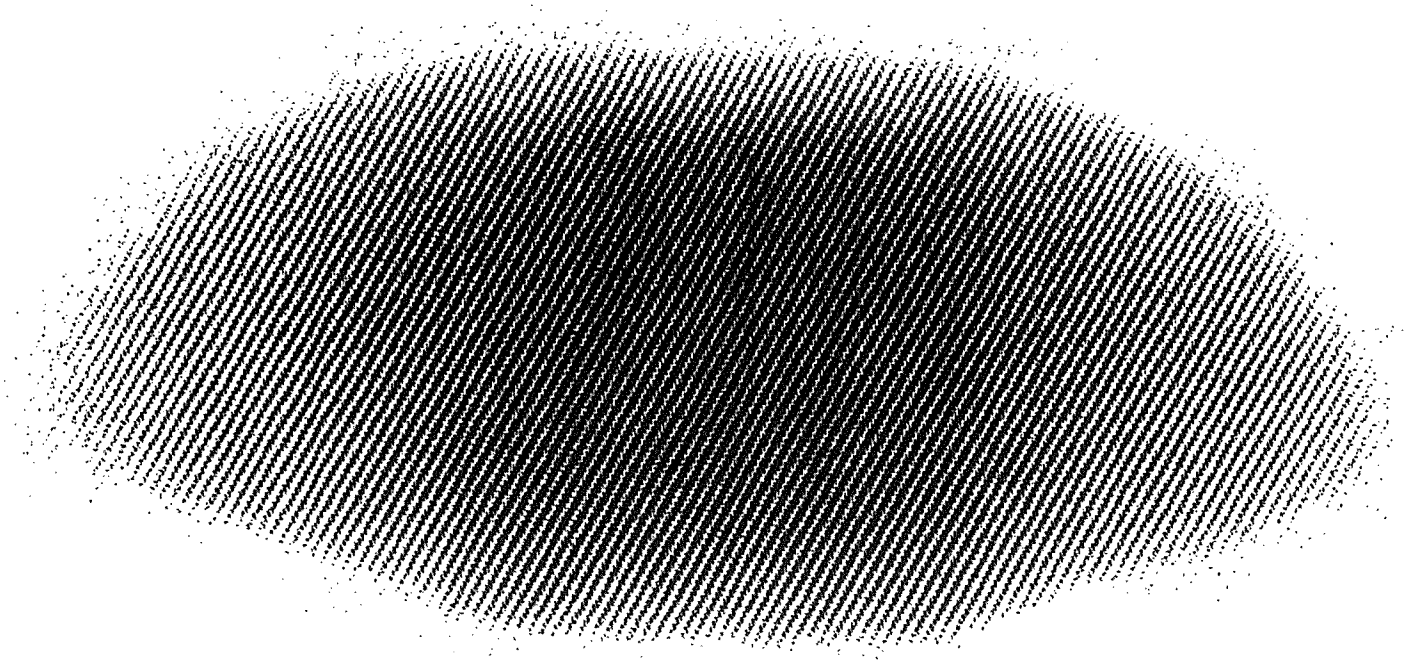
FIG. 36 is a light distribution pattern emitted from a conventional prior art flat plane of forward facing emitters with the four light bars spaced six inches apart in one or four rows and is sometime referred to as the "light array before".

FIG. 36 is a light distribution pattern emitted from a conventional prior art flat plane of forward facing emitters with four light bars spaced six inches apart in one or four rows and is sometime referred to as the "light array before". FIG. 36 is a light distribution pattern emitted from a conventional prior art flat plane of forward facing emitters with the four light bars spaced six inches apart in one or four rows and is sometime referred to as the "light array before". Rows of forward-facing only emitters make almost a circular pattern of light with dramatic fall off outside of that 'hot spot' area. A better solution can be attained by putting multiple copies of the rows on each column, angled away from each other in an angle optimized per use. Such as with the light bounced back off a reflector or directly to the subject being lit. Here is an example of a cross-section of the light using two rows of emitters angled away from each other at an angle optimized to combine the two into one smooth continuous beam as if it were one row of wider-angle emitters.

Figure 37:
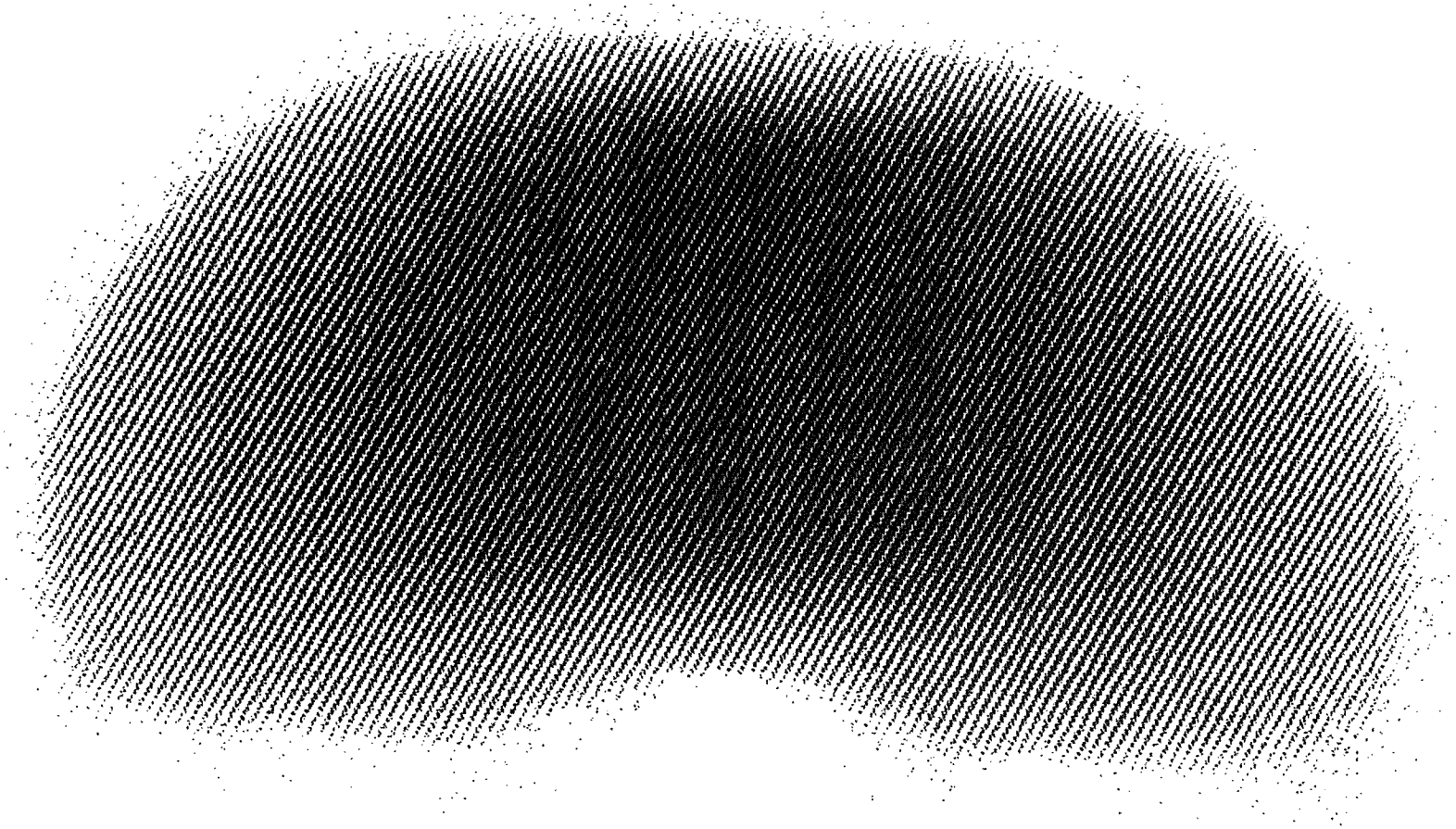
FIG. 37 is a light distribution pattern emitted from four light bars of two sided delta non-curvilinear LED luminaries in accordance with principles of the present invention and is sometime referred to as the "light array before".

FIG. 37 is a light distribution pattern emitted from four light bars of two sided delta non-curvilinear LED luminaries and is sometime referred to as the "light array before". An array of delta LED light bars will have a light distribution similar to FIG. 37. This is a far wider light distribution indicating that the light pattern will be smoother with less dark and bright zones. This same concept applies when going around the tube. The perfect light pattern can be achieved with a five sided hexagonal or a heptagonal extrusion but shown here are the difference of using a two sided and three sided LED light bar.

Figure 38:
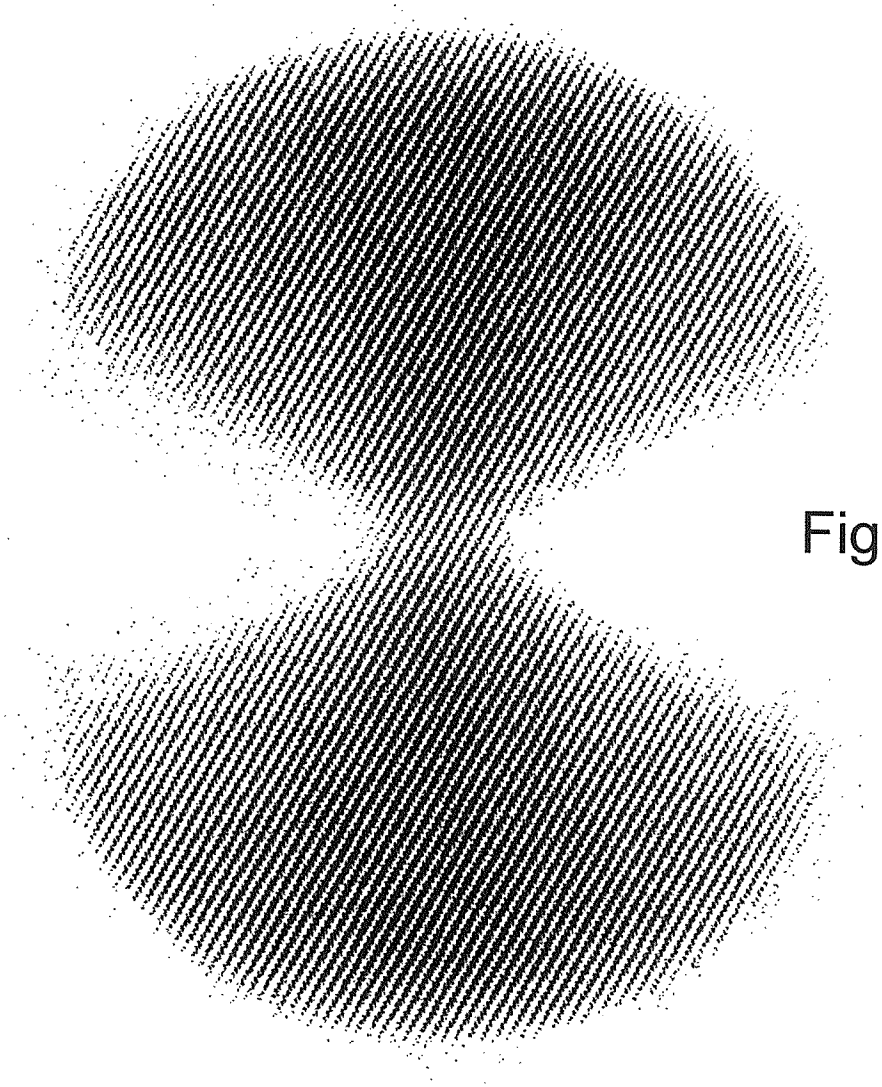
FIG. 38 is a light distribution pattern emitted from a conventional prior art setup using two planar row of emitters back-to-back at 180 degrees such as for illuminating a two sided outdoor sign.
Figure 39:
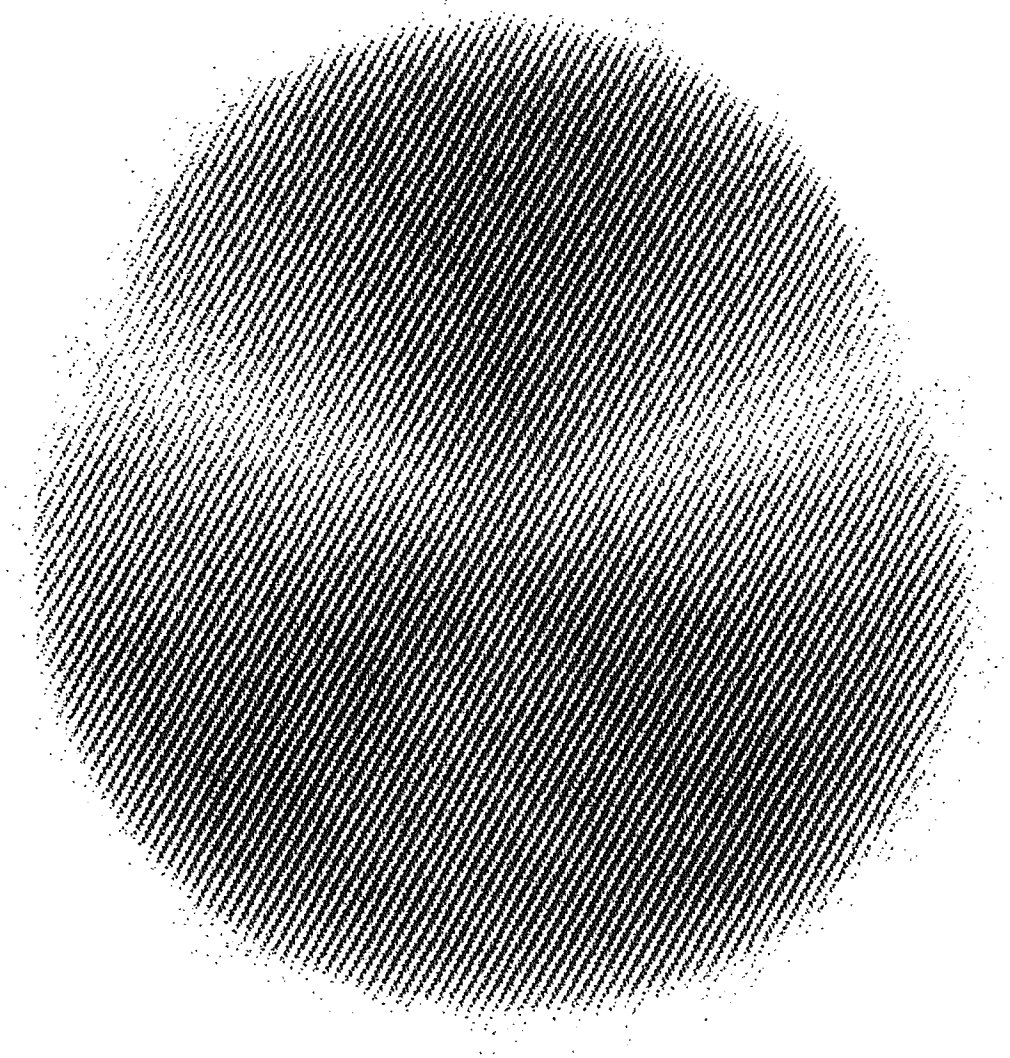
FIG. 39 is a light distribution pattern emitted from three sided delta non-curvilinear LED luminaries in accordance with principles of the present invention and is optimized to reduce the dim zone on the forward facing sided as well as create a balance between two dark zone that are mostly going into a reflector and the one zone that is used for direct illumination.

FIG. 38 is a light distribution pattern emitted from a conventional prior art setup using two planar row of emitters back-to-back at 180 degrees such as for illuminating a two sided outdoor sign. FIG. 39 is a light distribution pattern emitted from three sided delta or triangular non-curvilinear LED luminaries and is optimized to reduce the dim zone on the forward facing sided as well as create a balance between two dark zones that are mostly going into a reflector and the one zone that is used for direct illumination. With only three rows, a perfectly even light distribution is not physically possible, but by adjusting the angles, we can improve the forward-facing light. Though there is a slight dimming zone directly up from the center, the light distribution pattern is improved over the two dim zones that are 'south east' and 'south west' from the center. The improved LED light bar can be installed in such a way to eliminate any artifacts from those dim zones. When using a four sided tube LED light bar, the light pattern becomes nearly uniform. When using a five sided tube LED light bar, the light pattern essentially attains a 360 degree uniform light distribution.

Figure 40:
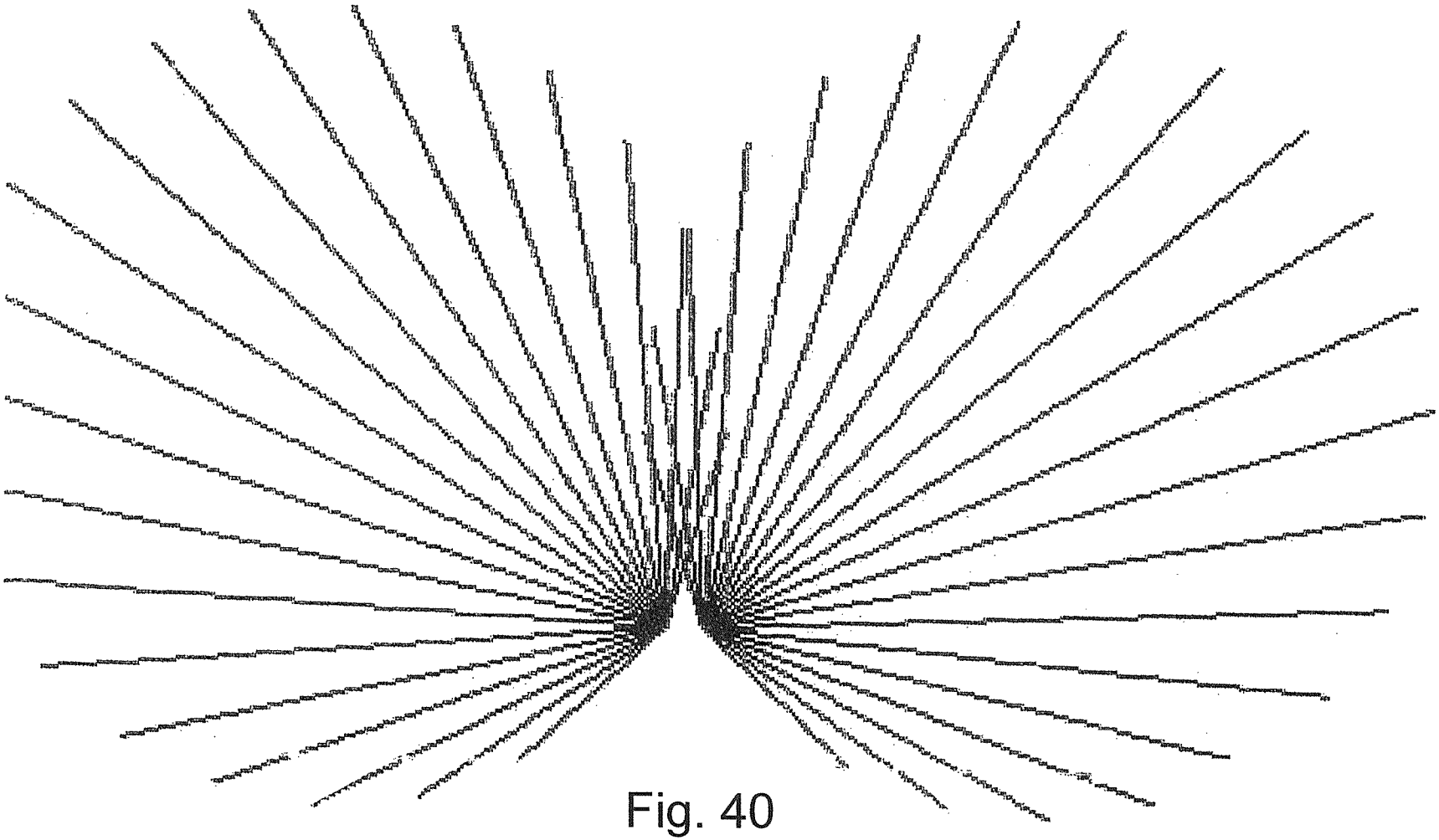
FIG. 40 is a light distribution pattern emitted from a single emitter.
Figure 41:
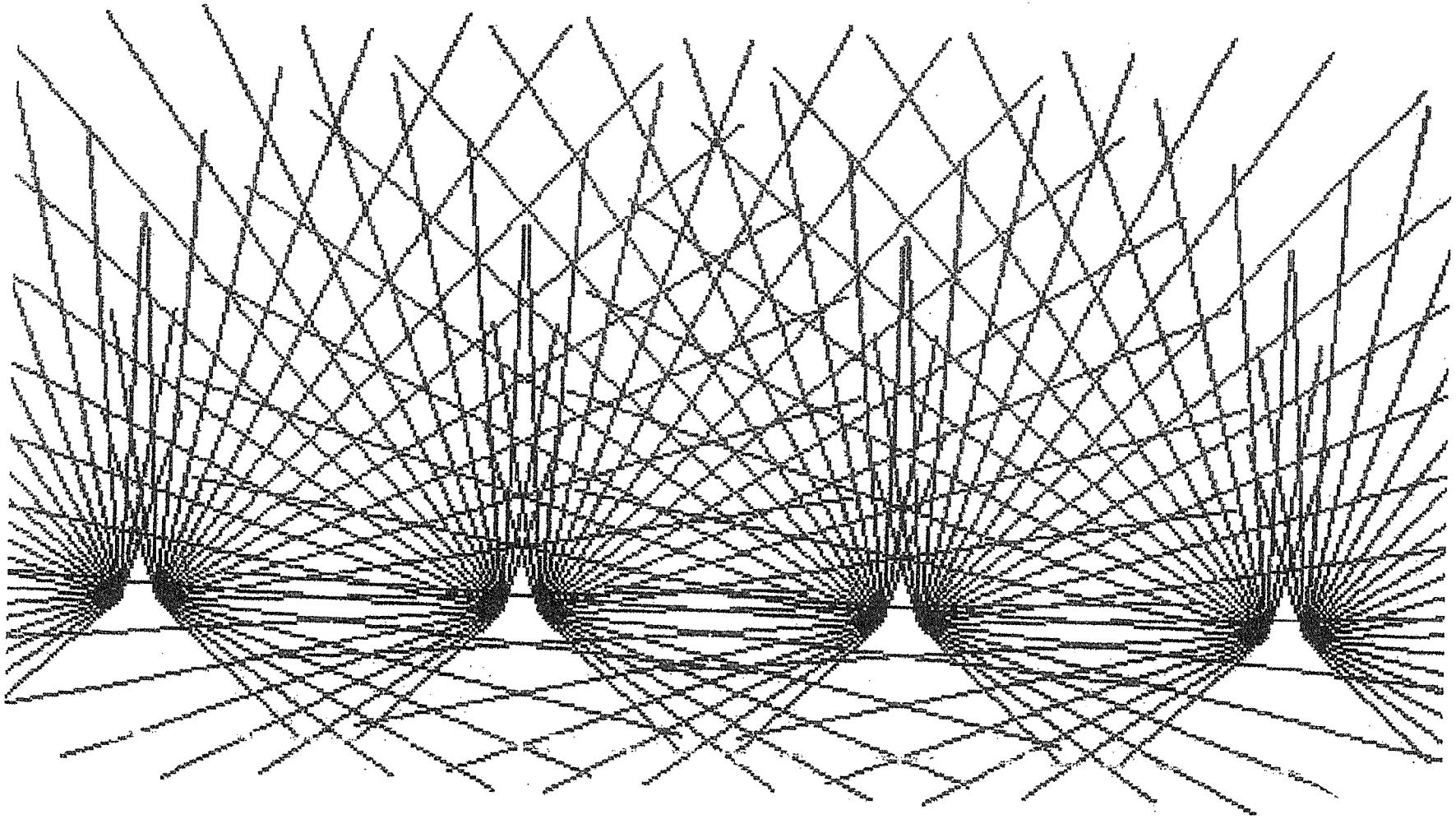
FIG. 41 is a light distribution pattern emitted from a set or row of emitter of FIG. 40.
Figure 42:
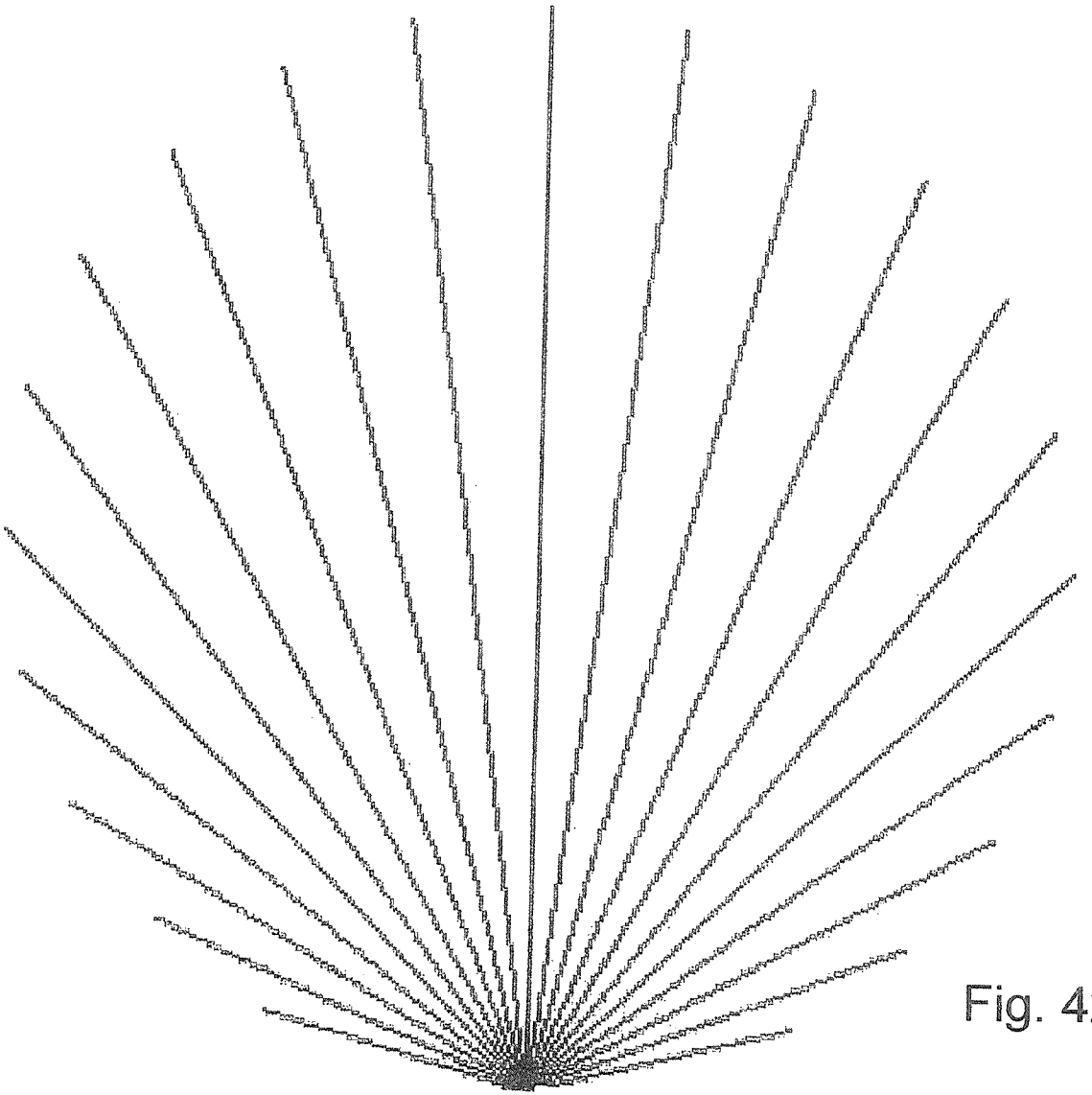
FIG. 42 is a light distribution pattern emitted from a single forward facing emitter.
Figure 43:
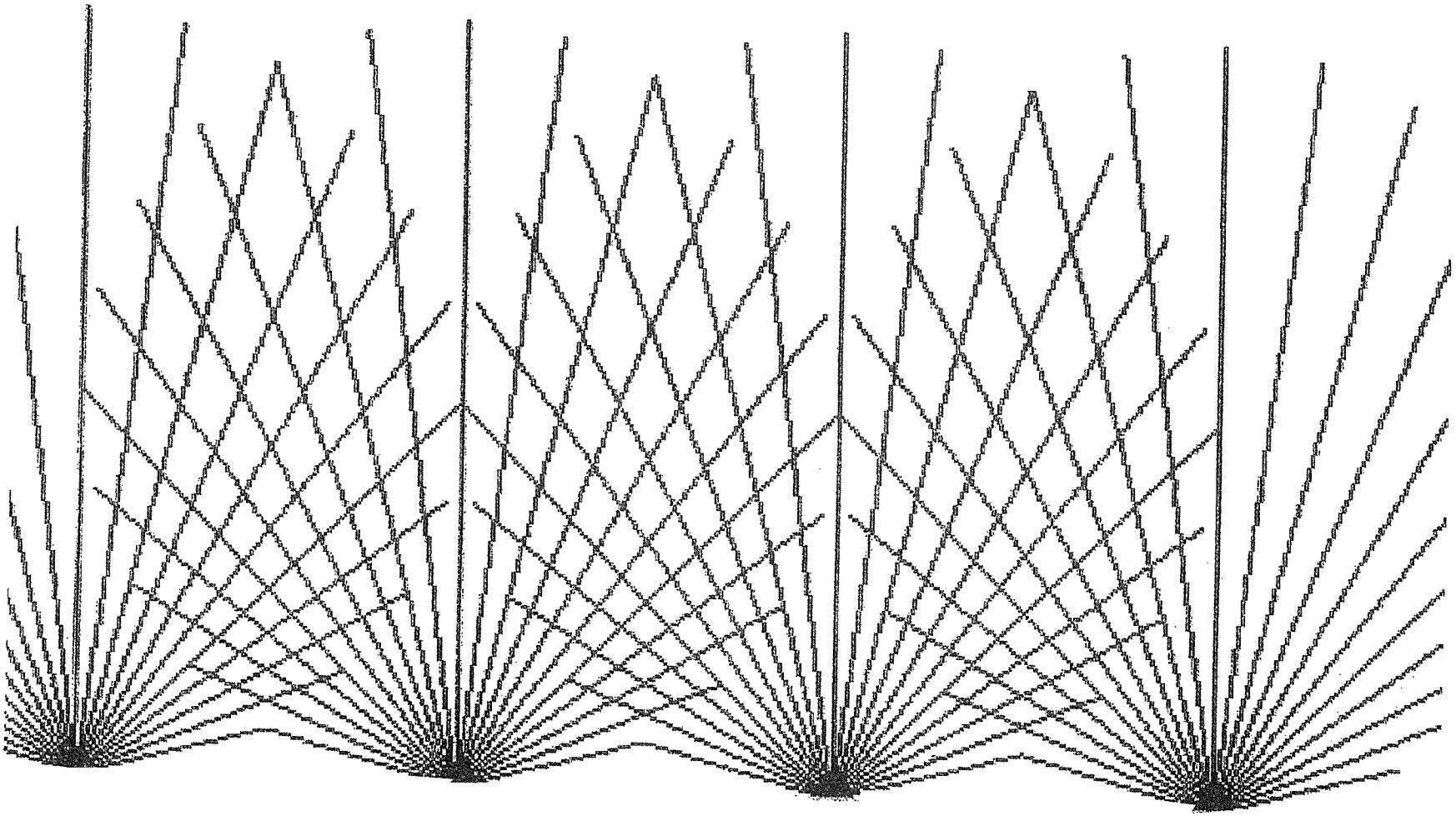
FIG. 43 is a light distribution pattern emitted from a set or row of forward facing emitters of FIG. 4.

FIG. 40 is a light distribution pattern emitted from a single emitter. FIG. 41 is a light distribution pattern emitted from a set or row of emitter of FIG. 40. FIG. 42 is a light distribution pattern emitted from a single forward facing emitter. FIG. 43 is a light distribution pattern emitted from a set or row of forward facing emitters of FIG. 4.

Figure 44:
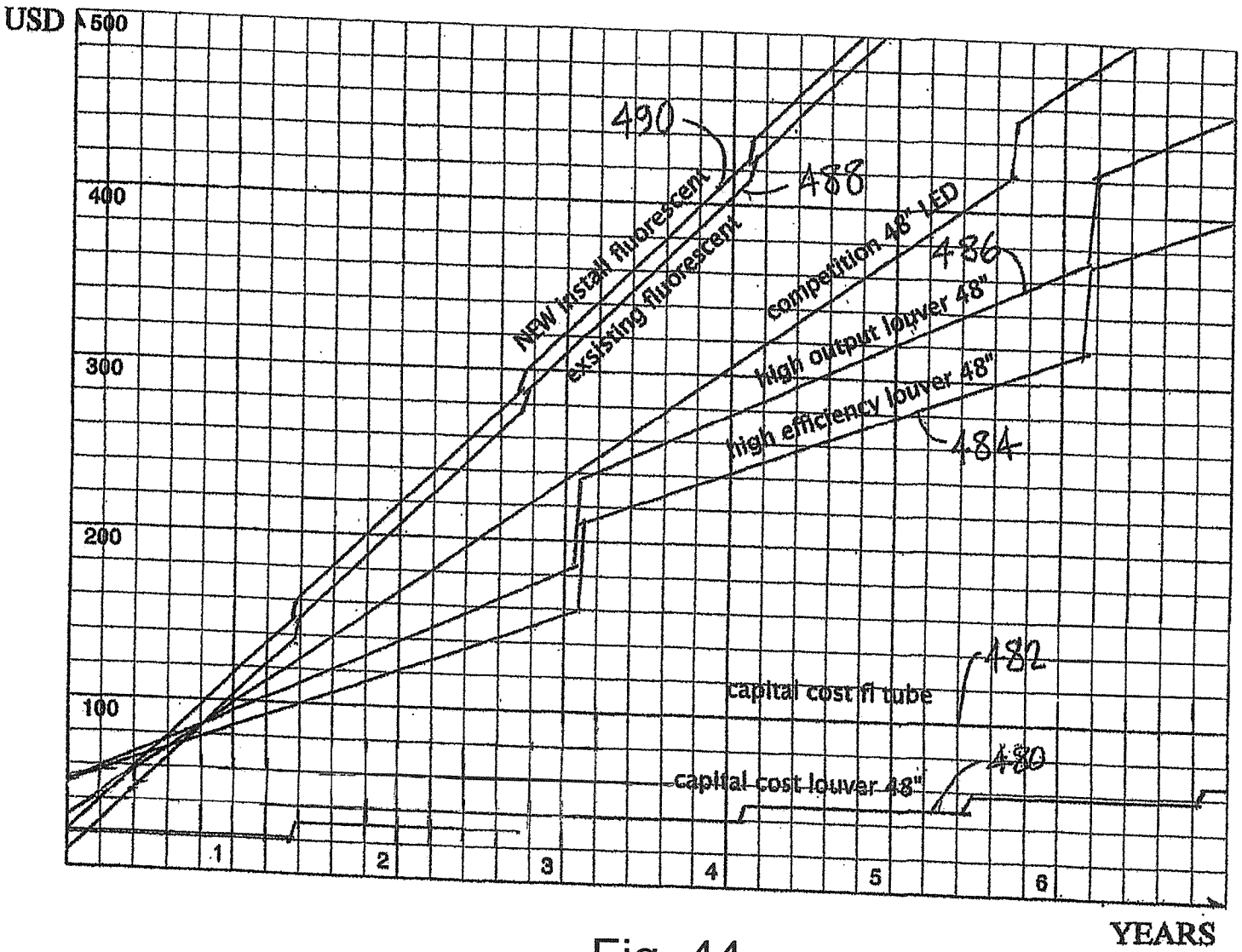
FIG. 44 is a graph of operational costs of non-curvilinear LED luminaries in accordance with principles of the present invention in comparison with conventional LED and fluorescent luminaries where the X axis is time in years and the Y axis is U.S. dollars (USD).

FIG. 44 is a graph of operational and capital costs of non-curvilinear LED luminaries in comparison with conventional LED and fluorescent luminaries where the X axis is timed expressed in years and the Y axis is U.S. dollars (USD). The capital cost to replace a lighting bar (LED light bar) comprising a delta or triangular shaped LED luminary 480 which extends 48 inches is illustrated in the graph and has the lowest cost. The capital cost to replace a 48 inch fluorescent bulb 482 operating at 65 watts has a higher cost. The operational cost of a high efficiency delta or triangular shaped LED luminary 484 which is 48 inches long and emits and emits 3000 lumens (L) is shown in the graph and has the lowest operational cost. The operational cost of a high output delta or triangular shaped LED luminary 486 which is 48 inches long and emits a brighter light with an illumination of 3600 L, but with the more power and the same number of emitters as LED luminary 484, is slightly more than the high efficiency LED luminary. A typical prior art LED luminary 486 is shown in the graph and has higher operational costs than the delta triangular shaped LED luminaries 484 and 486. The operational costs of an existing 48 inch 65 watt (W) fluorescent tube 488 than including ballast is much more expensive than the delta triangular shaped LED luminaries 484 and 486. The operational costs of electricity to operate a newly installed fluorescent tube 490 are the most expensive cost on the graph.

When referring to relative brightness to power, the correct term is efficacy or illuminating efficacy and it can be expressed in lumen per watt. Electrical efficiency when referring to the light bar or its components can be expressed in watts of power going into the system versus how many are delivered to the emitters themselves. Lifespan can be expressed in thousands of hours. Typically, a fluorescent tube will last 8 to 10,000 hours. A conventional LED can last about the same when driven hard as they are when used as fluorescent replacements. A high-quality SMD high-power LED will last about 50,000 hours when driven to spec and over 70,000 hours when under-driven. The models of lighting described by this patent application can be optimized to be nearly 100% efficient from the light bars themselves, that is to say, 100% of the watts going to the light-bar are delivered to the emitters. This is because the wiring goes directly to the emitters and there is not a lot of power loss on the traces. There is a tremendous gain in overall system efficiency when the emitter count is optimized to the input voltage so an extremely high-efficiency electrical driver can be utilized. Four to five time improvements in conventional efficiency can be achieved with the inventive LED light bars.

Figure 45:
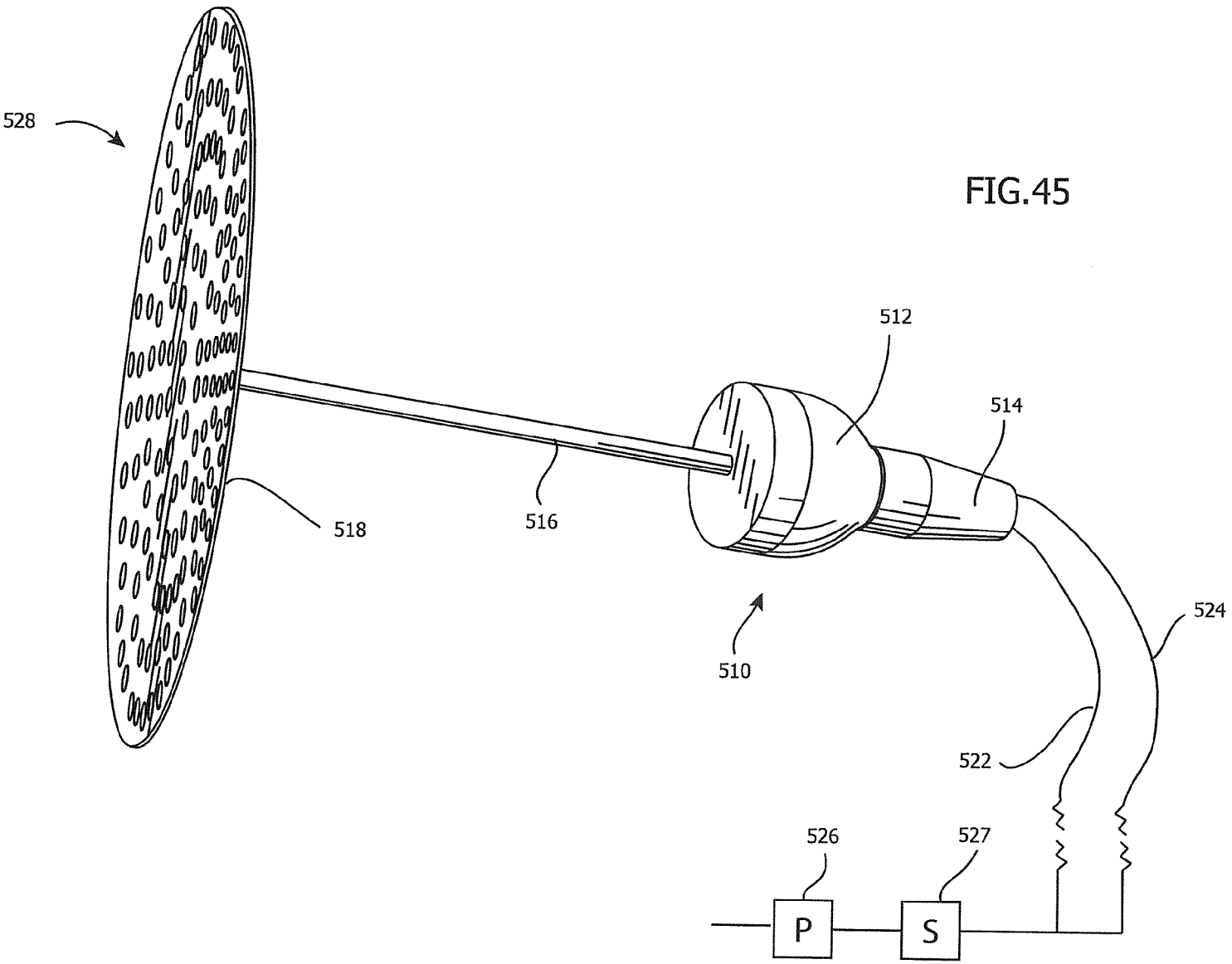
FIG. 45 is a schematic diagram of a prototype non-curvilinear LED luminary in accordance with principles of the present invention.

FIG. 45 is a schematic diagram of a prototype non-curvilinear LED luminary.

Figure 46:
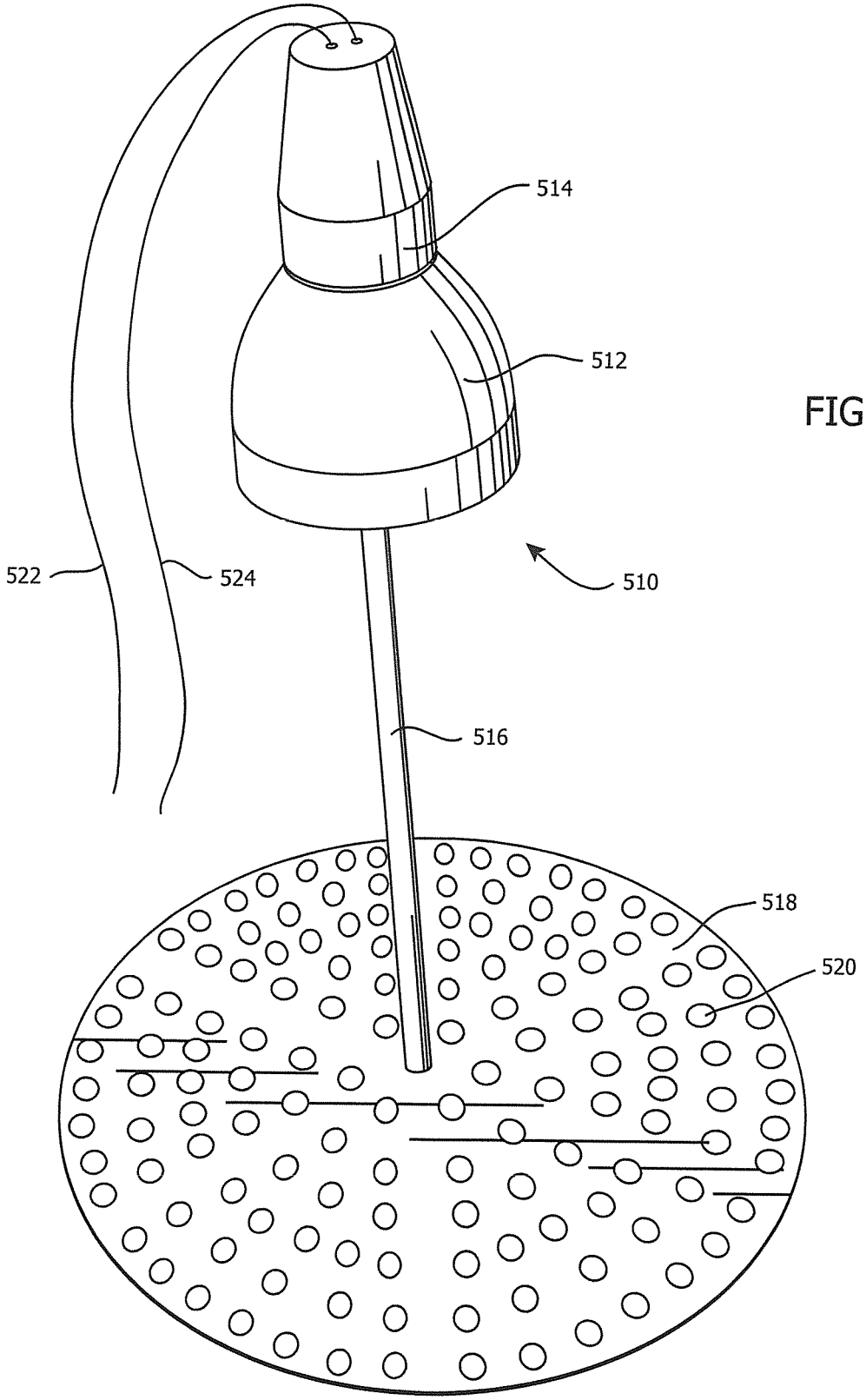
FIG. 46 is a top view of the prototype non-curvilinear LED luminary of FIG. 45.

FIG. 46 is a top view of the prototype non-curvilinear LED luminary.

FIG. 47 is a schematic diagram of another prototype non-curvilinear LED luminary. FIG. 48 is an enlarged cross-sectional view of a prototype delta three sided non-curvilinear LED luminary taken along line A-A of FIG. 47. FIG. 49 is a bottom view of the non-curvilinear LED taken along line B of FIG. 48.

Figure 50:
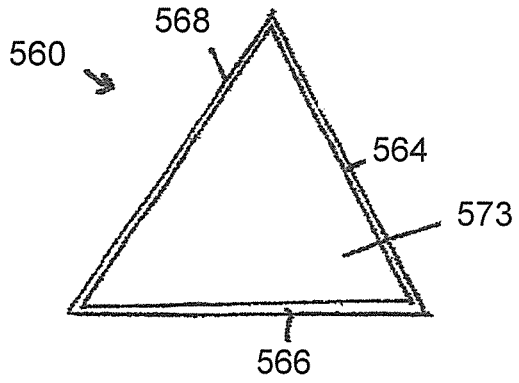
FIG. 50 is an enlarged cross-sectional view of a further prototype delta three sided non-curvilinear LED luminary in accordance with principles of the present invention.
Figure 51:
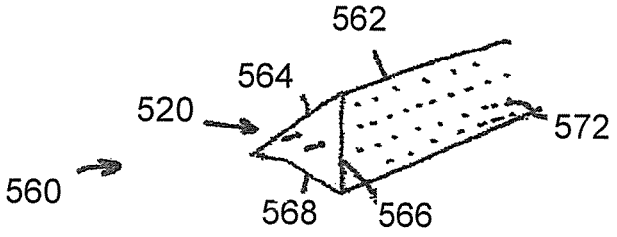
FIG. 51 is a perspective view of part of the prototype delta three sided non-curvilinear LED luminary of FIG. 50.

FIG. 50 is an enlarged cross-sectional view of a further prototype delta three sided non-curvilinear LED luminary. FIG. 51 is a perspective view of part of the prototype delta three sided non-curvilinear LED luminary of FIG. 50.

Figure 52:
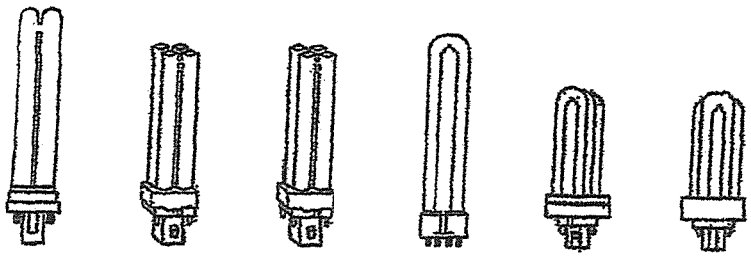
FIG. 52 is a perspective view of pin arrangements in lamp bases for compact lamp shapes.
Figure 53:
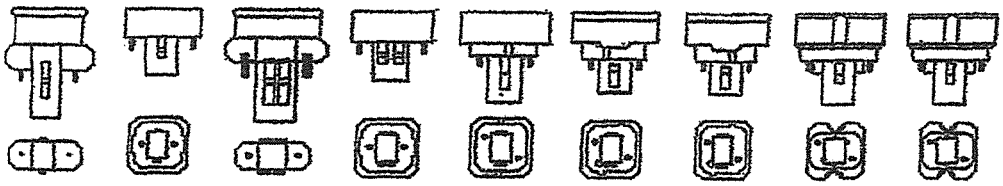
FIG. 53 illustrates the front and bottom views of pin arrangements in compact lamp bases for two pin lamps.
Figure 54:
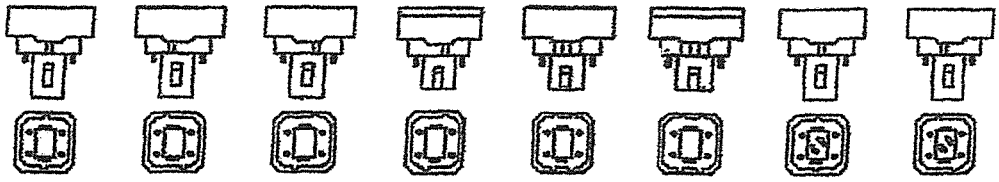
FIG. 54 illustrates the front and bottom views of pin arrangements in compact lamp bases for four pin lamps.
Figure 54:
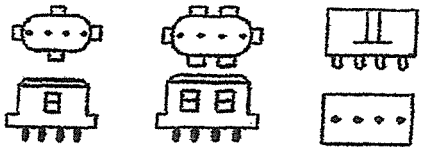

FIG. 52 is a perspective view of pin arrangements in lamp bases for compact lamp shapes. FIG. 53 illustrates the front and bottom views of pin arrangements in compact lamp bases for two pin lamps. FIG. 54 illustrates the front and bottom views of pin arrangements in compact lamp bases for four pin lamps.

In describing the preferred embodiments of the invention, which are illustrated in the drawings, specific terminology has been resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," or terms similar thereto are often used. They are not limited to direct connection but include connection through other elements where such connection is recognized as being equivalent by those skilled in the art.

The present invention and the various features and advantageous details thereof are explained more fully with reference to the non-limiting embodiments described in the detailed description of the invention. The present invention can relate to aspects of providing electrical housings, device frame work, and a lightweight luminary body for a luminary whose illumination is provided by light emitting diodes (LEDs). The present invention can also addresses issues related to thermal management, heat sink, and power source integration. The more compact LED orientation can be achievable with improved management of the thermal operating loads.

FIG. 47 illustrates an existing lighting fixture 510 that is retrofitted for light emitting diode (LED) lamination. Driver 502 is provided for LED electric power. A shaft 503 is connected to a LED power strip 504. A LED bulb 505 is connected to the LED power strip, electric power lines 506 are connected to and power the LED power strip.

FIGS. 45-51 show a light emitting diode (LED) luminary 510 according to one embodiment of the present invention. Luminary 510 includes a socket 512 that is preferably constructed to removably cooperate with a base 514. Regardless of the specific construction of the base 514, the base is commonly understood as that portion of a fixture that receives a luminary and provides the electrical connection between the luminary and the fixture. In one embodiment, the socket and base are constructed to cooperate in a threading manner common to many different types of luminaries. Alternatively, the socket and base can be constructed in any number of corresponding mating configurations. A number of such mating configurations are shown in FIGS. 52-54. It is appreciated that such interactions may be provided in a number of configurations that may or may not have a threading and/or a twisting interaction between the socket and base.

Referring back to FIGS. 45 and 46, an optional post 516 extends between the socket and a base or support 518. The support includes one, and preferably a number of individual light emitting diodes (LEDs) 520 that can be supported in an offset orientation from the socket. Preferably, the support can be configured to isolate the LEDs from the atmosphere. It is also appreciated that the support can form a lens or the outermost translucent structure of the luminary and/or be positioned very near thereto for those instances that include a supplemental lens near support 518.

A number of conductors or electrical connectors 522 and 524 can communicate electrical power, which are indicated by exemplary power supply 526 and/or switch 527 to the socket. The conductors 522 and 524 can extend through the optional post 516 to the support. The support 518 can be provided with a number of wire traces that are distributed about the support and electrically connect to each LED to the power source 526. As explained further below, it is appreciated that one or more power modifying devices such as converters or drivers may be disposed between LEDs and power source. The LED's 520 can be oriented on each of the opposite sides 528 and 530 of the generally planar shape of support 518 of the luminary.

As shown in FIG. 47, a shroud or reflector 530 can be oriented about the luminary 510 and configured to redirect light emitted from LEDs oriented on the upward directed side 530 of the support in a generally downward direction, indicated by arrow 534 (FIG. 48), to improve the illumination performance of luminary. The LEDs are preferably uniformly distributed about the support.

Referring to FIGS. 47-49, an alternate configuration of the luminary includes a generally planar multi-sided hollow support post 544 that extends in a longitudinal direction between the socket 512 and support 518. As shown in FIG. 48, in one embodiment of the present invention, the support post includes three walls 546, 548, and 550 that form a generally equilateral triangle. Although shown as having a triangular shape, it is appreciated that the support post can be provided in other generally rectilinear or substantially non-curvilinear cross-sectional shapes. As described further below, such a configuration increases the area available for LED support and provides a beneficial configuration for the integration of power, heat dissipating, and operational control devices such as device drivers within the footprint of the luminary rather than requiring extraneous structures for housing such components. As shown in FIG. 48, a cavity 552 enclosed by the post 544 may be sized to accommodate electrical components, such as a driver, a heat sink, a circuit board, electrical and/or thermal components 556, associated with the powered operation of the LEDs.

FIGS. 50 and 51 show a luminary 560 according to another embodiment of the invention. The luminary can include an elongated body 562 that can comprise a number of sides 564, 566 and 568 that can also be oriented in a rectilinear or non-curvilinear orientation. Unlike luminary 510, luminary 560 includes a socket 570 that is generally oriented at one end of luminary. A number of individual LEDs 572 can be distributed about at least one, and preferably more than one or each of sides 564, 566 and 568 of the luminary. A space 573 bounded by sides 564, 566 and 568 and socket 570 can accommodate the electronic and/or thermal equipment such as a power supply and/or electronic drivers, heat sinks and/or other thermal control structures, and/or controllers associated with the operation of LEDs. As shown in FIG. 51, in another embodiment, a number of LEDs 572 is supported by each side 564, 566 and 568 of the luminary 560. Such an orientation can increases the range of lumen output associated with luminary 560 as compared to conventional prior art luminaries having similar spatial requirements. Although the LEDs 572 are shown as being supported on a lens forming structure of luminary 560, it is appreciated that the LEDs could be supported on an internal power strip or circuit board having a generally similar shape as the luminary and can be oriented in close proximity to the interior surface of sides 564, 566 and 568. Such an LED support can be longitudinally translatable relative to the exterior surface of the luminary during the assembly thereof The LEDs can be integrated into each of sides 564, 566 and 568 such that each of the respective sides of the luminary forms the lens and isolates the LEDs from the atmosphere.

The shape of the frame work, housing configuration, and considerations of thermal management can allow the placement of LED's on a broader surface area than known conventional luminaries. This dispersed placement of the LEDs can allow greater degree of light dissipation and greater lumen output. In one preferred embodiments, the non-circular or rectilinear orientation of the LEDs can allow up to three surface points for placement of the individual light sources. The preferred embodiment can includes a frame work housing and thermal management channel that also allows for selective internal or external placement of a power source that powers the light source. Regardless of the proximate orientation of the power source, the luminary can allow greater thermal management for heat dissipation. In a preferred embodiment, the luminary has a three-sided, triangular or delta cross-sectional shape. It is appreciated that the lumen can have any number of generally non-curvilinear shapes including a square or virtually any number of planar side members. When provided in a delta or triangular shape, it is appreciated that the lumen can be provided in virtually any shape including equilateral and/or isosceles triangular shapes. The multiple planar surface structures allows for greater variation in the lumen orientation and position and a broader lumen mounting area to provide greater light.

It is envisioned that the socket of the lumen (luminary) can be configured to cooperate with virtually any base receptacle including, but not limited to, those shown in FIGS. 52-54. Such bases can also include other bases. It is envisioned that the luminary of the present invention can be provided in a shape applicable to any base configuration. The luminary can be configured to operate in the range of about 1 watt to about 1000 watts or more power usage. The luminary can provide a full spectrum of kelvin colors and can be configured for operation at all voltages including the most common voltages of 12 volts (v), 24 v, 110 v, 120 v, 208 v, 277 v, and 480 v. It is further appreciated that the luminary can be provided in virtually any length including lengths ranging from about 2 inches to about 96 inches or more and lengths common to the lighting industry.

The disclosed luminary can provide for greater surface area for LED light source than any known conventional luminary having a comparable footprint. The luminary construction can also allow for internal or external placement of a power supply source while allowing thermal management and greater lumen output and greater degree of light spread. The luminary can be configured to be a suitable plug and play configuration to provide enhanced LED lighting that suitable for operation with conventional fluorescent type lighting.

This invention can allow more surface area for placement of LEDs for the purpose of increased lumen output and greater degree of light dispersion. This can allow provisions for an internal or an external power supply, source, controllers, connections, and/or thermal control devices. The triangular shape can allow up to three points for light surface and thermal management to provide a luminary with a greater operating range and improved power management.

The improved light emitting diode (LED) illuminating assembly can comprise a multiple sided modular LED lighting bar, which is also referred to as a multi-sided LED light bar, comprising a non-curvilinear (LED) luminary with a multi-sided elongated tubular array having multiple, several, numerous or many sides comprising modular boards which can define panels with longitudinally opposite ends. The tubular array preferably can have a non-curvilinear cross-sectional configuration (cross-section) without and in the absence of a circular cross-sectional configuration, oval cross-sectional configuration, elliptical cross-sectional configuration and a substantially or rounded curved cross-sectional configuration. Each of the sides of the multi-sided tubular array can have a generally planar flat surface as viewed from the ends of the array, and adjacent sides which intersect each other and converge at an angle of inclination. Operatively positioned and connected to the multi-sided array can be an internal non-switching printed circuit board (PCB) driver comprising a driver board. The driver can be an interior or inner driver board positioned within an interior of the tubular array or can be an exterior or outer driver board which comprises and provides one of the sides of the tubular array. Desirably, two or some of the sides comprise modular LED emitter boards which can provide elongated LED PCB panels. The internal driver comprising the driver board can drive the LED emitter boards and can comprise one or more modular driver boards that are connected in series and/or parallel with each other.

The improved LED illuminating assembly comprising a multi-sided light bar providing a non-curvilinear (LED) luminary can have an optimal count of LED emitters comprising a group, set, matrix, series, multitude, plurality or array of light emitting diodes (LEDs) securely positioned, mounted and arranged on each of the emitter boards for emitting and distributing light outwardly from the emitter boards in a light distribution pattern for enhanced LED illumination and operational efficiency.

End cap PCB connectors providing connector end boards which are also referred to as end cap boards can be positioned at the ends of the tubular array and connected to the internal driver board and the emitter boards. The connector end boards can have power connector pins which can extend longitudinally outwardly for engaging and providing an electrical power connection with at least one light socket. End caps can be positioned about the end cap PCB connectors. The end caps can have bracket segments which can provide clamps that can extend longitudinally inwardly for abuttingly engaging, grasping and clamping the emitter boards.

The boards comprising the emitter boards and driver board can be generally rectangular and modular. Each of the sides of the multi-sided array comprising emitter boards can comprise a single emitter board or a set, series, plurality, multitude or multiple elongated emitter boards longitudinally connected end to end. The sides comprising the emitter boards can include all of the sides of the tubular array or all but one of the sides of the tubular array with the one other side comprising the driver board. The driver board can comprise a single driver board or multiple driver boards that are longitudinally connected end to end. The boards can have matingly engageable male and female connectors such that the connectors on the connector end boards matingly engage, connect and plug into matingly engageable female and male connectors on the driver board and/or on the emitter boards.

A multiple sided tubular heat sink comprising multiple metal sides can be positioned radially inwardly of the multi-sided tubular array for supporting and dissipating heat generated from the emitter boards and driver board(s). The heat sink can have a tubular cross-section which can be generally complementary or similar to the cross-sectional configuration of the multi-sided tubular array. The cross-section of the heat sink preferably has a non-curvilinear cross-section without and in the absence of a circular cross-section, oval cross-section, elliptical cross-section and a substantially curved or rounded cross-section.

The improved LED illuminating assembly comprising a multi-sided light bar providing a non-curvilinear (LED) luminary can have emitter traces for connecting the LED emitters in parallel and in series and can have alternating current (AC) and/or direct current (DC) lines. The emitters can comprise at least one row of substantially aligned aliquot uniformly spaced LED emitters. Desirably, the multi-sided light bar provides a no wire design in the absence of electrical wires.

The improved LED illuminating assembly comprising a multi-sided light bar providing a non-curvilinear (LED) luminary can also have a diffuser comprising an elongated light diffuser cover which can provide a light transmissive lens that can be positioned about and cover the LED emitters for reflecting, diffusing and/or focusing light emitted from the LED emitters.

In one embodiment, the lighting bar comprises: a two sided modular LED lighting bar; the array comprises a two sided array; the heat sink comprises a heat sink with at least two sides; and the emitter boards are arranged in a generally V-shaped configuration at an angle of inclination ranging from less than 180 degrees to an angle more than zero degrees; and the driver is positioned in proximity to an open end of the V-shaped configuration.

In another embodiment, the lighting bar comprises: a three sided modular LED lighting bar; the array comprises a three sided delta or triangular array; the heat sink comprises a tubular three sided heat sink with a delta or triangular cross-section; and the angle of inclination can range from less than 180 degrees to an angle more than zero degrees, and is preferably 120 degrees. The driver can be positioned within the interior of the delta or triangular cross-section of the three sided heat sink.

In a further embodiment, the lighting bar comprises: a four sided modular LED lighting bar; the array comprises a square or rectangular array; the heat sink comprises a tubular four sided heat sink with a square or rectangular cross-section; and the angle of inclination can be a right angle of about 90 degrees.

In still another embodiment, the lighting bar comprises: a five sided modular LED lighting bar; the array comprises a pentagon array; the heat sink comprises a tubular five sided heat sink with a pentagon cross-section; and the angle of inclination of the intersecting sides of the pentagon can comprise an acute angle such as at about 72 degrees.

Multi-sided LED light bars, arrays and heat sinks with more than five sides can also be used.

The improved LED illuminating assembly can comprise an illuminated LED sign, such as an outdoor sign or an indoor sig. The outdoor sign can comprise an outdoor menu board, such as for use in a drive through restaurant. The indoor sign can comprise an indoor menu board such as for use in an indoor restaurant. LED signs can also be provided for displays and other uses. The illuminated LED sign can comprise: a housing with light sockets; at least one light transmissive panel providing an illuminated window connected to the housing; multiple sided modular LED lighting bars, which are also referred to as multi-sided light bars, of the type previously described, can be connected to the light sockets for emitting light through the illuminated window; and the illuminated window can be moved from a closed position to an open position for access to the LED lighting bars. The lighting bars can extend vertically, horizontally, longitudinally, transversly or laterally along portions of the housing. The illuminated window can be covered by a diffuser.

The improved LED illuminating assembly can also comprise: an overhead LED lighting assembly providing overhead ceiling light with: translucent ceiling panels comprising light transmissive ceiling tiles; at least one drop ceiling light fixture comprising light sockets; and at least one multiple sided modular LED lighting bar (multi-sided light bar) of the type previously described, connected to the light sockets and positioned above the ceiling panels for emitting light through the translucent ceiling panels in a general downwardly direction and diverging toward a floor or room. One or more concave light reflector can be positioned above the LED lighting bar to reflect light downwardly through the translucent ceiling panel into the room.

Among the many advantages of the light emitting diode (LED) illuminating assemblies provided with a multi-sided LED light bar comprising a non-curvilinear LED luminary are:

1. Superior product.
2. Outstanding performance.
3. Superb illumination.
4. Improved LED lighting.
5. Excellent resistance to breakage and impact.
6. Long useful life span.
7. User friendly.
8. Reliable.
9. Readily transportable.
10. Light weight.
11. Portable.
12. Convenient.
13. Easy to use and install.
14. Less time needed to replace the light bar.
15. Durable
16. Economical.
17. Attractive.
18. Safe.
19. Efficient.
20. Effective.

There are many other advantages of the inventive LED illuminating assembly with a novel multi-sided LED lighting bar comprising a non-curvilinear LED luminary versus conventional LED lighting.

1. The use of multi-sided light bar allows for a much wider distribution of light. A standard solution has about 100-110 degree light beam to half brightness. The inventive LED illuminating assembly with the novel multi-sided LED lighting bar, however, can reach a full 360 degrees with little or no loss of brightness. Furthermore, the illustrated two-sided design can reach over 180 degrees to half-brightness. Another advantage is near-field use; lighting something just a few inches from the light source.
2. The internal driver of the improved LED illuminating assembly with the multi-sided lighting bar is less expensive, uses less labor, is simpler and has lower chance of failure over conventional lighting.
3. The non-switching driver of the improved LED illuminating assembly with the multi-sided lighting bar provides a boost of efficiency on the scale of 4-7 magnitude. A typical switching driver which is used on conventional LED lighting bars has a typical efficiency of 80-85% or 15-20% loss. In contrast, the improved LED illuminating assembly with the multi-sided lighting bar can have an efficiency of 95-97% (3-5% loss), and is four to seven time more efficient than conventional lighting and this improved results in about 20% overall efficiency gain. Desirably, the improved LED illuminating assembly with the multi-sided lighting bar can achieve greater than 90% efficiency, which is practically impossible with conventional switching drivers.

The improved LED illuminating assembly with the multi-sided lighting bar desirably can optimize the emitter count to the voltage source and can advantageously utilize wiring of the emitters in the appropriate numbers in a parallel-series arrangement.

In the improved LED illuminating assembly with the novel multi-sided lighting bar, the diffuser comprising the lens can be modified to change the output of the beam. By use of this arrangement, dark spots can be eliminated so that a much higher illuminating output can be attained. The improved LED illuminating assembly with the multi-sided lighting bar example can emit a 360 degree beam without visible hot or cold spots. The improved LED illuminating assembly with the multi-sided lighting bar can also have scalable length since there is no theoretical limit to the length of the novel arrangement and design. The actual length may be limited, however, by customer needs, costs, available space, and production capabilities.

The improved LED illuminating assembly with the multi-sided lighting bar further can have driver redundancy using parallel and multiple driver sub-circuits for even better reliability. This can achieve two other important goals:

1. The improved LED illuminating assembly with the multi-sided lighting bar can attain even, uniform accurate power levels to all emitters. In contrast, conventional LED designs do not control the current to all the emitters evenly, but apply a metered amount of current to all parallel circuits, typically as many as three to eight of them, and the current can vary on each parallel circuit because there is no control per sub-circuit. The improved LED illuminating assembly with the multi-sided lighting bar can control each sub-circuit independently so that every emitter in the entire light assembly gets exactly the same current.
2. The improved LED illuminating assembly with the multi-sided lighting bar achieves reliability of output during normal operating conditions and in the event of sub-circuit failure.

In a conventional LED design with output 300 mA to three branches or sub-circuits, when one branch fails, then two sub-circuits will share that same 300 mA so they will go from 100 mA to 150 mA, which is a huge change in current that is not desirable and is likely to cause a cascading failure. In the improved LED illuminating assembly with the multi-sided lighting bar, if one sub-circuit fails, the remaining circuits operate exactly as they were before the failure.

Furthermore, in the improved LED illuminating assembly with the multi-sided lighting bar, the sub-circuits can be spread out so that no one portion of the light assembly goes completely dark, but will just dim. This can be very important when lighting up a sign so that although it may be a little darker in one spot, the sign will still illuminate brightly and be readable.

In conventional LED illumination, all the emitters are typically in series with each other so in the event of a single LED failure that entire row blinks out and that entire portion of the light assembly will go dark. In the improved LED illuminating assembly with the multi-sided lighting bar, the strings or set of emitters are aligned and connected in parallel with the other emitter so that in the event of failure of one sub-circuit, the LED lamp of the LED illuminating assembly goes to 50% brightness but is evenly lit from edge to edge.

The improved LED illuminating assembly with the multi-sided lighting bar also achieves efficiency over initial capital costs. Conventional LED designs attempt to maximize lumens per emitter and are designed according to the specification ("spec") of the emitter. Emitters operating 'at spec' tend to net about 80 Lumen/watt total.

The improved LED illuminating assembly with the multi-sided lighting bar can be specifically under-driven to achieve some very valuable goals:

1. Longer life span. For example, an emitter run at 70% of rated capacity will last 70-80,000 hours when specified at 50,000 hours. That's a difference of 8.6 to 5.7 years when operating at 24 hours per day at seven days a week.
2. Higher efficacy. The improved LED illuminating assembly with the multi-sided lighting bar can achieve over 100 L/W system total by de-tuning the current drive of the emitter. The improved LED illuminating assembly with the multi-sided lighting bar can achieve the same total output by adding more emitters. The initial cost maybe higher but the operational cost will be much lower. This is shown in the illustrated operational costs chart which compares the high output 3600 L LED light bar to the high efficiency 3000 L LED light bar with the exact same design but at different drive operating levels because the LEDs are more efficient and last longer when driven below spec.
3 Higher reliability. Within their expected lifespan, LED emitters will maintain lumen longer and maintain color temperature longer when they are cooler, if the temperature is directly proportional to LED drive current. An over-driven LED will lose color temperature accuracy quicker than one driven at spec. An under driven LED can maintain lumen and color temperature longer than even one driven to 'spec'.

The improved LED illuminating assembly can have a no-wire design such that the novel light bar of the improved LED luminary assembly has no electrical wires. This arrangement can decrease assembly time and problems and lower failure rate associated with complexity in a manual labor portion of the assembly. A conventional LED light bar can have 12 or more hand-made solder joints. The new inventive light bar design can include only two hand-made solder joints as well as eliminating 100% of the electrical wiring. Elimination of standard electrical wires can increase both initial and long term reliability and expenses.

Although embodiments of the invention have been shown and described, it is to be understood that various modifications, substitutions, and rearrangements of parts, components, and/or process (method) steps, as well as other uses, shapes, features and arrangements of light emitting diode (LED) illuminating assemblies provided with a multi-sided LED light bar comprising a non-curvilinear LED luminary, can be made by those skilled in the art without departing from the novel spirit and scope of this invention. Furthermore, one or more of the disclosed features of any of the disclosed embodiments can be combined with, added, or substituted for, one or more features of any of the other disclosed embodiments.

What is claimed is:

1. A light emitting diode (LED) illuminating assembly, comprising:

a multiple sided (multi-sided) LED lighting bar comprising a non-curvilinear LED luminary including a multiple sided elongated tubular array comprising several sides comprising boards defining panels and having longitudinally opposite ends, said tubular array having a non-curvilinear cross-sectional configuration in the absence of a circular configuration, oval configuration, elliptical configuration and a substantially curved configuration, each of said sides having a generally planar surface as viewed from the ends of said array, and adjacent sides intersecting each other and converging at an angle of inclination;

an internal non-switching printed circuit board (PCB) driver comprising a driver board being selected from the group consisting of an inner driver board positioned within an interior of said tubular array and an outer driver board comprising one of said sides of said tubular array;

at least two of said sides comprising LED emitter boards providing elongated LED PCB panels, said internal driver driving said LED emitter boards;

a optimal count of LED emitters comprising a group of light emitting diodes (LED) securely positioned on each of said emitter boards for emitting and distributing light outwardly from said emitter boards in a light distribution pattern for enhanced LED illumination and operational efficiency; and at least one end cap PCB connector providing a connector end board positioned at one of the ends of said tubular array and connected to said driver board and said emitter boards, and said connector end board having connector pins extending longitudinally outwardly for engaging a light socket.

2. A LED illuminating assembly in accordance with claim 1 including:

emitter traces for connecting said LED emitters in parallel and in series; and said emitters comprise at least one row of substantially aligned aliquot uniformly spaced LED emitters.

3. A LED illuminating assembly in accordance with claim 1 including alternating current (AC) and/or direct current (DC) lines.

4. A LED illuminating assembly in accordance with claim 1 comprising a no wire design in the absence of electrical wires.

5. A LED illuminating assembly in accordance with claim 1 including an end cap positioned about said end cap PCB connector, said end cap having bracket segments providing clamps extending longitudinally inwardly for abuttingly engaging and clamping a portion of said emitter boards.

6. A LED illuminating assembly in accordance with claim 1 including a diffuser comprising an elongated light diffuser cover providing a light transmissive lens positioned about and covering said LED emitters for reflecting, diffusing and/or focusing light emitted from said LED emitters.

7. A LED illuminating assembly in accordance with claim 1 wherein:

said boards are generally rectangular;

each of said sides comprising emitter boards are selected from the group consisting of a single emitter board and multiple elongated emitter boards longitudinally connected end to end; and said driver board is selected from the group consisting of a single driver board and multiple driver boards longitudinally connected end to end.

8. A LED illuminating assembly in accordance with claim 1 wherein said sides comprising emitter boards are selected from the group consisting of all of said sides of said tubular array or all but one of said sides of said tubular array with the one other side comprising said driver board.

9. A LED illuminating assembly in accordance with claim 1 including a multiple sided heat sink comprising multiple metal sides positioned radially inwardly of said tubular array for supporting and dissipating heat generated from said emitter boards and driver board, said heat sink having a tubular cross-section generally similar to said cross-sectional configuration of said tubular array, and said cross-section of said heat sink having a non-curvilinear cross-section in the absence of a circular cross-section, oval cross-section, elliptical cross-section and a substantially curved cross-section.

10. A LED illuminating assembly in accordance with claim 1 wherein:

said cross-sectional configuration is selected from the group consisting of a delta, triangle, rectangle, square and pentagon;

said angle of inclination of said intersecting sides of said delta or triangle is selected from the group consisting of an angle ranging from less than 180 degrees to an angle more than zero degrees and a 120 degree angle;

said angle of inclination of said intersecting sides of said rectangular or square comprises a right angle of about 90 degrees; and said angle of inclination of said intersecting sides of said pentagon comprises an acute angle.

11. A light emitting diode (LED) illuminating assembly, comprising:

a multiple sided (multi-sided) modular LED lighting bar comprising a non-curvilinear LED luminary including a multi-sided elongated tubular array comprising multiple sides comprising generally rectangular modular boards defining panels and having longitudinally opposite ends, said tubular array having a non-curvilinear cross-sectional configuration in the absence of a circular cross-sectional configuration, oval cross-sectional configuration, elliptical cross-sectional configuration and a substantially curved cross-sectional configuration, each of said sides having a generally planar surface as viewed from the ends of said array, and adjacent sides intersecting each other and converging at an angle of inclination;

an internal non-switching printed circuit board (PCB) driver comprising a driver board being selected from the group consisting of an interior driver board positioned within an interior of said tubular array and an outer driver board comprising one of said sides of said tubular array;

several of said sides comprising modular LED emitter boards providing elongated LED PCB panels, said internal driver driving said LED emitter boards;

LED emitters comprising a group of light emitting diodes securely positioned and arranged on each of said emitter boards for emitting and distributing light outwardly from said emitter boards in a light distribution pattern for enhanced LED illumination;

end caps PCB connectors providing connector end boards positioned at the ends of said tubular array and connected to said internal driver board and said emitter boards, said connector end boards having power connector pins extending longitudinally outwardly for engaging at least one light socket;

end caps positioned about said end cap PCB connectors;

each of said sides comprising said emitter boards selected from the group consisting of a single emitter board and a multiple elongated emitter boards longitudinally connected end to end;

said driver board selected from the group consisting of a single driver board and multiple driver boards longitudinally connected end to end;

said sides comprising emitter boards selected from the group consisting of all of said sides of said tubular array or all but one of said sides of said tubular array with the one other side comprising said driver board; and a multiple sided tubular heat sink comprising multiple metal sides positioned radially inwardly of said tubular array for supporting and dissipating heat generated from said emitter boards and driver board, said heat sink having a tubular cross-section generally similar to said cross-sectional configuration of said tubular array, and said cross-section of said heat sink having a non-curvilinear cross-section in the absence of a circular cross-section, oval cross-section, elliptical cross-section and a substantially curved cross-section.

12. A LED illuminating assembly in accordance with claim 11 including:

emitter traces for connecting said LED emitters in parallel and in series;

said emitters comprise at least one row of substantially aligned aliquot uniformly spaced LED emitters;

alternating current (AC) and/or direct current (DC) lines; and said boards having matingly engageable connectors such that said connectors on said connector end boards matingly engage and connect to matingly engageable connectors on said driver board and said emitter boards.

13. A LED illuminating assembly in accordance with claim 11 including a diffuser comprising an elongated light diffuser cover providing a light transmissive lens positioned about and covering said LED emitters for reflecting, diffusing and/or focusing light emitted from said LED emitters.

14. A LED illuminating assembly in accordance with claim 11 wherein:

said lighting bar comprises a two sided lighting bar;

said array comprises a two sided array;

said heat sink comprises a heat sink with at least two sides;

said emitter boards are arranged in a generally V-shaped configuration at an angle of inclination ranging from less than 180 degrees to an angle more than zero degrees; and said driver is positioned in proximity to an open end of said V-shaped configuration.

15. A LED illuminating assembly in accordance with claim 11 wherein:

said lighting bar comprises a three sided lighting bar;

said array comprises a three sided delta triangular array;

said heat sink is a tubular three sided heat sink with a delta triangular cross-section;

said angle of inclination is selected from the group consisting of an angle of about 120 degrees and an angle ranging from less than 180 degrees to an angle more than zero degrees; and said driver is positioned within the interior of the delta triangular cross-section of said three sided heat sink.

16. A light emitting diode (LED) illuminating assembly, comprising:

an illuminated LED sign selected from the group consisting of an outdoor sign and an indoor sign, said illuminated LED sign comprising a housing with light sockets;

at least one light transmissive panel providing an illuminated window connected to said housing;

multiple sided (multi-sided) modular LED light bars connected to said light sockets for emitting light through said illuminated window;

said illuminated window being movable from a closed position to an open position for access to said LED lighting bars;

each of said LED light bars comprising a non-curvilinear (LED) luminary including a multi-sided elongated tubular array comprising a multitude of sides comprising generally rectangular modular boards defining panels and having longitudinally opposite ends, said tubular array having a non-curvilinear cross-sectional configuration in the absence of a circular cross-sectional configuration, oval cross-sectional configuration, elliptical cross-sectional configuration and a substantially curved cross-sectional configuration, each of said sides having a generally planar surface as viewed from the ends of said array, and adjacent sides intersecting each other and converging at an angle of inclination;

an internal non-switching printed circuit board (PCB) driver comprising a driver board being selected from the group consisting of an inner driver board positioned within an interior of said tubular array and an outer driver board comprising one of said sides of said tubular array;

at least two of said sides comprising modular LED emitter boards providing elongated LED PCB panels, said internal driver driving said LED emitter boards;

a group of LED emitters comprising a light emitting diodes mounted on each of said emitter boards for emitting and distributing light outwardly from said emitter boards in a light distribution pattern for enhanced LED illumination;

end caps PCB connectors providing connector end boards positioned at the ends of said tubular array and connected to said driver board and said emitter boards, said connector end boards having power connector pins extending longitudinally outwardly for engaging at least one light socket, and end caps positioned about said end cap PCB connectors;

each of said sides comprising emitter boards selected from the group consisting of a single emitter board and multiple elongated emitter boards longitudinally connected end to end;

said driver board selected from the group consisting of a single driver board and multiple driver boards longitudinally connected end to end;

said sides comprising emitter board selected from the group consisting of all of said sides of said tubular array or all but one of said sides of said tubular array with the one other side comprising said power board; and a multiple tubular sided heat sink comprising multiple metal sides positioned radially inwardly of said tubular array for supporting and dissipating heat generated from said emitter boards and driver board, said heat sink having a tubular cross-section generally similar to said cross-sectional configuration of said tubular array, and said cross-section of said heat sink having a non-curvilinear cross-section in the absence of a circular cross-section, oval cross-section, elliptical cross-section and a substantially curved cross-section.

17. A LED illuminating assembly in accordance with claim 16 wherein said illuminated LED sign comprises an outdoor menu board.

18. A LED illuminating assembly in accordance with claim 16 wherein said illuminated LED sign comprises an indoor menu board.

19. A LED illuminating assembly in accordance with claim 16 wherein said window comprises a LED illuminating assembly in accordance with claim 1 including a diffuser comprising an elongated light diffuser cover providing a light transmissive lens positioned about and covering said LED emitters for reflecting, diffusing and/or focusing light emitted from said LED emitters.

20. A LED illuminating assembly in accordance with claim 16 including:

emitter traces for connecting said LED emitters in parallel and in series;

said emitters comprise at least one row of substantially aligned aliquot uniformly spaced LED emitters;

alternating current (AC) and/or direct current (DC) lines;

said boards having matingly engageable connectors such that said connectors on said connector end boards matingly engage and connect to matingly engageable connectors on said driver board and said emitter boards;

said cross-sectional configuration is selected from the group consisting of a delta, triangle, rectangle, square and pentagon;

said angle of inclination of said intersecting sides of said delta or triangle is selected from the group consisting of an angle ranging from less than 180 degrees to an angle more than zero degrees and a 120 degree angle;

said angle of inclination of said intersecting sides of said rectangular or square comprises a right angle of about 90 degrees;

said angle of inclination of said intersecting sides of said pentagon comprises an acute angle; and said LED light bars extend vertically, horizontally, transversely, longitudinally or laterally along portions of said housing.

21. A light emitter diode (LED) illuminating assembly, comprising:

an overhead LED lighting assembly providing overhead ceiling lighting including translucent ceiling panels comprising light transmissive ceiling tiles;

at least one drop ceiling light fixture comprising light sockets and at least one multiple sided (multi-sided) modular LED lighting bar connected to said light sockets and positioned above said ceiling panels for emitting light downwardly through said translucent ceiling panels into a room;

each of said lighting bars comprising a non-curvilinear (LED) luminary including a multi-sided elongated tubular array comprising multiple sides comprising general rectangular modular boards defining panels and having longitudinally opposite ends, said tubular array having a non-curvilinear cross-sectional configuration in the absence of a circular cross-sectional configuration, oval cross-sectional configuration, elliptical cross-sectional configuration and a substantially curved configuration, each of said sides having a generally planar surface as viewed from the ends of said array, and adjacent sides intersecting each other and converging at an angle of inclination;

an internal non-switching printed circuit board (PCB) driver comprising a driver board being selected from the group consisting of an interior driver board positioned within an interior of said tubular array and an outer driver board comprising one of said sides of said tubular array;

several of said sides comprising modular LED emitter boards providing elongated LED PCB panels, said internal driver driving said LED emitter boards;

LED emitters comprising a group of light emitting diodes securely positioned and arranged on each of said emitter boards for emitting and distributing light outwardly from said emitter boards in a light distribution pattern for enhanced LED illumination;

end caps PCB connectors providing connector end boards positioned at the ends of said tubular array and connected to said internal driver board and said emitter boards, said connector end boards having connector pins extending longitudinally outwardly for engaging at least one light socket, and end caps positioned about said end cap PCB connectors;

each of said sides comprising emitter boards selected from the group consisting of a single emitter board and multiple elongated emitter boards longitudinally connected end to end;

said driver board selected from the group consisting of a single driver board and multiple driver boards longitudinally connected end to end;

said sides comprising emitter board selected from the group consisting of all of said sides of said tubular array or all but one of said sides of said tubular array with the one other side comprising said driver board;

a multiple sided tubular heat sink comprising multiple metal sides positioned radially inwardly of said tubular array for supporting and dissipating heat generated from said emitter boards and driver board, said heat sink having a tubular cross-section generally similar to said cross-sectional configuration of said tubular array, and said cross-section of said heat sink having a non-curvilinear cross-section in the absence of a circular cross-section, oval cross-section, elliptical cross-section and a substantially curved cross-section; and each of said translucent ceiling panels including a diffuser comprising an elongated light diffuser cover providing a light transmissive lens positioned about and covering said LED emitters for reflecting, diffusing and/or focusing light emitted from said LED emitters.

22. A LED illuminating assembly in accordance with claim 21 including:

emitter traces for connecting said LED emitters in parallel and in series;

said emitters comprise at least one row of substantially aligned aliquot uniformly spaced LED emitters;

alternating current (AC) and/or direct current (DC) lines;

said boards having matingly engageable connectors such that said connectors on said connector end boards matingly engage and connect to matingly engageable connectors on said driver board and said emitter boards;

said cross-sectional configuration is selected from the group consisting of a delta, triangle, rectangle, square and pentagon;

said angle of inclination of said intersecting sides of said delta or triangle is selected from the group consisting of an angle ranging from less than 180 degrees to an angle more than zero degrees and a 120 degree angle;

said angle of inclination of said intersecting sides of said rectangular or square comprises a right angle of about 90 degrees;

said angle of inclination of said intersecting sides of said pentagon comprises an acute angle; and said drop ceiling light fixture further comprises at least one concave light reflector positioned above said LED lighting bar to reflect light generally downwardly through said diffuser towards a floor.

* * * * *